US008700290B2

(12) United States Patent
Miyamoto et al.

(10) Patent No.: US 8,700,290 B2
(45) Date of Patent: Apr. 15, 2014

(54) ABNORMALITY DETERMINATION SYSTEM FOR MULTI-CYLINDER INTERNAL COMBUSTION ENGINE

(75) Inventors: Hiroshi Miyamoto, Susono (JP); Yasushi Iwazaki, Ebina (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 360 days.

(21) Appl. No.: 13/185,015

(22) Filed: Jul. 18, 2011

(65) Prior Publication Data

US 2012/0022772 A1 Jan. 26, 2012

(30) Foreign Application Priority Data

Jul. 20, 2010 (JP) ..... 2010-162752

(51) Int. Cl.
*F02D 41/30* (2006.01)
*F02D 28/00* (2006.01)
*F02D 19/02* (2006.01)

(52) U.S. Cl.
USPC ..... 701/103; 701/104; 701/109; 123/674; 123/698

(58) Field of Classification Search
USPC ..... 123/1 A, 173.3, 179.13–179.16, 304, 123/516, 518–520, 525, 527, 575, 576, 123/578; 701/102, 103, 104, 109, 31.8, 701/29.1–29.2
See application file for complete search history.

(56) References Cited

U.S. PATENT DOCUMENTS

| | | | | |
|---|---|---|---|---|
| 4,724,814 | A * | 2/1988 | Mieno et al. | 123/688 |
| 6,032,659 | A * | 3/2000 | Yamashita et al. | 123/674 |
| 6,736,121 | B2 * | 5/2004 | Gopichandra | 123/688 |
| 7,152,594 | B2 | 12/2006 | Anilovich et al. | |
| 8,370,043 | B2 * | 2/2013 | Kidokoro et al. | 701/99 |
| 8,447,497 | B2 * | 5/2013 | Iwazaki et al. | 701/103 |
| 8,560,208 | B2 * | 10/2013 | Miyamoto et al. | 701/103 |
| 2009/0037079 | A1 * | 2/2009 | Suzuki et al. | 701/103 |
| 2009/0260419 | A1 * | 10/2009 | Maeda et al. | 73/23.32 |
| 2013/0261934 | A1 * | 10/2013 | Iwazaki et al. | 701/103 |

FOREIGN PATENT DOCUMENTS

| | | | |
|---|---|---|---|
| JP | 11072473 | A | 3/1999 |
| JP | 2000065782 | A | 3/2000 |
| JP | 2004069547 | A | 3/2004 |

* cited by examiner

*Primary Examiner* — Stephen K Cronin
*Assistant Examiner* — Carl Staubach
(74) *Attorney, Agent, or Firm* — Gifford, Krass, Sprinkle, Anderson & Citkowski, P.C.

(57) ABSTRACT

When the ratio of the amount of vaporized fuel (purge amount) to be introduced into an intake passage of an engine from a fuel tank through a purge passage pipe, a purge control valve, etc. to the total amount of fuel (total fuel amount) to be supplied to the engine is large, an abnormality determination system acquires, as a parameter Pon, the air-fuel ratio imbalance index value that increases as the difference between the air-fuel ratios of the respective cylinders increases. When the purge amount is small relative to the total fuel amount, the determination system acquires the air-fuel ratio imbalance index value as a parameter Poff. When the difference between the parameters Pon and Poff is less than a predetermined value and at least one of these parameters is greater than a predetermined threshold value, the determination system determines that an inter-cylinder air intake amount variation abnormality is occurring.

5 Claims, 24 Drawing Sheets

VAPORIZED FUEL RATIO (VAPORIZED FUEL AMOUNT / TOTAL AMOUNT OF SUPPLIED FUEL) SMALL (0%)

VAPORIZED FUEL RATIO (VAPORIZED FUEL AMOUNT / TOTAL AMOUNT OF SUPPLIED FUEL) LARGE (50%)

VAPORIZED FUEL RATIO (VAPORIZED FUEL AMOUNT / TOTAL AMOUNT OF SUPPLIED FUEL) SMALL (0%)

VAPORIZED FUEL RATIO (VAPORIZED FUEL AMOUNT / TOTAL AMOUNT OF SUPPLIED FUEL) LARGE (50%)

ABNORMALITY DETERMINATION SYSTEM FOR MULTI-CYLINDER INTERNAL COMBUSTION ENGINE

CROSS-REFERENCE TO RELATED APPLICATIONS

This application claims priority to Japanese Patent Application No. 2010-162752 filed on Jul. 20, 2010, which is incorporated herein by reference in its entirety including the specification, drawings and abstract.

BACKGROUND OF THE INVENTION

1. Field of the Invention

The invention relates to an abnormality determination system for a multi-cylinder internal combustion engine having a vaporized fuel purge device that introduces the vaporized fuel that has occurred in a fuel tank into an intake passage of the engine, the abnormality determination system being capable of determining whether an intake air amount abnormality that "the degree of imbalance in the amount of intake air to be supplied to each of a plurality of cylinders between the plurality of cylinders is equal to or greater than an allowable value" is occurring.

2. Description of Related Art

A widely adopted electronic fuel injection type internal combustion engine includes at least one fuel injection valve in each cylinder or in each intake port communicating with the corresponding cylinder. Thus, when the characteristics of the fuel injection valve of a particular cylinder become "the characteristics such that a smaller amount of fuel than the instructed fuel injection amount is injected", only the air-fuel ratio of the mixture to be supplied to the particular cylinder becomes significantly leaner. As a result, the degree of imbalance in air-fuel ratio between the cylinders increases. In other words, a state, in which an imbalance in cylinder-specific air-fuel ratio that is the air-fuel ratio of the mixture to be supplied to each cylinder (the imbalance in air-fuel ratio between cylinders) is occurring, is brought about. The imbalance in air-fuel ratio between cylinders occurs also when, for example, the characteristics of the fuel injection valve of a particular cylinder become "the characteristics such that a larger amount of fuel than the instructed fuel injection amount is injected".

In this specification, the cylinder, for which the air-fuel ratio of the mixture to be supplied has a normal value (in general, near the stoichiometric air-fuel ratio) is referred to as "the non-imbalance cylinder" or "the normal cylinder". The air-fuel ratio of the mixture to be supplied to the non-imbalance cylinder is referred to also as "the air-fuel ratio of the non-imbalance cylinder" or "the air-fuel ratio of the normal cylinder". On the other hand, the cylinder, to which the mixture whose air-fuel ratio deviates from the air-fuel ratio of the mixture to be supplied to the non-imbalance cylinder is supplied, is referred to also as "the imbalance cylinder". The air-fuel ratio of the mixture to be supplied to the imbalance cylinder is referred to also as "the air-fuel ratio of the imbalance cylinder".

When the imbalance in air-fuel ratio between the cylinders occurs, the exhaust gas from the imbalance cylinder and the exhaust gas from the non-imbalance cylinder are alternately discharged into the exhaust passage. Thus, the air-fuel ratio of the exhaust gas varies relatively significantly, so that the output value of the air-fuel ratio sensor that is disposed in the exhaust gas joining portion, at which the exhaust gases from a plurality of cylinders join, also varies significantly. Thus, a conventional abnormality determination system acquires the trace length of the output value of the air-fuel ratio sensor, compares the trace length with the "reference value that varies according to the engine speed", and, based on the result of comparison, determines whether the imbalance in air-fuel ratio between cylinders is occurring (see U.S. Pat. No. 7,152,594, for example).

The parameter, such as the trace length of the output value of the air-fuel ratio sensor, that is determined based on the output value of the air-fuel ratio sensor and reflects "the magnitude of the variation of the air-fuel ratio of the exhaust gas that increases as the degree of imbalance in cylinder-specific air-fuel ratio increases" is referred to also as the air-fuel ratio imbalance index value or the imbalance determination parameter.

The imbalance in air-fuel ratio between cylinders occurs not only when the degree of imbalance, between cylinders, in the amount of injected fuel (cylinder-specific fuel injection amount) to be supplied to each cylinder increases (when the imbalance in fuel injection amount between cylinders occurs) because of the abnormal characteristics of the fuel injection valve of a particular cylinder but also when the degree of imbalance, between cylinders, in the amount of air to be supplied to each cylinder (cylinder-specific intake air amount) increases (when the imbalance in intake air amount between cylinders occurs). Also when the imbalance in intake air amount between cylinders occurs, the air-fuel ratio of the exhaust gas varies relatively significantly and the air-fuel ratio imbalance index value therefore increases.

Thus, when the air-fuel ratio imbalance index value increases, it is impossible to determine whether the cause is that "the imbalance in fuel injection amount between cylinders is occurring" or "the imbalance in intake air amount between cylinders is occurring" because an abnormality occurs in the parts of the air intake system, etc. This will be described in detail with reference to FIGS. 1A and 1B.

(A1), (A2), and (A3) of FIG. 1A respectively show "the intake air amount, the fuel injection amount, and the air-fuel ratio" of each cylinder when "the amount of air taken into a particular cylinder (fourth cylinder in FIG. 1A)" becomes twice "the amount of air taken into each of the remaining cylinders (first to third cylinders)".

(B1), (B2), and (B3) of FIG. 1B respectively show "the intake air amount, the fuel injection amount, and the air-fuel ratio" of each cylinder when "the amount of fuel injected through the fuel injection valve of the particular cylinder (fourth cylinder in FIG. 1B)" becomes half of "the amount of fuel injected through the fuel injection valve of each of the remaining cylinders (first to third cylinders)".

Note that (A1) and (B1) of FIGS. 1A and 1B show the intake air amount of each of the other cylinders when the intake air amount of the first cylinder is assumed to be "1". (A2) and (B2) of FIGS. 1A and 1B show the fuel injection amount of each of the other cylinders when the fuel injection amount of the first cylinder is assumed to be "1". In addition, (A3) and (B3) of FIGS. 1A and 1B show the air-fuel ratio of each of the other cylinders when the air-fuel ratio of the first cylinder is assumed to be "1".

As shown in (A1), (A2), and (A3) of FIG. 1A, when "the imbalance in intake air amount between cylinders" such that the intake air amount of the fourth cylinder becomes twice the intake air amount of each of the other cylinders occurs, the air-fuel ratio of the fourth cylinder becomes twice the air-fuel ratio of each of the other cylinders. As shown in (B1), (B2), and (B3) of FIG. 1B, when "the imbalance in fuel injection amount" such that the fuel injection amount of the fourth cylinder becomes half of the fuel injection amount of each of the other cylinders occurs, the air-fuel ratio of the fourth cylinder becomes twice the air-fuel ratio of each of the other cylinders. As a result, in either of these cases, the air-fuel ratio imbalance index value is substantially the same.

In conventional abnormality determination systems, however, "the inter-cylinder air intake amount variation abnormality" and "the inter-cylinder fuel injection amount variation abnormality" are not distinguished, and therefore, even when the inter-cylinder air intake amount variation abnormality is occurring actually, it is determined that "the inter-cylinder fuel injection amount variation abnormality" is occurring, for example.

SUMMARY OF THE INVENTION

The invention provides "an abnormality determination system for a multi-cylinder internal combustion engine" that is capable of determining "whether the inter-cylinder air intake amount variation abnormality is occurring".

The inventors have found that "it may be determined that the inter-cylinder air intake amount variation abnormality is occurring when both the air-fuel ratio imbalance index value acquired when a large amount of vaporized fuel that has occurred in the fuel tank is purged (that is, when a large amount of vaporized fuel that has occurred in the fuel tank is introduced into the intake passage to supply it to the engine) and the air-fuel ratio imbalance index value acquired when not a large amount of vaporized fuel that has occurred in the fuel tank is purged are acquired, these values are close to each other, and at least one of these values is equal to or greater than a threshold value". These findings will be described in more detail with reference to FIGS. 2A and 2B and FIGS. 3A and 3B.

FIGS. 2A and 2B show the respective values when the inter-cylinder fuel injection amount variation abnormality is not occurring and the inter-cylinder air intake amount variation abnormality is occurring.

(A1), (A2), and (A3) of FIG. 2A respectively show "the actual intake air amount, the actual fuel injection amount, and the actual air-fuel ratio" of each cylinder when "the amount of air taken into the fourth cylinder (imbalance cylinder)" becomes twice "the amount of air taken into each of the first to third cylinders (normal cylinders)" and the vaporized fuel ratio (or purge ratio) is small ("0%" in this example). Note that in these drawings, each of "the actual intake air amount, the actual fuel injection amount, and the actual air-fuel ratio" of the first cylinder, which is one of the normal cylinders, is assumed to be "1". In this case, as shown in (A3) of FIG. 2A, the air-fuel ratio of the fourth cylinder (imbalance cylinder) becomes twice the air-fuel ratio of the normal cylinders (first to third cylinders).

The vaporized fuel ratio is the ratio of the amount of fuel (APrg) to be supplied to the engine by purging the vaporized fuel to the total fuel supply amount TF (=sum (AInj+APrg) of the amount of fuel (AInj) to be supplied to the engine through fuel injection via the fuel injection valves and the amount of fuel (APrg) to be supplied to the engine by purging the vaporized fuel). Specifically, the vaporized fuel ratio $\gamma$ is APrg/(AInj+APrg). The amount of fuel to be supplied to the engine by purging the vaporized fuel will be hereinafter referred to also as "the purge amount".

(B1), (B2), and (B3) of FIG. 2B respectively show "the actual intake air amount, the actual fuel injection amount, and the actual air-fuel ratio" of each cylinder when "the amount of air taken into the fourth cylinder (imbalance cylinder)" becomes twice "the amount of air taken into each of the first to third cylinders (normal cylinders)" and the vaporized fuel ratio (or purge ratio) is large ("approximately 50%" in this example). Note that in these drawings, each of "the actual intake air amount, the actual fuel injection amount, and the actual air-fuel ratio" of the first cylinder, which is one of the normal cylinders, is assumed to be "1".

The instructed fuel injection amount to be supplied to the fuel injection valve is feedback-controlled using the common feedback amount for all the plurality of cylinders so that the air-fuel ratio of the exhaust gas that is detected by the air-fuel ratio sensor is brought to the target air-fuel ratio (stoichiometric air-fuel ratio, for example). Thus, the instructed fuel injection amount to be supplied to the fuel injection valves when the vaporized fuel ratio is 50% is half of the instructed fuel injection amount to be supplied to the fuel injection valves when the vaporized fuel ratio is 0%. In this case, the fuel injection valves are normal and therefore, as shown in (B2) of FIG. 2B, the actual fuel injection amount becomes "half of the actual fuel injection amount shown in (A2) of FIG. 2A". As a result, the amounts of fuel to be supplied to the cylinders are the same. Thus, even in this case, the air-fuel ratio of the fourth cylinder (imbalance cylinder) is twice the air-fuel ratio of the normal cylinders (first to third cylinders) as shown in (B3) of FIG. 2B.

In this way, when the inter-cylinder air intake amount variation abnormality occurs, the degree of imbalance in cylinder-specific air-fuel ratio is substantially the same both in the case where the vaporized fuel ratio is large and in the case where the vaporized fuel ratio is small. Thus, the air-fuel ratio imbalance index value is also substantially the same.

FIGS. 3A and 3B show the respective values when the inter-cylinder fuel injection amount variation abnormality is occurring and the inter-cylinder air intake amount variation abnormality is not occurring.

(A1), (A2), and (A3) of FIG. 3A respectively show "the actual intake air amount, the actual fuel injection amount, and the actual air-fuel ratio" of each cylinder when "the amount of fuel injected through the fuel injection valve of the fourth cylinder (imbalance cylinder)" becomes half of "the amount of fuel injected through the fuel injection valve of each of the first to third cylinders (normal cylinders)" and the vaporized fuel ratio (or purge ratio) is small ("0%" in this example). Note that in these drawings, each of "the actual intake air amount, the actual fuel injection amount, and the actual air-fuel ratio" of the first cylinder, which is one of the normal cylinders, is assumed to be "1". In this case, as shown in (A3) of FIG. 3A, the air-fuel ratio of the fourth cylinder (imbalance cylinder) becomes twice the air-fuel ratio of the normal cylinders (first to third cylinders).

(B1), (B2), and (B3) of FIG. 3B respectively show "the actual intake air amount, the actual fuel injection amount, and the actual air-fuel ratio" of each cylinder when "the amount of fuel injected through the fuel injection valve of the fourth cylinder (imbalance cylinder)" becomes half of "the amount of fuel injected through the fuel injection valve of each of the first to third cylinders (normal cylinders)" and the vaporized fuel ratio (or purge ratio) is large ("approximately 50%" in this example). Note that in these drawings, each of "the actual intake air amount, the actual fuel injection amount, and the actual air-fuel ratio" of the first cylinder, which is one of the normal cylinders, is assumed to be "1".

In this example, the fuel injection valve of the fourth cylinder injects fuel, whose amount is half (50%) of the instructed fuel injection amount, and the fuel injection valve of each of the other cylinders injects fuel, whose amount is 100% of the instructed fuel injection amount. Thus, when half (0.5) of the total amount (1) of fuel to be supplied to the first cylinder is the vaporized fuel and the remaining half (0.5)

thereof is the fuel injected through the fuel injection valve for the first cylinder, the amount of vaporized fuel to be supplied to the fourth cylinder is "0.5" and the amount of injected fuel to be supplied to the fourth cylinder through the fuel injection valve for the fourth cylinder is 0.25 (=0.5.50%). That is, in this case, when it is assumed that the total amount of fuel to be supplied to the first cylinder is "1", the total amount of fuel to be supplied to the fourth cylinder is "0.75". As a result, as shown in (B3) of FIG. 2B, the air-fuel ratio of the fourth cylinder (imbalance cylinder) is approximately 1.33 (=1/0.75) times the air-fuel ratio of the normal cylinders (first to third cylinders).

In this way, when the inter-cylinder fuel injection amount variation abnormality occurs, the degree of imbalance in cylinder-specific air-fuel ratio is significantly different between the case where the vaporized fuel ratio is large and the case where the vaporized fuel ratio is small. Thus, the air-fuel ratio imbalance index value is also significantly different between these cases.

As can be understood from the above explanation, when the air-fuel ratio imbalance index value is large and the difference between the air-fuel ratio imbalance index value acquired when the vaporized fuel ratio is large and the air-fuel ratio imbalance index value acquired when the vaporized fuel ratio is small is small, it may be determined that what is occurring is not the inter-cylinder fuel injection amount variation abnormality but the inter-cylinder air intake amount variation abnormality.

An abnormality determination system for a multi-cylinder internal combustion engine of the invention (hereinafter also referred to as "the determination system") is a system that is configured based on the above findings.

More specifically, the determination system includes: a plurality of fuel injection valves configured to inject fuel that is a component of a mixture to be supplied to combustion chambers of a plurality of cylinders of the engine; a vaporized fuel purge device that introduces, into an intake passage of the engine, vaporized fuel that has occurred in a fuel tank for storing the fuel to be supplied to the fuel injection valves; and a vaporized fuel purge amount control section that controls a purge amount that is an amount of vaporized fuel that is introduced into the intake passage according to the operating condition of the engine (the engine load, the engine speed, etc.).

In addition, the determination system includes: an air-fuel ratio sensor that is disposed at a position downstream of an exhaust gas joining portion of an exhaust passage of the engine, at which exhaust gases of the plurality of cylinders join, and that generates an output value corresponding to "an air-fuel ratio of an exhaust gas that passes through the position"; an instructed fuel injection amount determination section that determines an instructed fuel injection amount that is "a command value of an amount of fuel to be injected through each of the plurality of fuel injection valves" by feedback correcting the amount of fuel that is injected through each of the fuel injection valves so that the air-fuel ratio indicated by the output value of the air-fuel ratio sensor is brought to a predetermined target air-fuel ratio; an injection command signal sending section that sends an injection command signal to the plurality of fuel injection valves so that the fuel, whose amount corresponds to the instructed fuel injection amount, is injected through each of the plurality of fuel injection valves; an index value acquisition section that, based on the output value of the air-fuel ratio sensor, acquires an air-fuel ratio imbalance index value that increases as the degree of imbalance, between the plurality of cylinders, in cylinder-specific air-fuel ratio that is an air-fuel ratio of the mixture to be supplied to each of the plurality of cylinders increases; and an abnormality determination section that determines whether an abnormality is occurring based on the air-fuel ratio imbalance index value.

The air-fuel ratio imbalance index value can be calculated by various methods as described later.

Moreover, the index value acquisition section acquires, as a large purge amount case parameter, the air-fuel ratio imbalance index value that is acquired while a vaporized fuel ratio that is a ratio of the amount of vaporized fuel to be supplied to the engine to the total amount of fuel to be supplied to the engine is equal to or higher than a first predetermined value. In addition, the index value acquisition section acquires, as a small purge amount case parameter, the air-fuel ratio imbalance index value that is acquired while the vaporized fuel ratio is lower than "a second predetermined value that is equal to or less than the first predetermined value".

The abnormality determination section is configured so that when an absolute value of a difference between the small purge amount case parameter and the large purge amount case parameter is less than a first abnormality determination threshold value and one of following conditions is satisfied: the small purge amount case parameter is equal to or greater than a second abnormality determination threshold value; and the large purge amount case parameter is equal to or greater than a third abnormality determination threshold value, the abnormality determination section determines that "an intake air amount abnormality that a degree of imbalance, between the plurality of cylinders, in an amount of intake air to be supplied to each of the plurality of cylinders is equal to or greater than an allowable value is occurring".

As described above, when the inter-cylinder air intake amount variation abnormality occurs, the absolute value of the difference between the small purge amount case parameter and the large purge amount case parameter is less than a predetermined value (that is, the first abnormality determination threshold value) and at least one of the small purge amount case parameter and the large purge amount case parameter is equal to or greater than the corresponding predetermined value. On the other hand, when the inter-cylinder fuel injection amount variation abnormality occurs, the absolute value of the difference between the small purge amount case parameter and the large purge amount case parameter is equal to or greater than a predetermined value (that is, the first abnormality determination threshold value).

Thus, according to the determination system, it is possible to reliably determine the occurrence of the inter-cylinder air intake amount variation abnormality.

In a mode of the determination system, the abnormality determination section may be configured to determine that an abnormality is occurring in the fuel injection valves (the inter-cylinder fuel injection amount variation abnormality is occurring) when the absolute value of the difference between the small purge amount case parameter and the large purge amount case parameter is equal to or greater than the first abnormality determination threshold value.

In this case, the vaporized fuel purge amount control section may be configured to control the purge amount to zero when a purge inhibition request has been issued based on the operating condition of the engine and allow control to set the purge amount to a set value that is not zero even when the purge inhibition request has been issued, provided that the abnormality determination section determines that there is an abnormality in the fuel injection valves.

Depending on the operating conditions of the engine, a request to inhibit the introduction of the vaporized fuel into the intake passage of the engine is issued. Meanwhile, when the vaporized fuel is introduced into the intake passage of the engine, the corresponding amount of fuel injection is reduced by correction (feedback corrected). Specifically, the instructed fuel injection amount is reduced. Thus, when it is determined that the inter-cylinder fuel injection amount variation abnormality is occurring, even when the purge inhibition request has been issued, the introduction of the vaporized fuel into the intake passage of the engine (control to set the purge amount to a set value that is not zero) is allowed, so that it is possible to increase the chance to reduce the influence of the imbalance in fuel injection amount between cylinders. As a result, it becomes possible to suppress the deterioration of emission.

In another mode of the determination system, the vaporized fuel purge amount control section may be such that, when the large purge amount case parameter has already been acquired but the small purge amount case parameter has not been acquired yet, the vaporized fuel purge amount control section controls the purge amount so that a chance that the vaporized fuel ratio becomes less than the second predetermined value increases as compared to a case where neither the large purge amount case parameter nor the small purge amount case parameter has been acquired yet.

According to this mode, it is possible to increase the chance to calculate the small purge amount case parameter when the large purge amount case parameter has already been acquired but the small purge amount case parameter has not been acquired yet. As a result, it is possible to acquire both the large purge amount case parameter and the small purge amount case parameter early and therefore, it becomes possible to perform the abnormality determination early.

In another mode of the determination system, the vaporized fuel purge amount control section may be such that, when the small purge amount case parameter has already been acquired but the large purge amount case parameter has not been acquired yet, the vaporized fuel purge amount control section controls the purge amount so that a chance that the vaporized fuel ratio becomes equal to or higher than the first predetermined value increases as compared to a case where neither the large purge amount case parameter nor the small purge amount case parameter has been acquired yet.

According to this mode, it is possible to increase the chance that the large purge amount case parameter is calculated when the small purge amount case parameter has already been acquired but the large purge amount case parameter has not been acquired yet. As a result, it is possible to acquire both the large purge amount case parameter and the small purge amount case parameter early and therefore, it becomes possible to perform the abnormality determination early.

Other objects, other features, and accompanying advantages of the system of the invention will be easily understood from the description of embodiments of the invention given below with reference to the drawings.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Abnormality determination systems for multi-cylinder internal combustion engines according to embodiments of the invention (hereinafter also referred to merely as the "determination system") will be described below with reference to the drawings. The determination system is part of an air-fuel ratio controller for controlling the air-fuel ratio of the mixture to be supplied to the internal combustion engine (air-fuel ratio in the engine) and at the same time, part of a fuel injection amount controller for controlling the amount of fuel injection and a vaporized fuel purge amount controller.

First Embodiment

Figure 4:
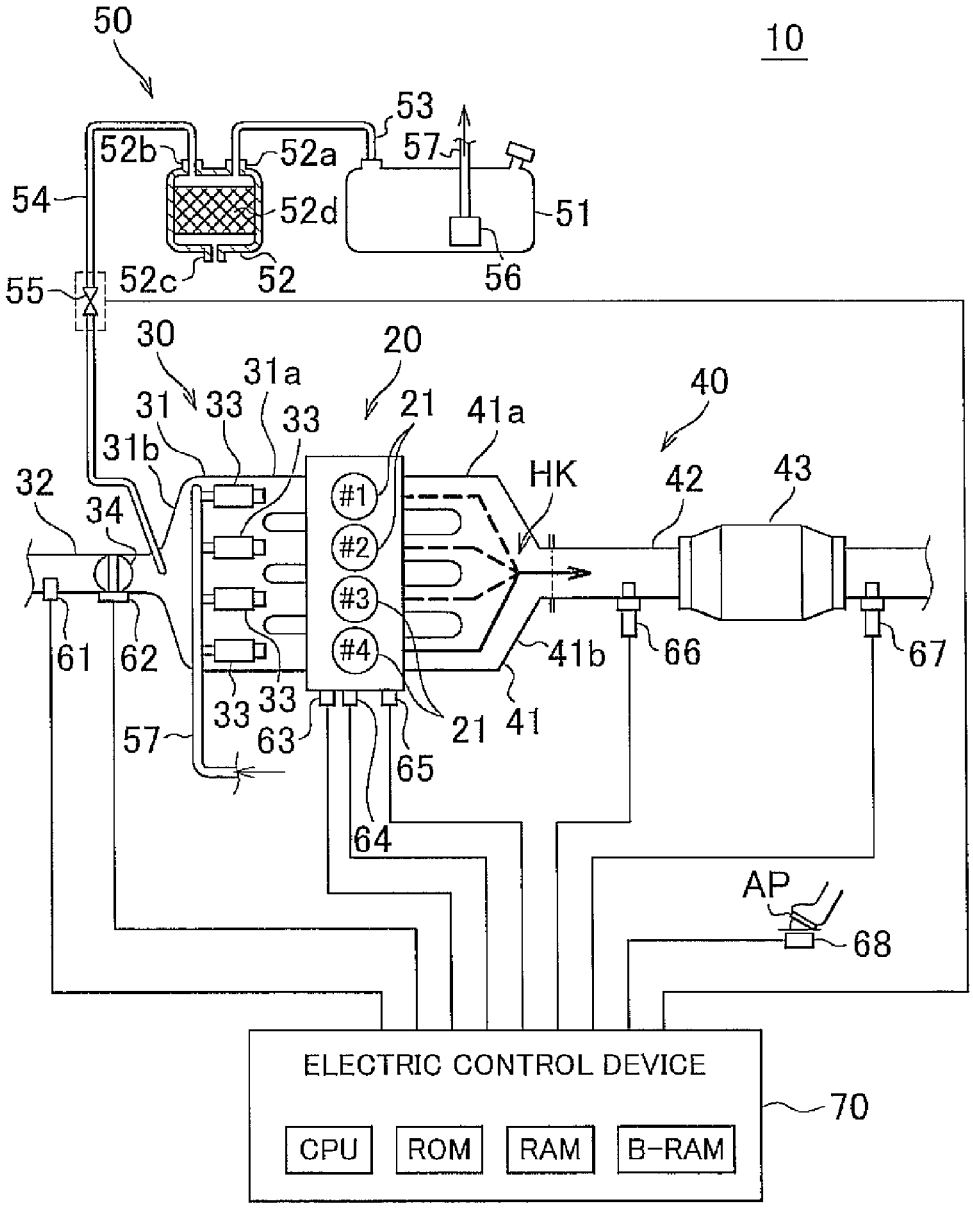
FIG. 4 is a schematic plan view of an internal combustion engine, to which an abnormality determination system according to each of embodiments of the invention is applied.

FIG. 4 shows a schematic configuration of a system, in which a determination system according to a first embodiment (hereinafter also referred to as the "first determination system") is used in a four-cycle spark-ignition multi-cylinder (four-cylinder) internal combustion engine 10.

The internal combustion engine 10 includes an engine body 20, an intake system 30, an exhaust system 40, and a vaporized fuel supply system 50.

The engine body 20 includes a cylinder block portion and a cylinder head portion. The engine body 20 also includes a plurality of cylinders (combustion chambers) 21. The cylinders communicate with the "intake ports" and the "exhaust ports" (not shown). The communication portion between the intake port and the combustion chamber 21 is opened and closed by an intake valve (not shown). The communication portion between the exhaust port and the combustion chamber 21 is opened and closed by an exhaust valve (not shown). A spark plug (not shown) is provided in each of the combustion chambers 21.

The intake system 30 includes an intake manifold 31, an intake pipe 32, a plurality of fuel injection valves 33, and a throttle valve 34.

The intake manifold 31 includes a plurality of branches 31*a* and a surge tank 31*b*. One ends of the plurality of branches 31*a* are connected to the plurality of intake ports. The other ends of the plurality of branches 31*a* are connected to the surge tank 31*b*.

One end of the intake pipe 32 is connected to the surge tank 31*b*. An air filter (not shown) is disposed at the other end of the intake pipe 32.

The fuel injection valve 33 is provided for each of the cylinders (combustion chambers) 21. The fuel injection valves 33 are provided in the intake ports. That is, each of the cylinders is provided with the fuel injection valve 33 that performs fuel supply independently of the fuel supply to the other cylinders. The fuel injection valve 33 is configured to inject, into the intake port (that is, the cylinder corresponding to the fuel injection valve 33), "fuel, whose amount is the instructed fuel injection amount indicated by an injection command signal" in response to the injection command signal when the fuel injection valve 33 is normal.

More specifically, the fuel injection valve 33 is opened for a period of time corresponding to the instructed fuel injection amount. The fuel injection valve 33 is supplied with fuel via a fuel supply pipe 57 connected to a fuel tank 51 to be described later. The pressure of the fuel supplied to the fuel injection valve 33 is controlled by a pressure regulator (not shown) so that the difference between the pressure of the fuel and the pressure in the intake port is kept constant. Thus, when the fuel injection valve 33 is normal, the fuel injection valve 33 injects fuel, whose amount is equal to the instructed fuel injection amount. When an abnormality occurs in the fuel injection valve 33, however, the fuel injection valve 33 injects fuel, whose amount is different from the instructed fuel injection amount. This results in the occurrence of an imbalance in cylinder-specific air-fuel ratio between cylinders.

The throttle valve 34 is rotatably disposed in the intake pipe 32. The throttle valve 34 is configured to vary the cross-sectional area of the opening of the intake passage. The throttle valve 34 is configured to be rotated in the intake pipe 32 via a throttle valve actuator (not shown).

The exhaust system 40 includes an exhaust manifold 41, an exhaust pipe 42, an upstream-side catalyst 43 that is disposed in the exhaust pipe 42, and "a downstream side catalyst (not shown)" that is disposed in the exhaust pipe 42 downstream of the upstream-side catalyst 43.

The exhaust manifold 41 includes a plurality of branches 41*a* and a confluence portion 41*b*. One ends of the plurality of branches 41*a* are connected to the plurality of exhaust ports. The other ends of the plurality of branches 41*a* are joined at the confluence portion 41*b*. The confluence portion 41*b* is a portion, at which the exhaust gases discharged from a plurality of cylinders (two or more cylinders, which is, in this embodiment, four cylinders) join, and for this reason, this portion is also referred to as the exhaust gas joining portion HK.

The exhaust pipe 42 is connected to the confluence portion 41*b*. The exhaust ports, the exhaust manifold 41, and the exhaust pipe 42 constitute the exhaust passage.

Each of the upstream-side catalyst 43 and the downstream-side catalyst is a three-way catalytic converter (exhaust gas controlling catalyst) that carries an active component including noble metal (catalytic substance), such as platinum, rhodium, or palladium. Each catalyst has a function of oxidizing the unburned components, such as HC, CO, and $H_2$ and reducing nitrogen oxides (NOx) when the air-fuel ratio of the gas that flows into these catalytic converters is the "air-fuel ratio within the window of the three-way catalyst (which is the stoichiometric air-fuel ratio, for example)". This function is referred to also as the catalytic function. In addition, each catalyst has an oxygen adsorbing function of adsorbing (storing) oxygen. The catalyst reduces the unburned components and the nitrogen oxides even when the air-fuel ratio varies from the stoichiometric air-fuel ratio, owing to the oxygen adsorbing function. That is, the window is widened owing to the oxygen adsorbing function. The oxygen adsorbing function is brought about by the oxygen adsorbing material such as ceria ($CeO_2$) that is carried by the catalyst.

The vaporized fuel supply system 50 includes the fuel tank 51, a canister 52, a vapor collecting pipe 53, a purge passage pipe 54, a purge control valve 55, and a fuel pump 56.

The fuel tank 51 stores the fuel that is to be supplied to the engine 10 through the fuel injection valves 33.

The canister 52 is a "common charcoal canister" that adsorbs the vaporized fuel (vaporized fuel gas) that has occurred in the fuel tank 51. The canister 52 includes a housing that has a tank port 52*a*, a purge port 52*b*, and an atmospheric port 52*c* that is open to the atmosphere. The canister 52 contains, in the housing, an adsorbent 52*d* for adsorbing the vaporized fuel.

One end of the vapor collecting pipe 53 is connected to an upper portion of the fuel tank 51 and the other end of the vapor collecting pipe 53 is connected to the tank port 52*a*. The vapor collecting pipe 53 is a pipe that introduces, from the fuel tank 51 to the canister 52, the vaporized fuel that has occurred in the fuel tank 51.

One end of the purge passage pipe 54 is connected to the purge port 52*b*. The other end of the purge passage pipe 54 is connected to the surge tank 31*b* (that is, the intake passage downstream of the throttle valve 34). The purge passage pipe 54 is a pipe for introducing, to the surge tank 31*b*, the vaporized fuel that is desorbed from the adsorbent 52*d* of the canister 52. The vapor collection pipe 53 and the purge passage pipe 54 constitute the purge passage (purge passage portion).

The purge control valve 55 is placed in the purge passage pipe 54. The purge control valve 55 is configured so that the opening degree (valve opening duration) thereof is controlled according to the drive signal indicating the duty ratio DPG, which is the command signal, to change the cross-sectional area of the passage in the purge passage pipe 54. The purge control valve 55 is configured to fully close the purge passage pipe 54 when the duty ratio DPG is "0".

When the fuel pump 56 is configured to supply fuel that is stored in the fuel tank 51 to the fuel injection valves 33 through the fuel supply pipe 57.

In the vaporized fuel supply system 50 configured in this way, when the purge control valve 55 is fully closed, the vaporized fuel that has occurred in the fuel tank 51 is adsorbed by the canister 52. When the purge control valve 55 is open, the vaporized fuel adsorbed by the canister 52 is discharged into the surge tank 31*b* (the intake passage downstream of the throttle valve 34) through the purge passage pipe 54 and supplied to the combustion chambers 21 (engine 10). That is, when the purge control valve 55 is open, a vaporized fuel gas purge (also referred to as "the vaporized fuel purge" or "the evapopurge") is executed.

This system includes a heat wire air flow meter 61, a throttle position sensor 62, a coolant temperature sensor 63, a crank position sensor 64, an intake cam position sensor 65, an upstream-side air-fuel ratio sensor 66, a downstream-side air-fuel ratio sensor 67, and an accelerator operation amount sensor 68. Note that, in this specification, the upstream-side air-fuel ratio sensor 66 is also referred to merely as the "air-fuel ratio sensor".

The air flow meter 61 is configured to output a signal corresponding to the mass flow rate (intake air flow rate) Ga of the intake air that flows in the intake pipe 32. That is, the intake air amount Ga indicates the amount of intake air that is taken into the engine 10 per unit time.

The throttle position sensor 62 is configured to detect the degree of opening of the throttle valve 34 (throttle valve opening degree) and output the signal indicating the throttle valve opening degree TA.

The coolant temperature sensor 63 is configured to detect the temperature of the coolant in the internal combustion engine 10 and output the signal indicating the coolant temperature THW. The coolant temperature THW is a parameter indicating the warm-up condition (temperature of the engine 10) of the engine 10.

The crank position sensor 64 is configured to output a signal having a narrow pulse every time the crank shaft rotates 10° and having a wide pulse every time the crank shaft rotates 360°. This signal is converted to an engine speed NE by an electric control device 70 to be described later.

The intake cam position sensor 65 is configured to output a pulse every time the intake cam shaft rotates 90°, rotates the following 90°, and rotates the following 180° from a given angular position. The electric control device 70 to be described later is configured to acquire the absolute crank angle CA relative to the compression top dead center of a reference cylinder (first cylinder, for example), based on the signals from the crank position sensor 64 and the intake cam position sensor 65. The absolute crank angle CA is set to "zero crank angle" at the compression top dead center of the reference cylinder and increases to "720-degree crank angle" according to the rotation angle of the crank shaft and is then set to the zero crank angle again.

The upstream-side air-fuel ratio sensor 66 is disposed in "one of the exhaust manifold 41 and the exhaust pipe 42" at a position between the confluence portion 41*b* (exhaust gas joining portion HK) of the exhaust manifold 41 and the upstream-side catalyst 43.

The upstream-side air-fuel ratio sensor 66 is a "current-limiting type wide range air-fuel ratio sensor having a diffusion resistance layer" described in Japanese Patent Application Publications Nos. 11-72473, 2000-65782, and 2004-69547 (JP-A-11-72473, JP-A-2000-65782, and JP-A-2004-69547), for example.

Figure 5A:
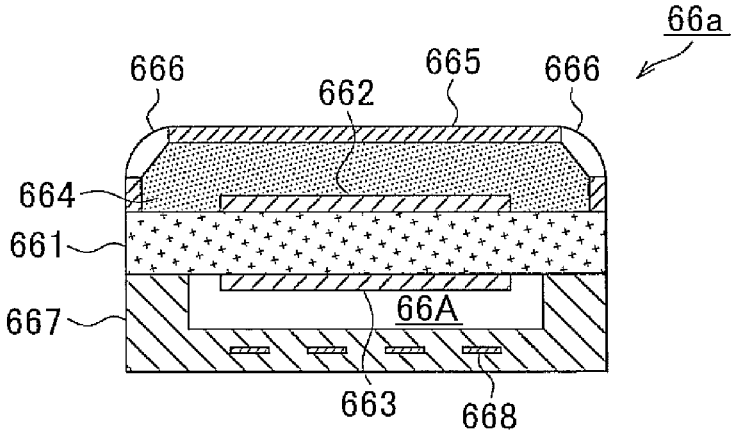
FIGS. 5A to 5C are schematic sectional views of an air-fuel ratio sensor element of an upstream-side air-fuel ratio sensor (air-fuel ratio sensor) shown in FIG. 4.
Figure 5B:
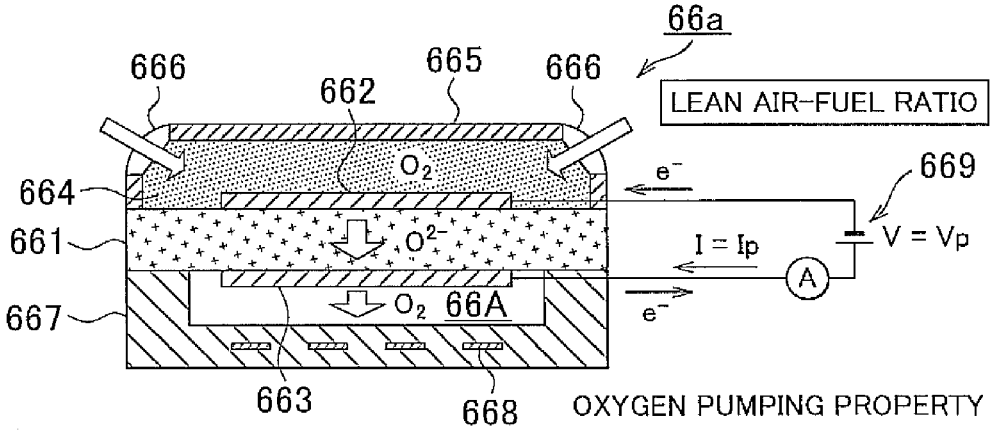
Figure 5C:
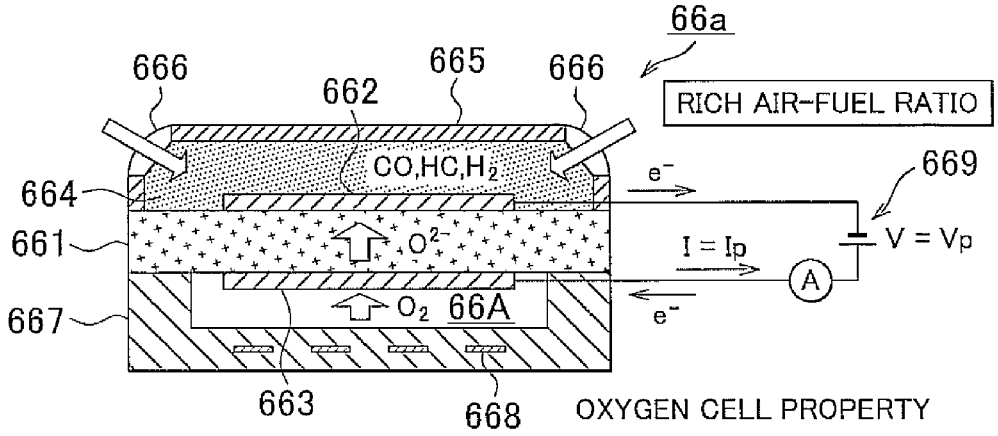

As shown in FIGS. 5A to 5C, the upstream-side air-fuel ratio sensor 66 has an air-fuel ratio detecting portion 66*a*. The air-fuel ratio detecting portion 66*a* is housed in the "hollow cylindrical protection cover made of metal" (not shown). Through holes are formed in the side and the bottom of the protection cover. The exhaust gas flows into the protection cover through the through holes in the side, reaches the air-fuel ratio detecting portion 66*a*, and then flows out of the protection cover through the through holes in the bottom.

Specifically, the exhaust gas that has reached the protection cover is sucked into the protection cover by the flow of the exhaust gas flowing near the through holes in the bottom of the protection cover. Thus, the flow speed of the exhaust gas in the protection cover varies according to the flow speed of the exhaust gas that flows near the through holes in the bottom of the protection cover (that is, according to the intake air amount Ga, which is the amount of intake air that is taken in per unit time). Thus, the output response (responsivity) of the upstream-side air-fuel ratio sensor 66 to the "air-fuel ratio of the exhaust gas flowing through the exhaust passage" improves as the intake air amount Ga increases and the output response hardly depends on the engine speed NE.

As shown in FIGS. 5A to 5C, the air-fuel ratio detecting portion 66*a* includes a solid electrolyte layer 661, an exhaust gas-side electrode layer 662, an atmosphere-side electrode layer (reference gas-side electrode layer) 663, a diffusion resistance layer 664, a first wall portion 665, a catalyst portion 666, a second wall portion 667, and a heater 668.

The solid electrolyte layer 661 is an oxygen ion-conductive oxide sintered compact. In this example, the solid electrolyte layer 661 is a "stable zirconia element" that is obtained by mixing CaO, as the stabilizer, with $ZrO_2$ (zirconia) in the form of a solid solution. The solid electrolyte layer 661 exhibits the well-known "oxygen cell property" and "oxygen pumping property" when the temperature of the solid electrolyte layer 661 is equal to or higher than the activation temperature.

The exhaust gas-side electrode layer 662 is made of a noble metal having a high catalytic activity, such as platinum (Pt). The exhaust gas-side electrode layer 662 is formed on one surface of the solid electrolyte layer 661. The exhaust gas-side electrode layer 662 is formed so as to have a sufficient permeability (that is, so as to be porous) by chemical plating, for example.

The atmosphere-side electrode layer 663 is made of a noble metal having a high catalytic activity, such as platinum (Pt). The atmosphere-side electrode layer 663 is formed on the other surface of the solid electrolyte layer 661 so as to face the exhaust gas-side electrode layer 662 with the solid electrolyte layer 661 interposed therebetween. The atmosphere-side electrode layer 663 is formed so as to have a sufficient permeability (that is, so as to be porous) by chemical plating, for example. The atmosphere-side electrode layer 663 is referred to also as the reference gas-side electrode layer.

The diffusion resistance layer (diffusion controlled layer) 664 is a porous layer made of a porous ceramic (heat resistant inorganic substance). The diffusion resistance layer 664 is formed by, for example, plasma spraying so that the diffusion resistance layer 664 covers the outer surface of the exhaust gas-side electrode layer 662.

The first wall portion 665 is made of alumina ceramic that is dense and not permeable to gas. The first wall portion 665 is formed so as to cover the diffusion resistance layer 664 except the corner portions (part) of the diffusion resistance layer 664. That is, the first wall portion 665 has through portions for exposing part of the diffusion resistance layer 664 to the outside.

The catalyst portion 666 is formed in each through portion so as to close the through portion of the first wall portion 665. The catalyst portion 666 carries the catalyst substance that promotes the oxidation-reduction reaction and the oxygen adsorbing material that exhibits the oxygen adsorbing ability. The catalyst portions 666 are porous. Thus, as shown in FIGS. 5B and 5C by the outline arrows, the exhaust gas (exhaust gas that flows into the inside of the protection cover described above) passes through the catalyst portions 666, reaches the diffusion resistance layer 664, passes through the diffusion resistance layer 664 (that is, diffuses therethrough), and reaches the exhaust gas-side electrode layer 662.

The second wall portion 667 is made of alumina ceramics that is dense and not permeable to gas. The second wall portion 667 is configured to form an "atmosphere chamber 66A" that is a space for accommodating the atmosphere-side electrode layer 663. The air is introduced into the atmosphere chamber 66A.

A power source 669 is connected to the upstream-side air-fuel ratio sensor 66. The power source 669 applies voltage V (=Vp) so that the atmosphere-side electrode layer 663 has a higher electric potential and the exhaust gas-side electrode layer 662 has a lower electric potential.

The heater 668 is embedded in the second wall portion 667. The heater 668 generates heat when energized by the electric control device 70, to heat the solid electrolyte layer 661, the exhaust gas-side electrode layer 662, and the atmosphere-side electrode layer 663 to control the temperatures thereof.

Figure 6:
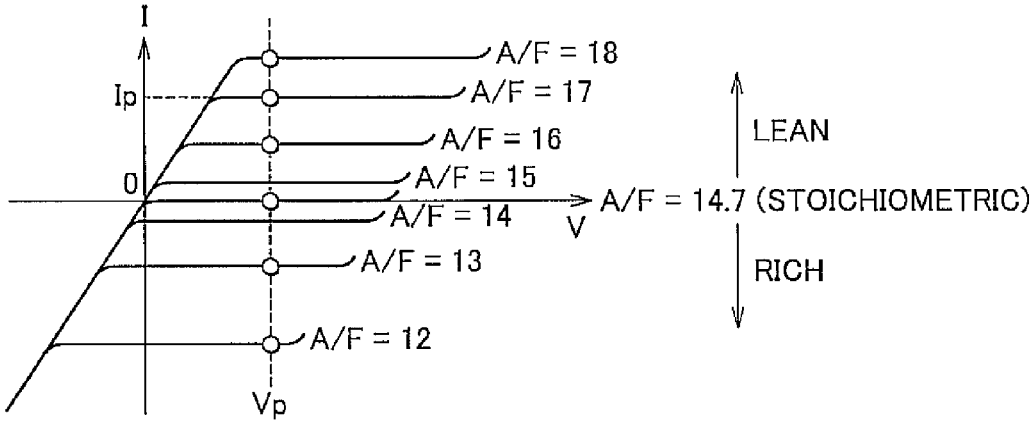
FIG. 6 is a graph showing relations between air-fuel ratios of the exhaust gas and the limiting current value of an air-fuel ratio sensor.

As shown in FIG. 5B, the upstream-side air-fuel ratio sensor 66 having such a structure ionizes the oxygen that passes through the diffusion resistance layer 664 to reach the exhaust gas-side electrode layer 662, thereby allowing the oxygen to pass through and reach the atmosphere-side electrode layer 663 when the air-fuel ratio of the exhaust gas is leaner than the stoichiometric air-fuel ratio. As a result, electric current I flows from the positive electrode to the negative electrode of the power source 669. As shown in FIG. 6, when the voltage V is set to a fixed voltage Vp, the value of the electric current I has a constant value proportional to the amount of oxygen (partial pressure of oxygen, oxygen concentration, that is, the air-fuel ratio of the exhaust gas) that reaches the exhaust gas-side electrode layer 662. The upstream-side air-fuel ratio sensor 66 outputs, as the output value Vabyfs, the value obtained by converting the electric current (that is, the limiting current Ip) to a voltage.

On the other hand, as shown in FIG. 5C, when the air-fuel ratio of the exhaust gas is richer than the stoichiometric air-fuel ratio, the upstream-side air-fuel ratio sensor 66 ionizes the oxygen present in the atmosphere chamber 66A to introduce it to the exhaust gas-side electrode layer 662, thereby oxidizing the unburned components (HC, CO, $H_2$, etc.) that pass through the diffusion resistance layer 664 to reach the exhaust gas-side electrode layer 662. As a result, the electric current I flows from the negative electrode of the power source 669 to the positive electrode thereof. As shown in FIG. 6, when the voltage V is set to a fixed voltage Vp, the value of the electric current I also has a constant value proportional to the amount of unburned components (partial pressure of unburned components, concentration of unburned components, that is, the air-fuel ratio of the exhaust gas) that reaches the exhaust gas-side electrode layer 662. The upstream-side air-fuel ratio sensor 66 outputs, as the output value Vabyfs, the value obtained by converting the electric current (that is, the limiting current Ip) to a voltage.

Figure 7:
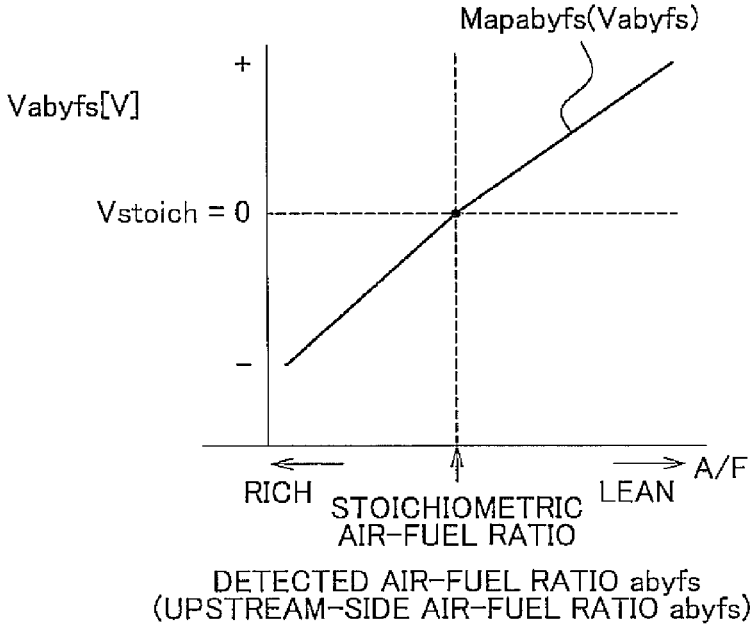
FIG. 7 is a graph showing a relation between the air-fuel ratio of the exhaust gas and the output value of the air-fuel ratio sensor.

That is, as shown in FIG. 7, the air-fuel ratio detecting portion 66*a* outputs, as the "air-fuel ratio sensor output", the output value Vabyfs corresponding to the air-fuel ratio of the gas that flows through the position, at which the upstream-side air-fuel ratio sensor 66 is provided, passes through the through holes of the protection cover, and reaches the air-fuel ratio detecting portion 66*a*. In other words, the upstream-side air-fuel ratio sensor 66 outputs the output value Vabyfs that varies depending on the "partial pressure of oxygen (oxygen concentration, oxygen amount) and the partial pressure of unburned components (concentration of unburned components, amount of unburned components)" in the gas that passes through the diffusion resistance layer 664 of the air-fuel ratio detecting portion 66*a* and reaches the exhaust gas-side electrode layer 662. The output value Vabyfs coincides with the stoichiometric air-fuel ratio equivalent value Vstoich when the air-fuel ratio of the gas that has reached the air-fuel ratio detecting portion 66*a* is the stoichiometric air-fuel ratio.

As is clear from the above description, the upstream-side air-fuel ratio sensor 66 is disposed in the exhaust passage at the position between the exhaust gas joining portion HK and the three-way catalyst (upstream-side catalyst 43), and includes the air-fuel ratio detecting element (solid electrolyte layer) 661, the exhaust gas-side electrode layer 662 and the reference gas-side electrode layer (atmosphere-side electrode layer) 663 that are arranged so as to face each other with the air-fuel ratio detecting element interposed therebetween, and the porous layer (diffusion resistance layer) 664 that covers the exhaust gas-side electrode layer 662. In addition, the upstream-side air-fuel ratio sensor 66 outputs the output value Vabyfs corresponding to the "oxygen amount and amount of unburned components" contained in the "exhaust gas that has passed through the porous layer (diffusion resistance layer) 664 and has reached the exhaust gas-side electrode layer 662" that is part of the "exhaust gas that passes through the position, at which the upstream-side air-fuel ratio sensor 66 is provided."

The unburned components, including hydrogen, in the exhaust gas are reduced in the catalyst portions 666 to some extent. However, when a large amount of unburned components is contained in the exhaust gas, it is impossible to completely eliminate the unburned components in the catalyst portions 666. As a result, "oxygen and the unburned components that are excessive relative to the oxygen" can reach the outer surface of the diffusion resistance layer 664. In addition, the diameter of the molecule of hydrogen is smaller than that of the other unburned components and therefore, hydrogen diffuses through the diffusion resistance layer 664 more than the other unburned components. When the degree of imbalance in cylinder-specific air-fuel ratio becomes large, a large amount of unburned components is discharged from the cylinder, for which the air-fuel ratio becomes very rich. Thus, even when the average of the air-fuel ratios in the engine is a certain value, the greater the degree of imbalance in cylinder-specific air-fuel ratio is, the larger the amount of hydrogen that reaches the outer surface of the diffusion resistance layer 664 is. As a result, as the degree of imbalance in cylinder-specific air-fuel ratio increases, the output value Vabyfs varies so that the air-fuel ratio indicated by the output value Vabyfs becomes richer.

Referring again to FIG. 4, the downstream-side air-fuel ratio sensor 67 is disposed in the exhaust pipe 42. The position, at which the downstream-side air-fuel ratio sensor 67 is disposed, is on the downstream side of the upstream-side catalyst 43 and on the upstream side of the downstream-side catalyst (that is, the exhaust passage between the upstream-side catalyst 43 and the downstream-side catalyst). The downstream-side air-fuel ratio sensor 67 is a well-known electromotive force-type oxygen concentration sensor (well-known concentration cell-type oxygen concentration sensor using solid electrolyte, such as stabilized zirconia). The downstream-side air-fuel ratio sensor 67 is configured to generate the output value Voxs corresponding to the air-fuel ratio of the detection subject gas that passes through the position in the exhaust passage, at which the upstream-side air-fuel ratio sensor 67 is provided. In other words, the output value Voxs is the value corresponding to the air-fuel ratio of the gas that flows out of the upstream-side catalyst 43 and flows into the downstream-side catalyst.

Figure 8:
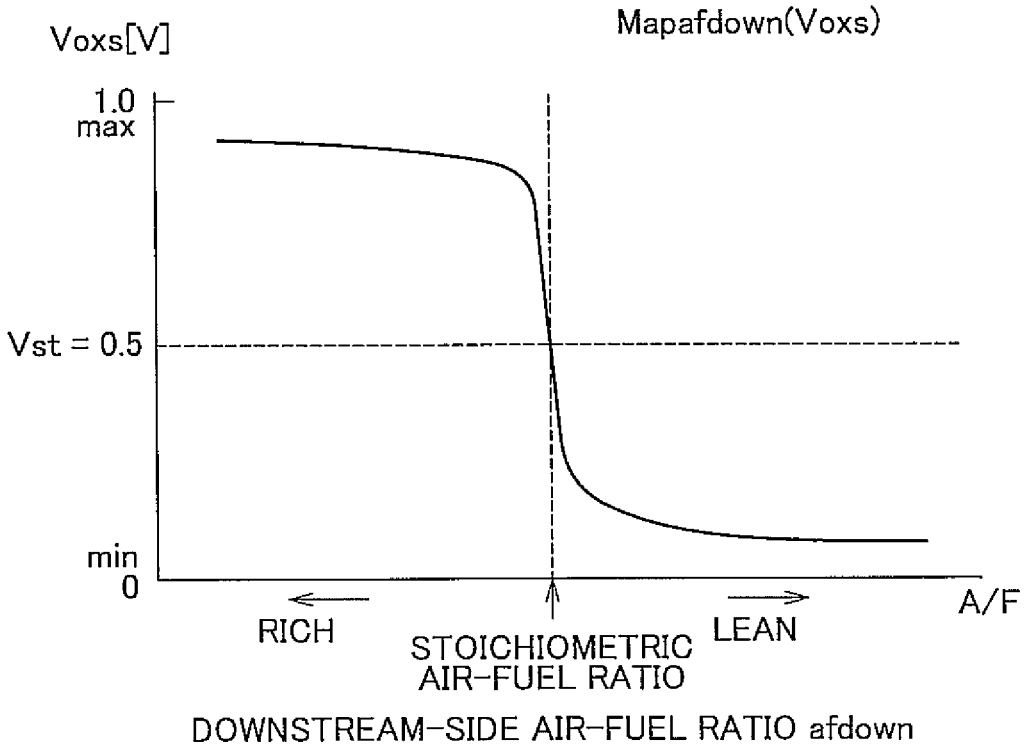
FIG. 8 is a graph showing a relation between the air-fuel ratio of the exhaust gas and the output value of the downstream-side air-fuel ratio sensor shown in FIG. 4.

As shown in FIG. 8, the output value Voxs becomes the maximum output value, max, (approximately 0.9 V to 1.0 V, for example) when the air-fuel ratio of the detection subject gas is richer than the stoichiometric air-fuel ratio. The output value Voxs becomes the minimum output value, min (approximately 0.1 V to 0 V, for example), when the air-fuel ratio of the detection subject gas is leaner than the stoichiometric air-fuel ratio. When the air-fuel ratio of the detection subject gas is the stoichiometric air-fuel ratio, the output value Voxs becomes a generally intermediate voltage Vst (approximately 0.5 V, for example) between the maximum output value max and the minimum output value min The output value Voxs rapidly varies from the maximum output value max to the minimum output value min when the air-fuel ratio of the detection subject gas varies from an air-fuel ratio richer than the stoichiometric air-fuel ratio to an air-fuel ratio leaner than the stoichiometric air-fuel ratio. Similarly, the output value Voxs rapidly varies from the minimum output value min to the maximum output value max when the air-fuel ratio of the detection subject gas varies from an air-fuel ratio leaner than the stoichiometric air-fuel ratio to an air-fuel ratio richer than the stoichiometric air-fuel ratio.

The downstream-side air-fuel ratio sensor 67 also includes the solid electrolyte layer and the "exhaust gas-side electrode layer and the atmosphere-side (reference gas-side) electrode layer" that are arranged on the two sides of the solid electrolyte layer so as to face each other with the solid electrolyte layer interposed therebetween. In addition, the exhaust gas-side electrode layer is covered with a porous layer (protection layer). Thus, the detection subject gas turns into the oxygen equilibrium attained gas (gas after oxygen and unburned components are combined with each other) during passing through the porous layer and reaches the exhaust gas-side electrode layer. Hydrogen passes through the porous layer more easily than other unburned components do. Note that the "excessive hydrogen that is generated when there occurs the imbalance in cylinder-specific air-fuel ratio" is reduced by the upstream-side catalyst 43 except in special cases. Thus, the output value Voxs from the downstream-side air-fuel ratio sensor 67 does not vary depending on the degree of imbalance in cylinder-specific air-fuel ratio except in special cases.

The accelerator operation amount sensor 68 shown in FIG. 4 outputs the signal indicating the operation amount Accp of the accelerator pedal AP (accelerator pedal operation amount, depression amount of accelerator pedal AP) that is operated by a driver. The accelerator pedal operation amount Accp increases as the amount of operation of the accelerator pedal AP increases.

The electric control device 70 is a common microcomputer including "a central processing unit (CPU), a read-only memory (ROM), into which programs to be executed by the CPU, tables (maps and functions), and constants are written in advance, a random access memory (RAM), into which the CPU temporarily stores data as needed, a backup RAM, and interfaces including an analogue-digital (AD) converter".

The backup RAM is supplied with electric power from a battery mounted on a vehicle regardless of the position (one of OFF position, starting position, ON position, etc.) of the ignition key switch (not shown) of the vehicle, on which the engine 10 is mounted. While the backup RAM is supplied with electric power from the battery, the backup RAM stores data according to the command from the CPU (that is, data is written thereinto) and the backup RAM holds (retains) the data so that the data can be read out. Thus, the backup RAM can holds the data even while the engine 10 is stopped.

The backup RAM cannot hold data when the electric power supply from the battery is cut off, such as when the battery is removed from the vehicle. Thus, the CPU is configured to initialize the data to be held in the backup RAM (set them to the default values) when the supply of electric power to the backup RAM is resumed. The backup RAM may be a rewritable nonvolatile memory, such as the electrically erasable programmable ROM (EEPROM).

The electric control device 70 is connected to the above sensors, etc. and is configured to supply signals from these sensors to the CPU. In addition, the electric control device 70 is configured to, according to the command from the CPU, send a driving signal (command signal) to spark plugs (igniter, actually) provided for the respective cylinders, the fuel injection valves 33 provided for the respective cylinders, the purge control valve 55, the throttle valve actuator, etc.

Note that the electric control device 70 is configured to send the command signal to the throttle valve actuator so that the greater the acquired accelerator pedal operation amount Accp is, the greater the throttle valve opening degree TA is. Specifically, the electric control device 70 includes a throttle valve driving section that varies the degree of opening of the "throttle valve 34 disposed in the intake passage of the engine 10" according to the accelerating operation amount (accelerator pedal operation amount Accp) of the engine 10 that is changed by the driver.

(Brief Description of Operation of First Determination System)

Based on the above knowledge, the first determination system determines, based on an air-fuel ratio imbalance index value, which one of the following is detected: that an inter-cylinder air intake amount variation abnormality that is an abnormality, in which the amount of intake air varies depending on the cylinders, is occurring; that an inter-cylinder fuel injection amount variation abnormality that is an abnormality, in which the amount of fuel injection varies depending on the cylinders, is occurring; and that none of these abnormalities is occurring.

More specifically, the first determination system acquires the air-fuel ratio imbalance index value while the vaporized fuel ratio (the ratio of the amount of vaporized fuel supplied to the engine 10 to the total amount of fuel supplied to the engine 10) is equal to or greater than a first predetermined value. The air-fuel ratio imbalance index value acquired in this case is referred to also as the large purge amount case parameter Pon. In addition, the first determination system acquires the air-fuel ratio imbalance index value while the vaporized fuel ratio is less than "a second predetermined value that is equal to or less than the first predetermined value". The air-fuel ratio imbalance index value acquired in this case is referred to also as the small purge amount case parameter Poff.

The air-fuel ratio imbalance index value is a parameter that increases as the degree of imbalance, between the plurality of cylinders, in cylinder-specific air-fuel ratio that is the air-fuel ratio of the mixture to be supplied to each of the plurality of cylinders increases, and the index value is acquired by various ways as described below. The first determination system acquires, as the air-fuel ratio imbalance index value (that is, the large purge amount case parameter Pon and the small purge amount case parameter Poff), a value correlating to the derivative d(Vabyfs)/dt of the output value Vabyfs of the upstream-side air-fuel ratio sensor 66. When the degree of imbalance in cylinder-specific air fuel ratio increases, the fluctuation of the air-fuel ratio of the exhaust gas increases. Thus, the output value Vabyfs significantly varies, so that the derivative d(Vabyfs)/dt increases. Thus, the air-fuel ratio imbalance index value correlating to the derivative d(Vabyfs)/dt increases as the degree of imbalance in cylinder-specific air-fuel ratio increases.

When one of the conditions 1 and 2 listed below is satisfied, the first determination system determines that the inter-cylinder air intake amount variation abnormality is occurring. (Condition 1) The difference between the small purge amount case parameter Poff and the large purge amount case parameter Pon (|Poff−Pon|) is less than a first abnormality determination threshold value ΔPth (=2·ΔPinj) and the small purge amount case parameter Poff is equal to or greater than a second abnormality determination threshold value (small purge amount case threshold value) Poffth. (Condition 2) The difference between the small purge amount case parameter Poff and the large purge amount case parameter Pon (|Poff−Pon|) is less than the first abnormality determination threshold value ΔPth (=2·ΔPinj) and the large purge amount case parameter Pon is equal to or greater than a third abnormality determination threshold value (large purge amount case threshold value) Ponth.

Figure 9:
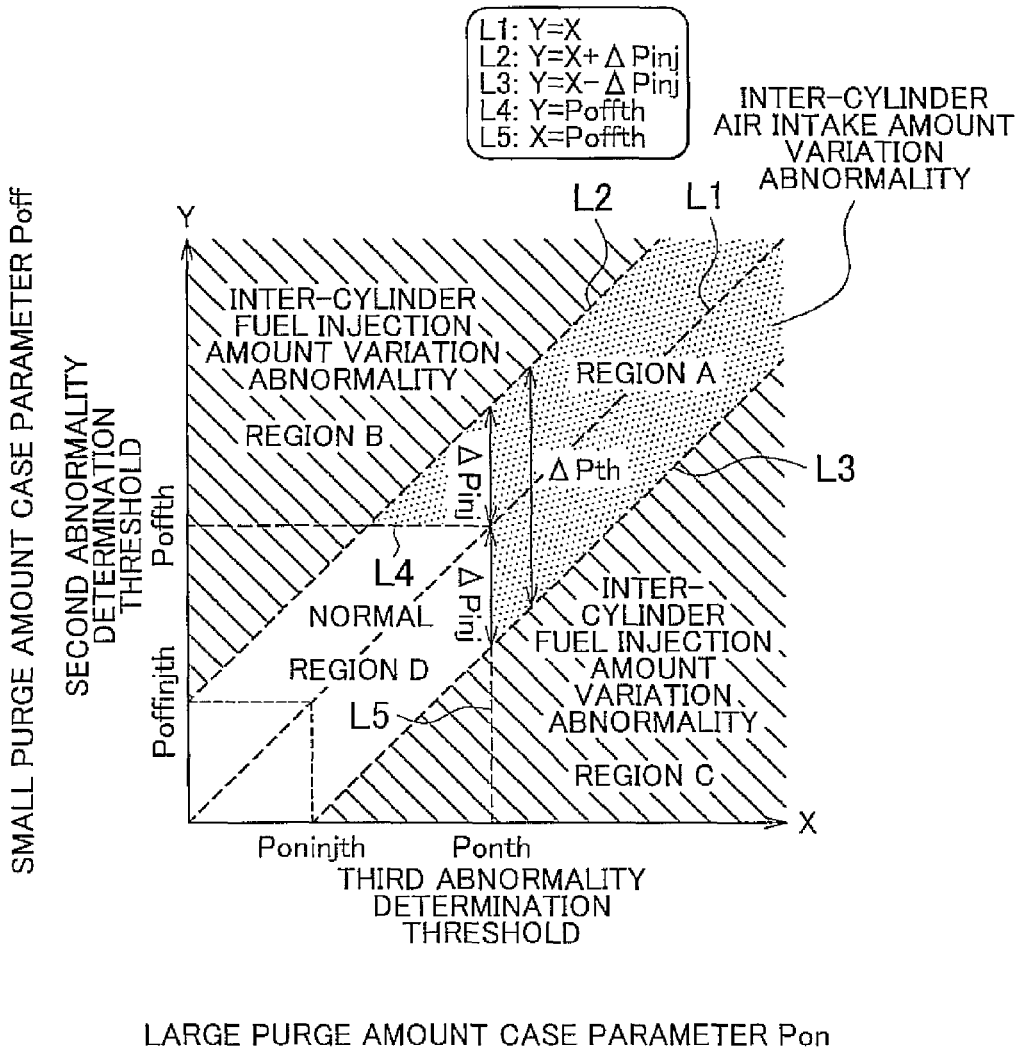
FIG. 9 is a region diagram showing regions indicating whether the inter-cylinder fuel injection amount variation abnormality is occurring and whether the inter-cylinder air intake amount variation abnormality is occurring.

Specifically, when the large purge amount case parameter Pon and the small purge amount case parameter Poff are within a region A shown in FIG. 9 (region defined by the straight lines L2, L3, L4, and L5), the first determination system determines that the inter-cylinder air intake amount variation abnormality is occurring.

On the other hand, when the condition 3 below is satisfied, the first determination system determines that the inter-cylinder fuel injection amount variation abnormality is occurring.

(Condition 3) The difference between the small purge amount case parameter Poff and the large purge amount case parameter Pon (|Poff−Pon|) is equal to or greater than the first abnormality determination threshold value ΔPth (=2·ΔPinj).

Specifically, when the large purge amount case parameter Pon and the small purge amount case parameter Poff are in a region B shown in FIG. 9 (region defined by the straight line L2 and Y axis) or when they are in a region C shown in FIG. 9 (region defined by the straight line L3 and X axis), the first determination system determines that the inter-cylinder fuel injection amount variation abnormality is occurring.

In addition, when none of the above conditions 1 to 3 is satisfied, the first determination system determines that the engine 10 is normal (neither the inter-cylinder air intake amount variation abnormality nor the inter-cylinder fuel injection amount variation abnormality is occurring).

(Actual Operation)

Next, the actual operation of the first determination system will be described.

(Fuel Injection Amount Control)

The CPU, which serves as the first determination system, is configured to repeatedly execute the fuel injection amount control routine shown in FIG. 10 for a given cylinder (hereinafter referred to also as the "fuel injection cylinder") every time the crank angle of the given cylinder becomes a predetermined crank angle before the intake stroke top dead center (BTDC 90° CA, for example).

Thus, the CPU starts the process from step 1000 at a predetermined timing, sequentially performs the processes of steps 1010 to 1060 described below, proceeds to step 1095, and exits this routine.

Step 1010: By applying "the intake air amount Ga measured by the air flow meter 61 and the engine speed NE" to the lookup table MapMc, the CPU determines the intake air amount (in-cylinder intake air amount) Mc(k) that is taken into the fuel injection cylinder at the present time.

Step 1020: The CPU reads a main feedback (FB) learned value KG out of a backup RAM. The main FB learned value KG is separately determined by a main feedback learning routine shown in FIG. 12 described below, and is stored in the backup RAM.

Step 1030: As shown by the following equation (1), the CPU calculates a base fuel injection amount Fb(k) by dividing the in-cylinder intake air amount Mc(k) by a present upstream-side target air-fuel ratio abyfr (target air-fuel ratio abyfr).

$$Fb(k)=Mc(k)/abyfr \tag{1}$$

Except in special cases, such as the case where the engine is being warmed up, the case where the fuel injection amount is being increased after a fuel cut, and the case where the fuel injection amount is being increased for preventing catalyst overheat, the upstream-side target air-fuel ratio abyfr is set to the stoichiometric air-fuel ratio, stoich. Note that in this embodiment, the upstream-side target air-fuel ratio abyfr is always set to the stoichiometric air-fuel ratio stoich. The base fuel injection amount Fb(k) is stored in the RAM in association with each intake stroke.

Step 1040: The CPU calculates a purge correction coefficient FPG using the following equation (2). In the equation (2), PGT is a target purge ratio. The target purge ratio PGT is determined based on the operating conditions of the engine 10 in step 1330 shown in FIG. 13 to be described below. FGPG is a vaporized fuel gas concentration learned value. The vaporized fuel gas concentration learned value FGPG is determined by the routine shown in FIG. 14 to be described below.

$$FPG=1+PGT(FGPG-1) \tag{2}$$

Step 1050: The CPU calculates an instructed fuel injection amount Fi that is the ultimate command value of the fuel injection amount, by correcting the base fuel injection amount Fb(k) using the following equation (3). Values on the right-hand side of the equation (3) are as follows. These values are separately determined using routines described below.

KG: learned value of main feedback coefficient (main FB learned value KG)

FPG: purge correction coefficient

FAF: main feedback coefficient updated (calculated) by main feedback control $$Fi=FPG\cdot\{KG\cdot FAF\cdot Fb(k)\} \quad (3)$$

Step 1060: The CPU sends a command signal to a fuel injection valve 33 so that the fuel whose amount is the instructed fuel injection amount Fi is injected from the fuel injection valve 33 provided for the fuel injection cylinder.

As described above, the base fuel injection amount Fb(k) is corrected using the main feedback value DFi (main feedback coefficient FAF, actually), whereby the instructed fuel injection amount Fi is calculated. As long as the characteristics of the fuel injection valve 33 provided for the fuel injection cylinder are normal, the fuel whose amount is the instructed fuel injection amount Fi is injected into the fuel injection cylinder.

(Main Feedback Control)

Figure 11:
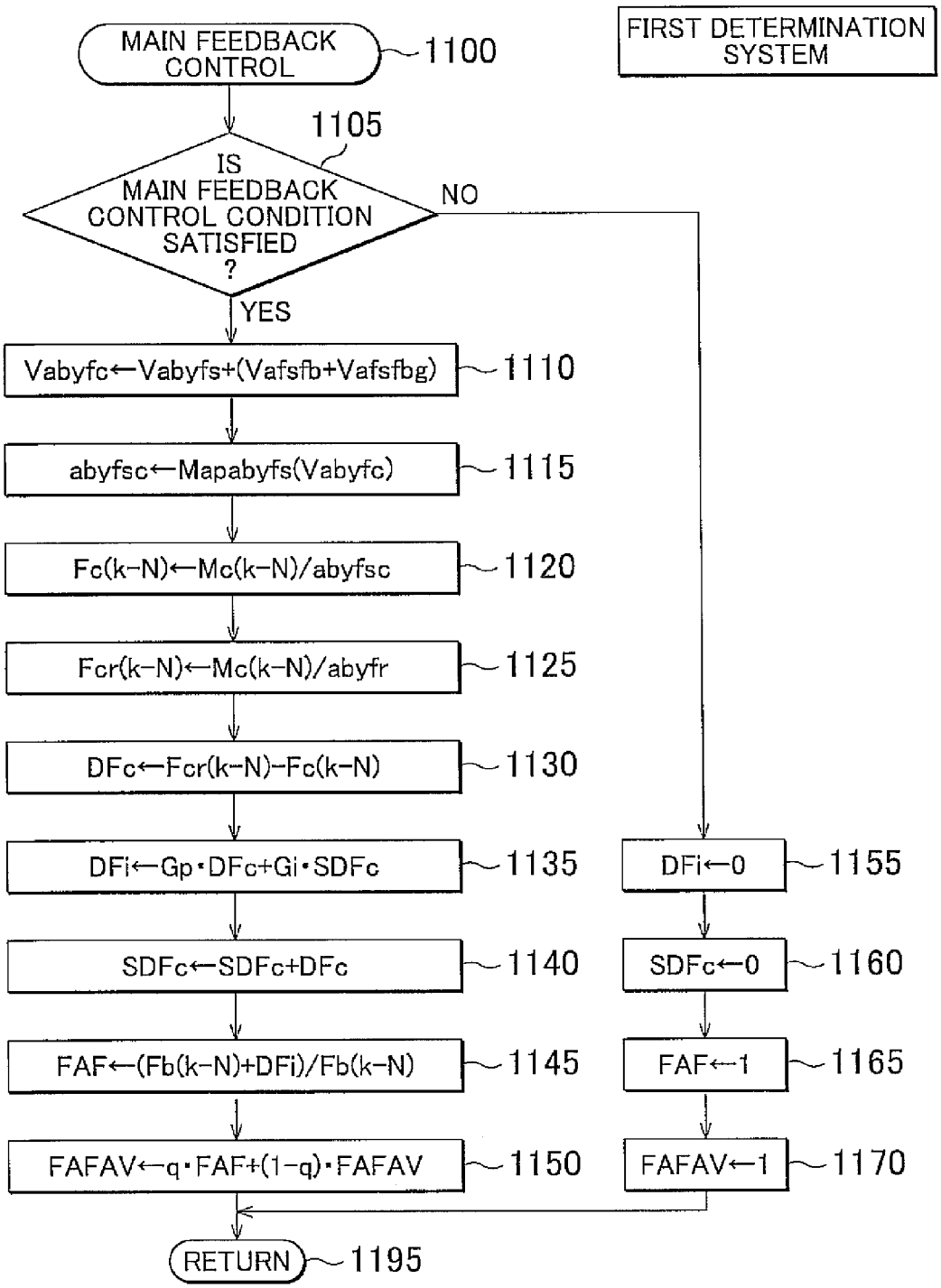
FIG. 11 is a flow chart showing a routine to be executed by the CPU of the first determination system.

The CPU repeatedly executes the main feedback control routine shown by a flow chart in FIG. 11 at predetermined time intervals. Thus, the CPU starts the process from step 1100 at a predetermined timing and proceeds to step 1105 to determine whether the main feedback control condition (upstream-side air-fuel ratio feedback control condition) is satisfied. The main feedback control condition is satisfied when, for example, the fuel cut is not being performed, the coolant temperature THW of the engine is equal to or higher than a first predetermined temperature, the load KL is equal to or lower than a predetermined value, and the upstream-side air-fuel ratio sensor 66 is active.

The load KL is a load factor (charging factor) KL in this embodiment and is calculated using the following equation (4). In the equation (4), ρ represents air density (g/l), L represents the displacement (l) of the engine 10, and 4 is the number of cylinders of the engine 10. However, the load KL may be the in-cylinder intake air amount Mc, the throttle valve opening degree TA, the accelerator pedal operation amount Accp, etc.

$$KL=\{Mc(k)/(\rho\cdot L/4)\}\cdot 100(\%) \quad (4)$$

The description will now be continued on the assumption that the main feedback control condition is satisfied. In this case, the CPU makes the affirmative determination, "Yes", in step 1105, sequentially performs the processes of steps 1110 to 1150 to be described below, proceeds to step 1195, and exits the routine.

Step 1110: The CPU acquires the feedback control output value Vabyfc according to the following equation (5). In the equation (5), Vabyfs is the output value of the upstream-side air-fuel ratio sensor 66, Vafsfb is the sub-feedback amount that is calculated based on the output value Voxs from the downstream-side air-fuel ratio sensor 67, and Vafsfbg is the learned value of the sub-feedback amount. The method of calculating the sub-feedback amount Vafsfb and the learned value Vafsfbg of the sub-feedback amount will be described later.

$$Vabyfc=Vabyfs+Vafsfb+Vafsfbg \quad (5)$$

Step 1115: The CPU acquires the feedback control air-fuel ratio abyfsc according to the following equation (6). Specifically, the CPU acquires the feedback control air-fuel ratio abyfsc by applying the feedback control output value Vabyfc to the table Mapabyfs shown in FIG. 7.

$$abyfsc=Mapabyfs(Vabyfc) \quad (6)$$

Step 1120: The CPU calculates an "in-cylinder fuel supply amount Fc(k−N)" that is the amount of fuel that had been supplied to the combustion chamber 21 N cycles before the present, by dividing the in-cylinder intake air amount Mc(k−N) N cycles (that is, N·720° CA) before the present by the feedback control air fuel ratio abyfsc as shown by the following equation (7).

$$Fc(k-N)=Mc(k-N)/abyfsc \quad (7)$$

Thus, the reason why the in-cylinder intake air amount Mc(k−N) N cycles before the present is divided by the feedback control air-fuel ratio abyfsc in order to obtain the in-cylinder fuel supply amount Fc(k−N) N cycles before the present is that it takes time corresponding to N cycles for the mixture burned in the combustion chamber 21 to reach the upstream-side air-fuel ratio sensor 66. In actuality, however, the exhaust gas reaches the upstream-side air-fuel ratio sensor 66 after the exhaust gases discharged from the cylinders are mixed to some extent.

Step 1125: The CPU calculates the "target in-cylinder fuel supply amount Fcr(k−N) N cycles before the present" by dividing the "in-cylinder intake air amount Mc(k−N) N cycles before the present" by the "upstream-side target air-fuel ratio abyfr(k−N) N cycles before the present" as shown by the following equation (8). Note that as described above, in this embodiment, the upstream-side target air-fuel ratio abyfr is constant and therefore, it is expressed simply by abyfr in the equation (8).

$$Fcr(k-N)=Mc(k-N)/abyfr \quad (8)$$

Step 1130: The CPU sets, as the in-cylinder fuel supply amount difference DFc, the value obtained by subtracting the in-cylinder fuel supply amount Fc(k−N) from the target in-cylinder fuel supply amount Fcr(k−N) as shown by the following equation (9). The in-cylinder fuel supply amount difference DFc is the amount that indicates the excess or deficiency in the fuel supplied to the engine 10 N cycles before the present.

$$DFc=Fcr(k-N)-Fc(k-N) \quad (9)$$

Step 1135: The CPU calculates the main feedback value DFi using the following equation (10). In the equation (10), Gp is the proportional gain that has been set in advance and Gi is the integral gain that has been set in advance. The value SDFc in the equation (10) is the integral value of the in-cylinder fuel supply amount difference DFc and is calculated in the next step 1140. Specifically, the first determination system calculates the main feedback value DFi through the proportional-integral control (PI control) to bring the feedback control air-fuel ratio abyfsc to the upstream-side target air-fuel ratio abyfr.

$$DFi=Gp\cdot DFc+Gi\cdot SDFc \quad (10)$$

Step 1140: The CPU calculates the integral value SDFc of the new in-cylinder fuel supply amount difference by adding the in-cylinder fuel supply amount difference DFc calculated in the above step 1130 to the integral value SDFc of the present in-cylinder fuel supply amount difference DFc.

Step 1145: The CPU calculates the main feedback coefficient FAF by substituting the main feedback value DFi and the base fuel injection amount Fb(k−N) into the following equation (11). Specifically, the main feedback coefficient FAF is calculated by dividing the "value obtained by adding the main feedback value DFi to the base fuel injection amount Fb(k−N) N cycles before the present" by the "base fuel injection amount Fb(k−N)".

$$FAF=(Fb(k-N)+DFi)/Fb(k-N) \quad (11)$$

Step 1150: The CPU calculates, as the main feedback coefficient average FAFAV (hereinafter referred to also as the "correction coefficient average FAFAV"), the weighted average of the main feedback coefficient FAF using the following equation (12).

In the equation (12), FAFAVnew is the post-update correction coefficient average FAFAV and the FAFAVnew is stored as the new correction coefficient average FAFAV. In the equation (12), the value q is a constant greater than zero and smaller than 1. The correction coefficient average FAFAV is used when the "main FB learned value KG and the vaporized fuel gas concentration learned value FGPG" are calculated, as described below.

$$FAFAVnew=q\cdot FAF+(1-q)\cdot FAFAV \quad (12)$$

As described above, the main feedback value DFi is determined through the proportional-integral control and the main feedback value DFi is converted to the main feedback coefficient FAF. The main feedback coefficient FAF is reflected on the instructed fuel injection amount Fi in step 1050 shown in FIG. 10 described above. As a result, the excess or deficiency in the fuel supply amount is compensated and the average value of the air-fuel ratio in the engine (that is, the air-fuel ratio of the gas that flows into the upstream-side catalyst 43) is substantially equalized to the upstream-side target air-fuel ratio abyfr.

On the other hand, when the main feedback control condition is not satisfied at the time of determination in step 1105, the CPU makes the negative determination, "No", in step 1105, proceeds to step 1155, and sets the main feedback value DFi to "0". Next, the CPU sets the integral value SDFc of the in-cylinder fuel supply amount difference to "0" in step 1160, sets the value of the main feedback coefficient FAF to "1" in step 1165, and sets the value of the correction coefficient average FAFAV to "1" in step 1170.

The CPU then proceeds to step 1195 and exits this routine. As described above, when the main feedback control condition is not satisfied, the value of the main feedback value DFi is set to "0" and the value of the main feedback coefficient FAF is set to "1". Thus, correction of the main feedback coefficient FAF using the base fuel injection amount Fb(k) is not made. Even in this case, however, the base fuel injection amount Fb(k) is corrected using the main FB learned value KG (Main Feedback Learning (Base Air-Fuel Ratio Learning))

The first determination system updates the main FB learned value KG based on the correction coefficient average FAFAV so that the main feedback coefficient FAF is brought to the basic value "1" during the "purge control valve closing command period (period, during which the duty ratio DPG is "0")", during which a command signal to keep the purge control valve 55 fully closed is sent to the purge control valve 55.

Figure 12:
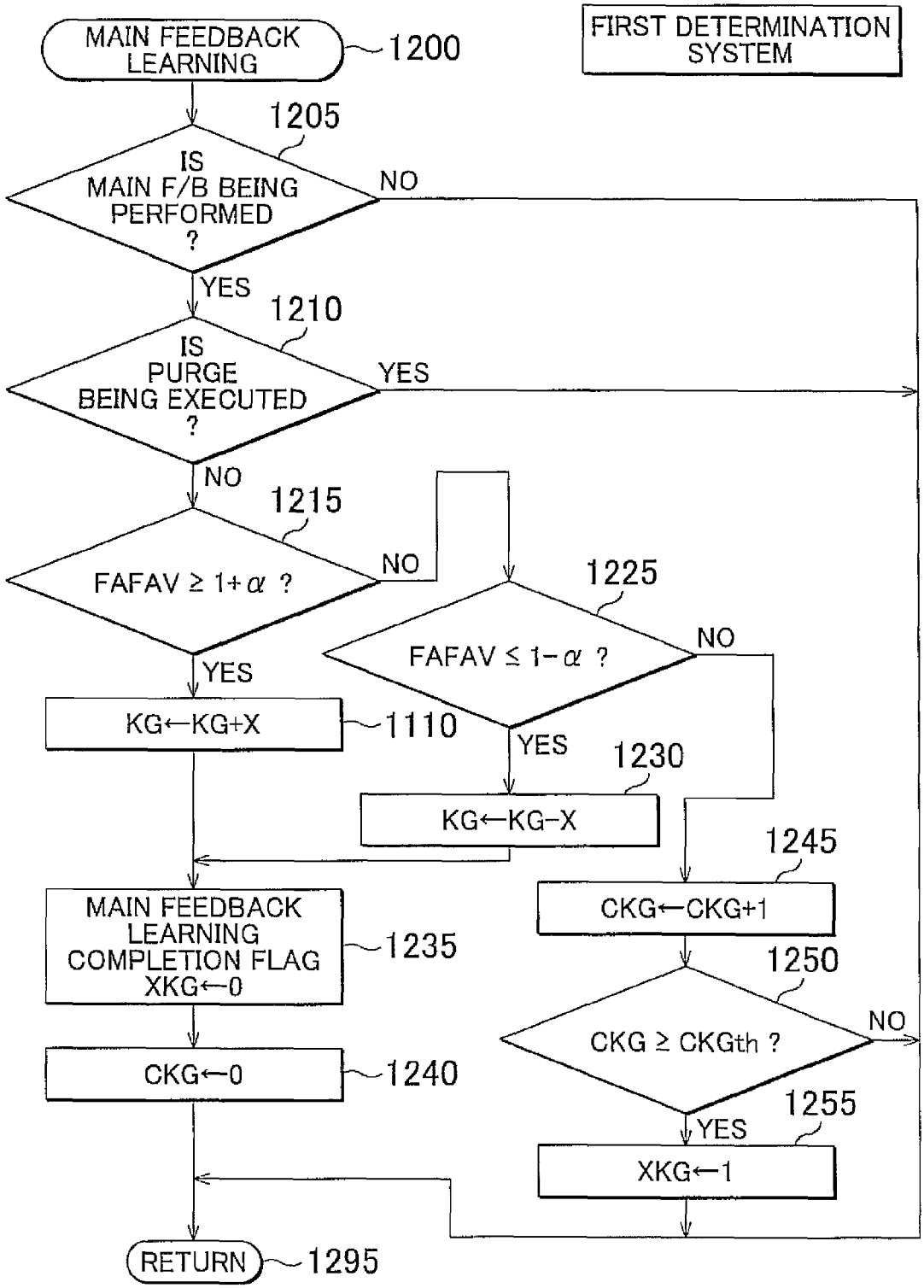
FIG. 12 is a flow chart showing a routine to be executed by the CPU of the first determination system.

In order to update the main FB learned value KG, the CPU executes the main feedback learning routine shown in FIG. 12 every time a predetermined period of time has elapsed. Thus, the CPU starts the process from step 1200 at a predetermined timing, proceeds to step 1205 to determine whether the main feedback control is being performed (that is, whether the main feedback control condition is satisfied).

In this step, when it is determined that the main feedback control is not being performed, the CPU makes the negative determination, "No", in step 1205, directly proceeds to step 1295, and exits this routine. As a result, the main FB learned value KG is not updated.

On the other hand, when the main feedback control is being performed, the CPU proceeds to step 1210 and determines "whether the vaporized fuel gas purge is being executed (specifically, whether the target purge ratio PGT determined through the routine shown in FIG. 13 to be described later is "0")". In this step, when it is determined that the vaporized fuel gas purge is being executed, the CPU makes the affirmative determination, "Yes", in step 1210, directly proceeds to step 1295, and exits this routine. As a result, the main FB learned value KG is not updated.

On the other hand, if the vaporized fuel gas purge is not being executed when the CPU performs the process of step 1210, the CPU makes the negative determination, "No", in step 1210, proceeds to step 1215, and determines whether the value of the correction coefficient average FAFAV is equal to or greater than 1+α (α is a very small predetermined value, greater than zero and less than one, which is 0.02, for example). When it is determined in this step that the value of the correction coefficient average FAFAV is equal to or greater than 1+α, the CPU proceeds to step 1220 and increases the main FB learned value KG by a predetermined positive value, X. The CPU then proceeds to step 1235.

On the other hand, if the value of the correction coefficient average FAFAV is less than 1+α when the CPU performs the process of step 1215, the CPU proceeds to step 1225 and determines whether the value of the correction coefficient average FAFAV is equal to or less than 1−α. When the value of the correction coefficient average FAFAV is equal to or less than 1−α, the CPU proceeds to step 1230 and reduces the main FB learned value KG by a predetermined positive value X. The CPU then proceeds to step 1235.

In addition, when the CPU proceeds to step 1235, the CPU sets the value of the main feedback learning completion flag (main FB learning completion flag) XKG to "0" in step 1235. When the value of the main FB learning completion flag XKG is "1", it indicates that the main feedback learning is completed, and when the value of the main FB learning completion flag XKG is "0", it indicates that the main feedback learning is not completed.

The CPU then proceeds to step 1240 and sets the value of the main learning counter CKG to "0". Note that the value of the main learning counter CKG is set to "0" in the initial routine that is executed when the ignition key switch (not shown) of the vehicle, on which the engine 10 is mounted, is turned from the off position to the on position. The CPU then proceeds to step 1295 and exits this routine.

If the value of the correction coefficient average FAFAV is greater than 1−α (that is, the value of the correction coefficient average FAFAV is between 1−α and 1+α) when the CPU performs the process of step 1225, the CPU proceeds to step 1245 and increases the value of the main learning counter CKG by "1".

The CPU then proceeds to step 1250 and determines whether the value of the main learning counter CKG is equal to or greater than a predetermined main learning counter threshold value CKGth. When the value of the main learning counter CKG is equal to or greater than the main learning counter threshold value CKGth, the CPU proceeds to step 1255 and sets the value of the main FB learning completion flag XKG to "1".

Specifically, when the number of times the value of the correction coefficient average FAFAV is determined to be between 1−α and 1+α after the engine 10 is started becomes equal to or greater than the main learning counter threshold value CKGth, it is determined that learning of the main FB learned value KG is completed. The CPU then proceeds to step 1295 and exits this routine.

On the other hand, if the value of the main learning counter CKG is less than the predetermined main learning counter threshold value CKGth when the CPU performs the process of step 1250, the CPU directly proceeds from step 1250 to step 1295 and exits this routine.

In this way, the main FB learned value KG is updated while the main feedback control is performed and the vaporized fuel gas purge is not executed.

(Purge Control Valve Drive)

Figure 13:
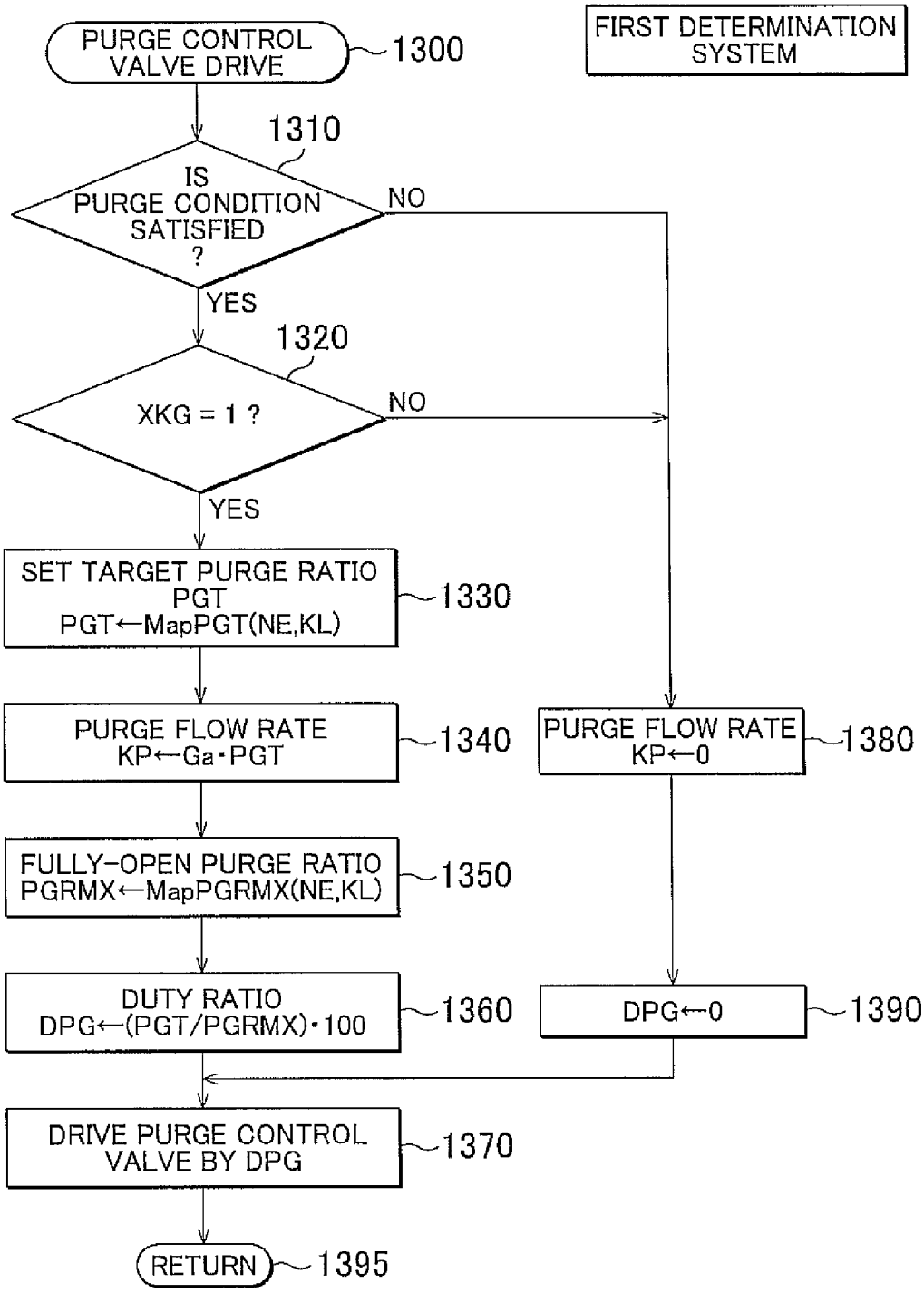
FIG. 13 is a flow chart showing a routine to be executed by the CPU of the first determination system.

Meanwhile, the CPU executes a purge control valve drive routine shown in FIG. 13 every time a predetermined period of time has elapsed. Thus, the CPU starts the process from step 1300 at a predetermined timing, proceeds to step 1310 to determine whether the purge condition is satisfied. The purge condition is satisfied when the main feedback control is being performed and the engine 10 is in steady operation (such as when the amount of change per unit time in the throttle valve opening degree TA that indicates the engine load is equal to or less than a predetermined value), for example.

Assume that the purge condition is satisfied. In this case, the CPU makes the affirmative determination, "Yes", in step 1310 shown in FIG. 13, proceeds to step 1320, and determines whether the value of the main FB learning completion flag XKG is "1" (that is, whether the main feedback learning is completed). In this step, when the value of the main FB learning completion flag XKG is "1", the CPU makes the affirmative determination, "Yes", in step 1320, sequentially performs the processes of steps 1330 to 1370 to be described later, proceeds to step 1395, and exits this routine.

Step 1330: The CPU sets the target purge ratio PGT based on the operating conditions of the engine 10 (engine load KL and engine speed NE, for example). A configuration may be employed, in which the target purge ratio PGT is increased in increments of a predetermined amount when the value of the correction coefficient average FAFAV is between $1+\alpha$ and $1-\alpha$.

Step 1340: The CPU calculates the "purge flow rate (vaporized fuel gas purge amount) KP that is the flow rate of the vaporized fuel gas" from the target purge ratio PGT and the intake air amount (flow rate) Ga using the following equation (13). In other words, the purge ratio is the ratio of the purge flow rate KP to the intake air amount Ga (purge ratio=KP/Ga). The purge ratio may be expressed in the form of the ratio of the vaporized fuel gas purge amount KP to the "sum of the intake air amount Ga and the vaporized fuel gas purge amount KP (Ga+KP)" (purge ratio={KP/(Ga+KP)}).

$$KP=Ga\cdot PGT \tag{13}$$

Step 1350: The CPU calculates the fully-open purge ratio PGRMX by applying the engine speed NE and the load KL to the map MapPGRMX as shown by the following equation (14). The fully-open purge ratio PGRMX is the purge ratio when the purge control valve 55 is fully opened. The map MapPGRMX is obtained in advance based on the results of experiments or simulations and stored in the ROM. According to the map MapPGRMX, the higher the engine speed NE is, or the higher the load KL is, the smaller the fully-open purge ratio PGRMX is.

$$PGRMX=MapPGRMX(NE,KL) \tag{14}$$

Step 1360: The CPU calculates the duty ratio DPG from the fully-open purge ratio PGRMX and the target purge ratio PGT using the following equation (15).

$$DPG=(PGT/PGRMX)\cdot 100 \tag{15}$$

Step 1370: The CPU controls opening and closing of the purge control valve 55 according to the duty ratio DPG.

On the other hand, when the purge condition is not satisfied, the CPU makes the negative determination, "No", in step 1310, proceeds to step 1380, and sets the purge flow rate KP to "0". The CPU then sets the duty ratio DPG to "0" in step 1390 and proceeds to step 1370. In this case, because the duty ratio DPG is set to "0", the purge control valve 55 is fully closed. The CPU then proceeds to step 1395 and exits this routine.

In addition, if the value of the main FB learning completion flag XKG is "0" when the CPU performs the process of step 1320, the CPU makes the negative determination, "No", in step 1320 and performs the processes of steps 1380, 1390, and 1370. Also in this case, the duty ratio DPG is set to "0" and therefore, the purge control valve 55 is fully closed. The CPU then proceeds to step 1395 and exits this routine.

(Vaporized Fuel Gas Concentration Learning)

Figure 14:
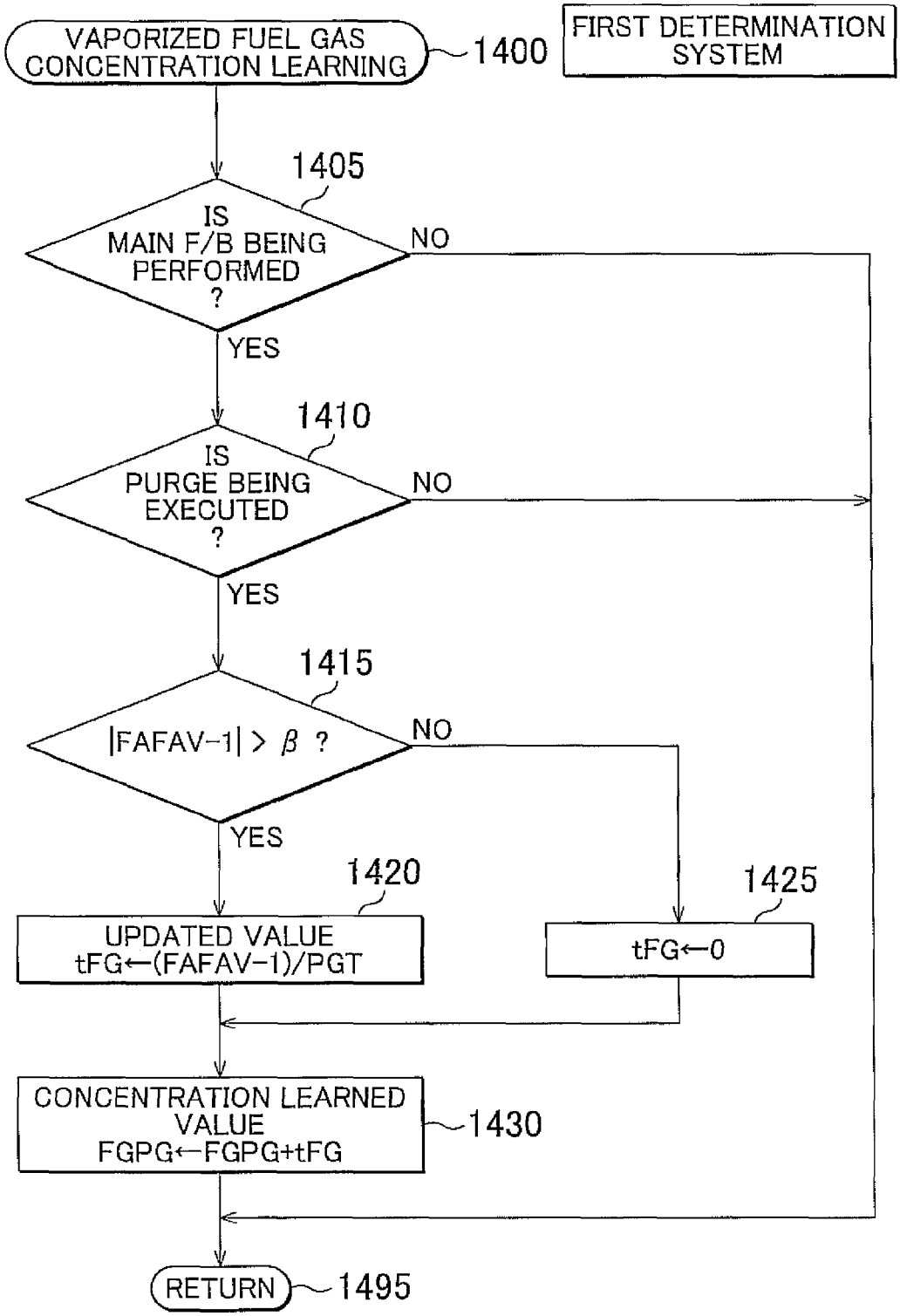
FIG. 14 is a flow chart showing a routine to be executed by the CPU of the first determination system.

In addition, the CPU executes the vaporized fuel gas concentration learning routine shown in FIG. 14 every time a predetermined period of time has elapsed. The vaporized fuel gas concentration learned value FGPG is updated by executing the vaporized fuel gas concentration learning routine.

The CPU starts the process from step 1400 at a predetermined timing, proceeds to step 1405, and determines whether the main feedback control is being performed. When it is determined that the main feedback control is not being performed, the CPU makes the negative determination, "No", in step 1405, directly proceeds to step 1495, and exits this routine. As a result, the vaporized fuel gas concentration learned value FGPG is not updated.

On the other hand, when it is determined that the main feedback control is being performed, the CPU proceeds to step 1410 and determines whether the vaporized fuel gas purge is being executed (specifically, whether the duty ratio DPG that is determined through the routine shown in FIG. 13 is "0"). In this step, when it is determined that the vaporized fuel gas purge is not being executed, the CPU makes the negative determination, "No", in step 1410, directly proceeds to step 1495, and exits this routine. As a result, the vaporized fuel gas concentration learned value FGPG is not updated.

On the other hand, if the vaporized fuel gas purge is being executed when the CPU proceeds to step 1410, the CPU makes the affirmative determination, "Yes", in step 1410, proceeds to step 1415, and determines whether the absolute value |FAFAV-1| obtained by subtracting "1" from the correction coefficient average FAFAV is greater than a predetermined value $\beta$. Note that $\beta$ is a very small predetermined value, greater than zero and less than one, which is 0.02, for example.

When the absolute value, |FAFAV-1|, is greater than $\beta$, the CPU makes the affirmative determination, "Yes", in step 1415, proceeds to step 1420, and calculates the updated value tFG using the following equation (16). The target purge ratio PGT in the equation (16) is set in step 1330 shown in FIG. 13. As is clear from the equation (16), the updated value tFG is the "difference ea (difference of FAFAV from 1=FAFAV−1)" per 1% of the target purge ratio. The CPU then proceeds to step 1430.

$$tFG=(FAFAV-1)/PGT \tag{16}$$

The higher the concentration of the vaporized fuel contained in the vaporized fuel gas is, the smaller the upstream-side air fuel ratio abyfs is below the stoichiometric air-fuel ratio (that is, the air fuel ratio becomes richer than the stoichiometric air-fuel ratio). Thus, the main feedback coefficient FAF decreases, so that the correction coefficient average FAFAV becomes a value smaller than "1". As a result, the value of FAFAV-1 becomes negative, so that the updated value tFG also becomes negative. In addition, the smaller the value of FAFAV is (that is, the more the difference from "1" increases), the greater the absolute value of the updated value tFG is. That is, as the concentration of the vaporized fuel gas increases, the updated value tFG becomes negative and the absolute value thereof increases.

On the other hand, when the absolute value |FAFAV-1| is equal to or less than β, the CPU makes the negative determination, "No", in step 1415, proceeds to step 1425, and sets the updated value tFG to "0". The CPU then proceeds to step 1430.

The CPU updates the vaporized fuel gas concentration learned value FGPG using the following equation (17) in step 1430, proceeds to step 1495, and exits this routine. In the equation (17), FGPGnew is the post-update vaporized fuel gas concentration learned value FGPG. As a result, the higher the vaporized fuel gas concentration is, the smaller the vaporized fuel gas concentration learned value FGPG is. The initial value of the vaporized fuel gas concentration learned value FGPG is "1".

$$FGPGnew=FGPG+tFG \tag{17}$$

(Sub-feedback Amount and Sub FB Learned Value Calculation)

Figure 15:
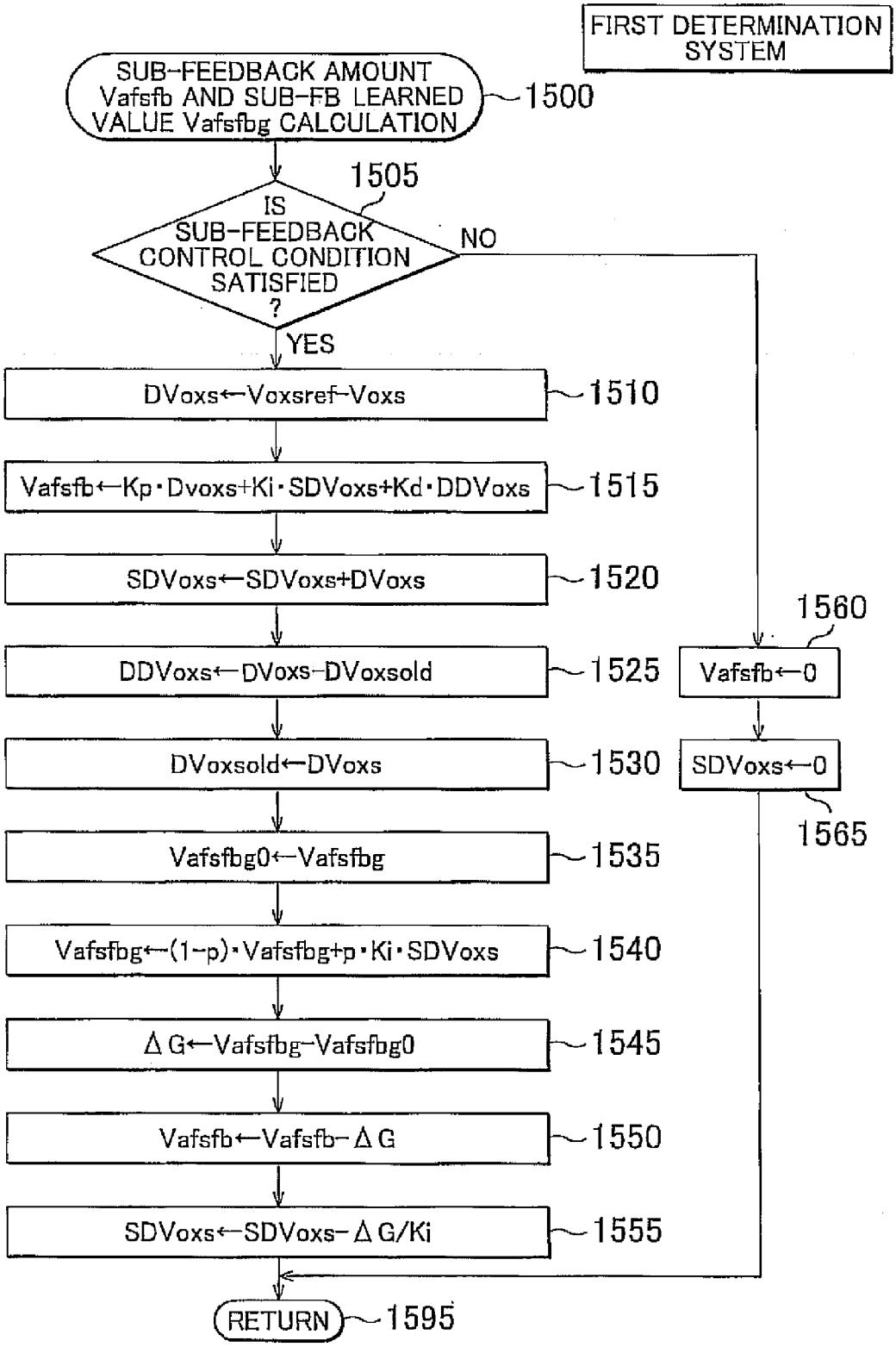
FIG. 15 is a flow chart showing a routine to be executed by the CPU of the first determination system.

In order to calculate the sub-feedback amount Vafsfb and the learned value Vafsfbg of the sub-feedback amount Vafsfb, the CPU executes the routine shown in FIG. 15 every time a predetermined period of time has elapsed.

Thus, the CPU starts the process from step 1500 at a predetermined timing, proceeds to step 1505, and determines whether a sub-feedback control condition is satisfied. The sub-feedback control condition is satisfied when, for example, the main feedback control condition, the satisfaction of which is determined in step 1105 in FIG. 11 described above, is satisfied, the upstream-side target air-fuel ratio abyfr is set to the stoichiometric air-fuel ratio, the coolant temperature THW of the engine is equal to or higher than a second predetermined temperature that is higher than the first predetermined temperature, and the downstream-side air-fuel ratio sensor 67 is active.

The description will be continued on the assumption that the sub-feedback control condition is satisfied. In this case, the CPU makes the affirmative determination, "Yes", in step 1505, sequentially performs the processes of steps 1510 to 1555 to be described below, proceeds to step 1595, and exits this routine.

Step 1510: The CPU calculates the output deviation DVoxs by subtracting the present output value Voxs of the downstream-side air-fuel ratio sensor 67 from the downstream-side target value Voxsref as shown by the following equation (18). The downstream-side target value Voxsref in the equation (18) is determined so as to improve the purification efficiency of the upstream-side catalyst 43. The downstream-side target value Voxsref is set to a value (stoichiometric air-fuel ratio equivalent value) Vst corresponding to the stoichiometric air-fuel ratio in this embodiment.

$$DVoxs=Voxsref-Voxs \tag{18}$$

Step 1515: The CPU calculates the sub-feedback amount Vafsfb using the following equation (19). In the equation (19), Kp is the proportional gain (proportional constant), Ki is the integral gain (integral constant), and Kd is the derivative gain (derivative constant). Further, SDVoxs is the integral value (time integral value) of the output deviation DVoxs and DDVoxs is the derivative value (time derivative value) of the output deviation DVoxs.

$$Vafsfb=Kp\cdot DVoxs+Ki\cdot SDVoxs+Kd\cdot DDVoxs \tag{19}$$

Step 1520: The CPU obtains the new integral value SDVoxs of the output deviation by adding the output deviation DVoxs obtained in step 1510 to the present integral value SDVoxs of the output deviation.

Step 1525: The CPU calculates the new derivative value DDVoxs of the output deviation by subtracting "the preceding output deviation DVoxsold that is the output deviation calculated in the preceding execution of this routine" from "the output deviation DVoxs calculated in the above-described step 1510".

Step 1530: The CPU stores "the output deviation DVoxs calculated in the above-described step 1510" as "the preceding output deviation DVoxsold".

In this way, the CPU calculates the sub-feedback amount Vafsfb by performing the proportional-integral-derivative control (PID control) that is performed to bring the output value Voxs of the downstream-side air-fuel ratio sensor 67 to the downstream-side target value Voxsref. The sub-feedback amount Vafsfb is used to calculate the feedback-control output value Vabyfc as described above.

Step 1535: The CPU stores the present sub FB learned value Vafsfbg as the pre-update learned value Vafsfbg0.

Step 1540: The CPU updates the learned value Vafsfbg of the sub-feedback amount Vafsfb using the following equation (20). The left-hand side of the equation (20), Vafsfbgnew, is the post-update learned value Vafsfbg. Specifically, the sub FB learned value Vafsfbg is updated so as to include "the steady component of the sub-feedback amount Vafsfb". The value p in the equation (20) is a predetermined value that is greater than zero and less than one. The updated sub FB learned value Vafsfbg (=Vafsfbgnew) is stored in the backup RAM.

$$Vafsfbgnew=(1-p)\cdot Vafsfbg+p\cdot Ki\cdot SDVoxs \tag{20}$$

Note that the learned value Vafsfbg may be updated according to the following equation (21).

$$Vafsfbgnew=(1-p)\cdot Vafsfbg+p\cdot Vafsfb \tag{21}$$

Step 1545: The CPU calculates the change amount (update amount) AG of the sub FB learned value Vafsfbg using the following equation (22).

$$\Delta G=Vafsfbg-Vafsfbg0 \tag{22}$$

Step 1550: The CPU corrects the sub-feedback amount Vafsfb by the change amount ΔG according to the following equation (23).

$$Vafsfbnew=\mathrm{Vafsfb}-\Delta G \tag{23}$$

Step 1555: The CPU corrects the integral term Ki·SDVoxs based on the change amount ΔG according to the following equation (24). Note that step 1555 may be omitted. Further, steps 1545 to 1555 may be omitted.

$$SDVoxsnew=SDVoxs-\Delta G/Ki \tag{24}$$

The process described above updates the sub-feedback amount Vafsfb and the sub FB learned value Vafsfbg every time a predetermined period of time has elapsed. Note that the sub FB learned value Vafsfbg may be updated every time a period of time has elapsed that is longer than the time intervals between updates of the sub-feedback amount Vafsfb.

On the other hand, when the sub-feedback control condition is not satisfied, the CPU makes the negative determination, "No", in step 1505 shown in FIG. 15, sequentially performs the processes of steps 1560 and 1565 to be described below, proceeds to step 1595, and exits this routine.

Step 1560: The CPU sets the value of the sub-feedback amount Vafsfb to "0". Step 1565: The CPU sets the value of the integral value SDVoxs of the output deviation to "0".

As a result, the feedback-control output value Vabyfc becomes the sum of the output value Vabyfs of the upstream-side air-fuel ratio sensor 66 and the sub FB learned value Vafsfbg. That is, in this case, "the update of the sub-feedback amount Vafsfb" and "the reflection of the sub-feedback amount Vafsfb on the instructed fuel injection amount Fi" are stopped. However, at least the sub FB learned value Vafsfbg corresponding to the integral term (steady component) of the sub-feedback amount Vafsfb is reflected on the instructed fuel injection amount Fi.

(Air-fuel Ratio Imbalance Index Value (Imbalance Determination Parameter))

As described above, when it is determined whether the inter-cylinder air intake amount variation abnormality or the inter-cylinder fuel injection amount variation abnormality is occurring, the CPU calculates the air-fuel ratio imbalance index value (small purge amount case parameter Poff and large purge amount case parameter Pon). In this embodiment, the air-fuel ratio imbalance index value is a value that varies depending on the average value of the derivative d(Vabyfs)/dt of the output value Vabyfs of the upstream-side air-fuel ratio sensor 66. It will be described below in more detail that the air-fuel ratio imbalance index value (a value that varies depending on the average value of the derivative d(Vabyfs)/dt) is a parameter that increases as the degree of imbalance in cylinder-specific air-fuel ratio increases.

The exhaust gases from the respective cylinders reach the upstream-side air-fuel ratio sensor 66 in the order of ignition (that is, in the order of exhaustion). When there is no imbalance in cylinder-specific air-fuel ratio (when there is no difference in air-fuel ratio between cylinders), the air-fuel ratios of the exhaust gases that are discharged from the cylinders and reach the upstream-side air-fuel ratio sensor 66 are substantially the same. Thus, "the output value Vabyfs (that is, the detected air-fuel ratio abyfs) of the upstream-side air-fuel ratio sensor 66" when there is no difference in air-fuel ratio between cylinders, varies as shown by the broken line C1 in FIG. 16B, for example.

Specifically, when there is no imbalance in air-fuel ratio between the cylinders, the waveform of the output value Vabyfs is substantially flat. Thus, as shown by the broken line C3 in FIG. 16C, when there is no imbalance in cylinder-specific air-fuel ratio, the absolute value of "the derivative d(Vabyfs)/dt, which is the gradient of the output value Vabyfs" is small.

Meanwhile, assume that the air-fuel ratio of a "particular cylinder (first cylinder, for example)" is significantly different from the air-fuel ratios of the other cylinders. That is, assume that the air-fuel ratio of the exhaust gas from the particular cylinder (air-fuel ratio of an imbalance cylinder) and the air-fuel ratios of the exhaust gases from the cylinders other than the particular cylinder (air-fuel ratios of non-imbalance cylinders) significantly differ from each other.

Figure 16A:
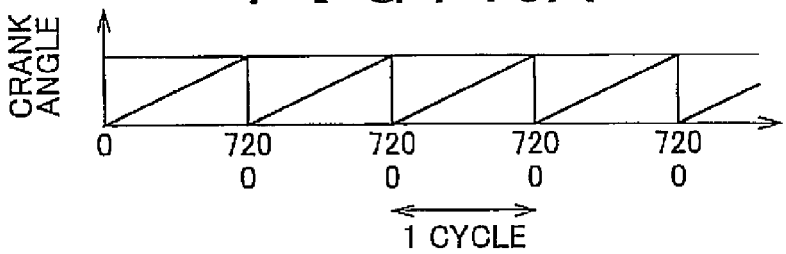
FIGS. 16A to 16D show time charts showing the behaviors of values correlating to the air-fuel ratio imbalance index value when the degree of imbalance in cylinder-specific air-fuel ratio is large (imbalance in air-fuel ratio between cylinders is occurring) and when the degree of imbalance in cylinder-specific air-fuel ratio is small (imbalance in air-fuel ratio between cylinders is not occurring)
Figure 16B:
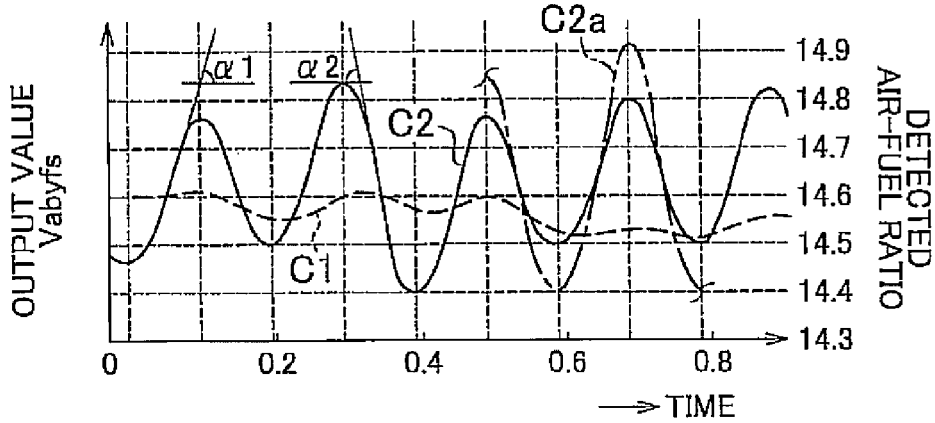

In this case, the output value Vabyfs significantly varies at every unit combustion cycle as shown by the solid line C2 in FIG. 16B, for example. Thus, as shown by the solid line C4 in FIG. 16C, when the degree of imbalance in cylinder-specific air-fuel ratio is large (when the imbalance in air-fuel ratio between cylinders is occurring), the absolute value of the derivative d(Vabyfs)/dt is large.

Note that the unit combustion cycle is a crank angle cycle that is required for every cylinder that discharges the exhaust gas that reaches one upstream-side air-fuel ratio sensor 66 to complete one combustion stroke. The engine 10 of this embodiment is an in-line four-cylinder four-cycle engine and the exhaust gases from the first to fourth cylinders reach one upstream-side air-fuel ratio sensor 66. Thus, the unit combustion cycle is a crank angle cycle of 720°.

The more the air-fuel ratio of the imbalance cylinder deviates from the air-fuel ratio of the non-imbalance cylinders, the more significantly the absolute value |d(Vabyfs)/dt| of the derivative d(Vabyfs)/dt varies. For example, if the output value Vabyfs (or the detected air-fuel ratio abyfs) when the difference between the air-fuel ratio of the imbalance cylinder and the air-fuel ratios of the non-imbalance cylinders is the first value, varies as shown by the solid line C2 in FIG. 16B, the output value Vabyfs (or the detected air-fuel ratio abyfs) when the difference between the air-fuel ratio of the imbalance cylinder and the air-fuel ratios of the non-imbalance cylinders is "the second value that is greater than the first value", varies as shown by the chain line C2*a* in FIG. 16B.

Figure 17:
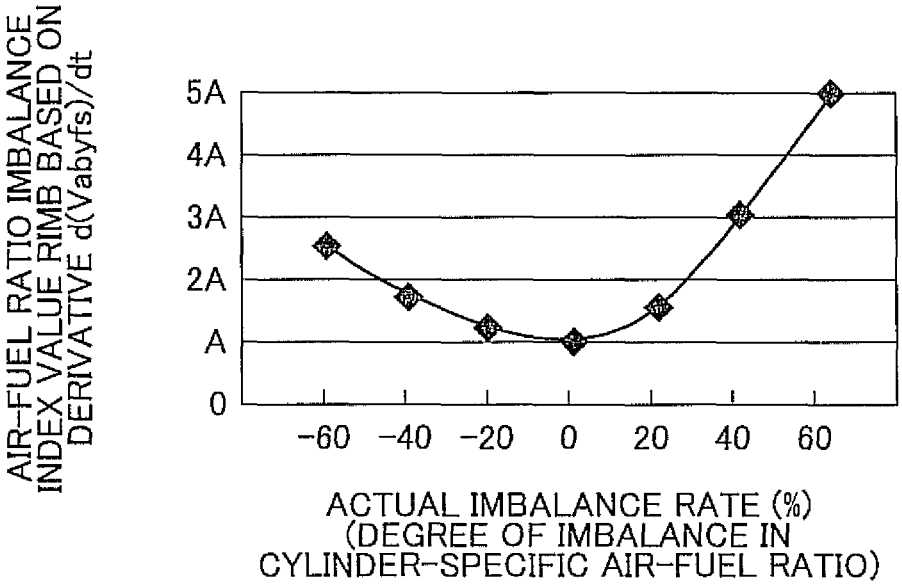
FIG. 17 is a graph showing a relation between the actual imbalance rate and the air-fuel ratio imbalance index value correlating to the derivative acquired through the upstream-side air-fuel ratio sensor.

Thus, as shown in FIG. 17, the value (air-fuel ratio imbalance index value RIMB) correlating to the average value AveΔAF of the absolute value |d(Vabyfs)/dt| of the derivative d(Vabyfs)/dt over "a plurality of unit combustion cycles" increases as the actual imbalance rate increases (that is, as the air-fuel ratio of the imbalance cylinder deviates from the air-fuel ratios of the non-imbalance cylinders). That is, the air-fuel ratio imbalance index value RIMB increases as the degree of imbalance in cylinder-specific air-fuel ratio increases.

Note that the horizontal axis of FIG. 17 indicates the imbalance rate. The imbalance rate corresponds to the value of "$\alpha$" when it is assumed that the amount of fuel to be supplied to a non-imbalance cylinder is "1" and the amount of fuel to be supplied to the imbalance cylinder is "$1+\alpha$". In general, the imbalance rate is expressed in the form of $\alpha \cdot 100\%$.

The CPU calculates, as the large purge amount case parameter Pon, the air-fuel ratio imbalance index value RIMB in the case where the vaporized fuel ratio is equal to or greater than the first predetermined value and calculates, as the small purge amount case parameter Poff, the air-fuel ratio imbalance index value RIMB in the case where the vaporized fuel ratio is "less than the second predetermined value equal to or less than the first predetermined value".

(Acquisition of Large Purge Amount Case Parameter Pon)

Figure 18:
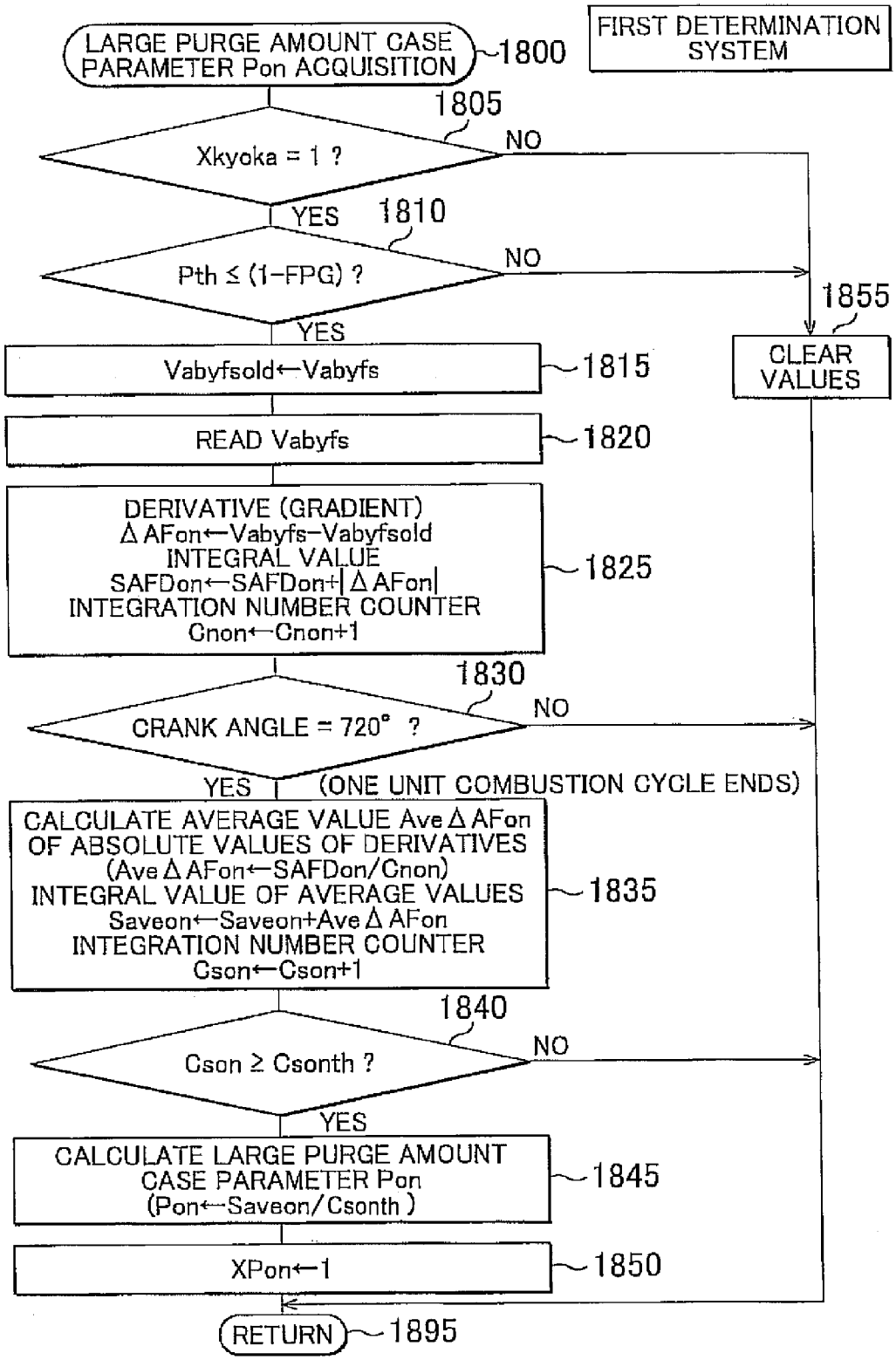
FIG. 18 is a flow chart showing a routine to be executed by the CPU of the first determination system.

The CPU is configured to execute the routine shown by the flow chart in FIG. 18 every 4 ms (4 milliseconds=predetermined fixed sampling time ts).

Thus, the CPU starts the process from step 1800 at a predetermined timing, proceeds to step 1805, and determines whether the value of the parameter acquisition allowance flag Xkyoka is "1".

The parameter acquisition allowance flag Xkyoka is set to "0" in the above-described initial routine. In addition, by executing a routine (not shown), the parameter acquisition allowance flag Xkyoka is set to "1" if the parameter acquisition condition is satisfied when the reference cylinder (first cylinder in this embodiment) reaches the compression top dead center. The parameter acquisition allowance flag Xkyoka is immediately set to "0" when the parameter acquisition condition is not satisfied.

The parameter acquisition condition is satisfied when all the following conditions (conditions C1 to C5) are satisfied. Thus, the parameter acquisition condition is not satisfied when at least one of the following conditions (conditions C1 to C5) is not satisfied. Needless to say, the conditions constituting the parameter acquisition condition are not limited to the following conditions C1 to C5.

(Condition C1) The intake air amount Ga acquired by the air flow meter 61 is within a predetermined range. Specifically, the intake air amount Ga is equal to or greater than a lower threshold air flow rate GaLoth and equal to or less than a higher threshold air flow rate GaHith. The condition C1 makes it possible to avoid "the deterioration of accuracy of the air-fuel ratio imbalance index value RIMB" that is caused by the variation of the response of the output value Vabyfs under the influence of the intake air amount Ga. (Condition C2) The engine speed NE is within a predetermined range. Specifically, the engine speed NE is equal to or higher than a lower threshold engine speed NELoth and equal to or lower than a higher threshold engine speed NEHith. (Condition C3) The coolant temperature THW is equal to or higher than a threshold coolant temperature THWth. (Condition C4) The main feedback control condition is satisfied. (Condition C5) Fuel cut control is not being performed.

Figure 10:
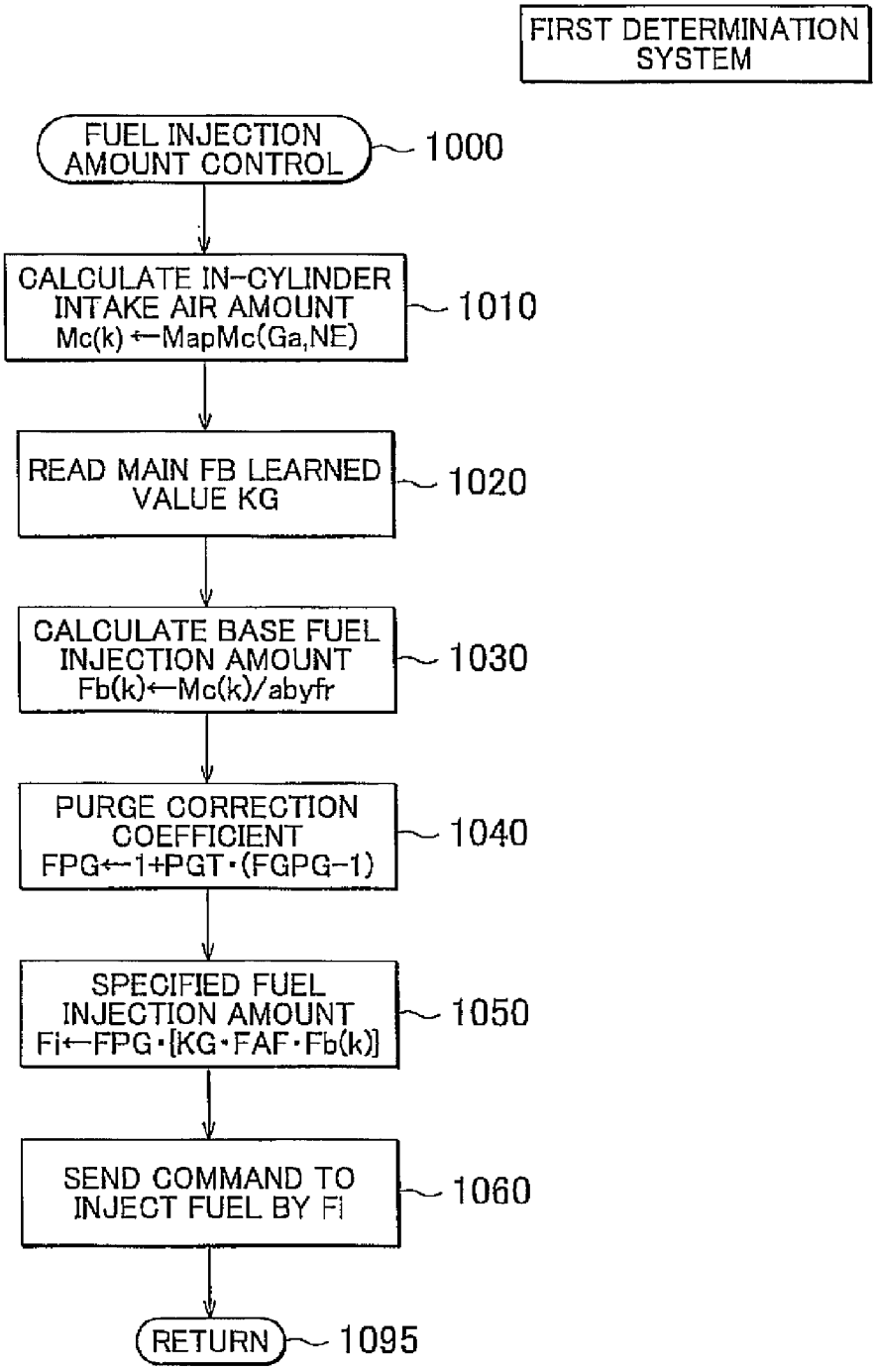
FIG. 10 is a flow chart showing a routine to be executed by a central processing unit (CPU) of an abnormality determination system (first determination system) according to a first embodiment of the invention.

As shown by the above equation (3) and step 1050 in FIG. 10, the instructed fuel injection amount Fi is calculated using the equation, Fi=FPG·{KG·FAF·Fb(k)}. As can be understood from the fact, for example, that when the target purge ratio PGT is "0", the purge correction coefficient FPG calculated in step 1040 in FIG. 10 becomes "1", the value, {KG·FAF·Fb(k)}, is the amount of fuel required to achieve the target air-fuel ratio abyfr (stoichiometric air-fuel ratio stoich, for example) when the vaporized fuel purge is not executed at all.

Thus, {KG·FAF·Fb(k)} means that fuel whose amount is equivalent to the value of (1−FPG)·{KG·FAF·Fb(k)} is supplied in the form of the vaporized fuel. Thus, the ratio of "the amount of vaporized fuel (1−FPG)·{KG·FAF·Fb(k)}" to "the total amount of fuel to be supplied to the engine 10, {KG·FAF·Fb(k)}", is 1−FPG. The ratio, 1−FPG, is also referred to as the vaporized fuel ratio, γ.

Thus, when the value of the parameter acquisition allowance flag Xkyoka is "1", the CPU makes the affirmative determination, "Yes", in step 1805, proceeds to step 1810, and determines whether the value of (1−FPG) is equal to or greater than the threshold value Pth. The threshold value Pth is referred to also as the first predetermined value for convenience. The threshold value Pth is set to a value (0.5=50%, for example) that means that a sufficient amount of vaporized fuel is being supplied to the engine 10. Thus, in step 1810, the CPU determines whether the vaporized fuel ratio is equal to or higher than the first predetermined value.

The CPU may determine, in step 1810 whether or not the value of (1−FPG) is equal to or greater than the threshold value Pth and less than the threshold value (Pth+A). The value A is positive. The value A is set to a small value so as to ensure that the vaporized fuel ratio is close to the first predetermined value. Thus, in this case, the CPU determines whether the vaporized fuel ratio is substantially equal to a predetermined value (Pth) that is sufficiently large.

Assume that the value of (1−FPG) is equal to or higher than the threshold value Pth. In this case, the CPU makes the affirmative determination, "Yes", in step 1810, sequentially performs the processes of steps 1815 to 1825 to be described below, and proceeds to step 1830.

Step 1815: The CPU stores, as the preceding output value Vabyfs, the output value Vabyfs that was read in during the preceding execution of this routine. That is, the preceding output value Vabyfsold is the output value Vabyfs 4 ms (sampling time ts) before the present. The initial value of the output value Vabyfs is set to a value corresponding to the stoichiometric air-fuel ratio in the above-described initial routine.

Step 1820: The CPU reads the present output value Vabyfs of the upstream-side air-fuel ratio sensor 66.

Step 1825: The CPU updates the value of the ΔAFon that is the derivative d(abyfs)/dt when the vaporized fuel ratio is higher than the first predetermined value (vaporized fuel ratio=50% in this embodiment), the integral value SAFDon that is the integral of the absolute value of the derivative ΔAFon, and the value of the integration number counter Cnon. The method of update will be concretely described below.

(A) Update of Derivative ΔAFon

The CPU obtains the derivative ΔAFon by subtracting the preceding output value Vabyfsold from the current output value Vabyfs. Specifically, the CPU calculates the "current derivative ΔAFon(n)" in step 1825 using the following equation (25) where the current output value Vabyfs is Vabyfs(n) and the preceding output value Vabyfsold is Vabyfs(n−1). This routine is executed at very short time intervals (4 ms), so that the value ΔAFon(n) can be regarded as the derivative d(Vabyfs)/dt.

$$\Delta AFon(n)=Vabyfs(n)-Vabyfs(n-1) \tag{25}$$

(B) Update of Integral Value SAFDon of Absolute Value |ΔAFon| of Derivative ΔAFon The CPU calculates the current integral value SAFDon(n) using the following equation (26). Specifically, the CPU updates the integral value SAFDon by adding the absolute value |ΔAFon(n)| of the current integral value ΔAFon(n) calculated as described above to the preceding integral value SAFDon at the time of proceeding to step 1825.

$$SAFDon(n)=SAFDon(n-1)+|\Delta AFon(n)| \tag{26}$$

Figure 16C:
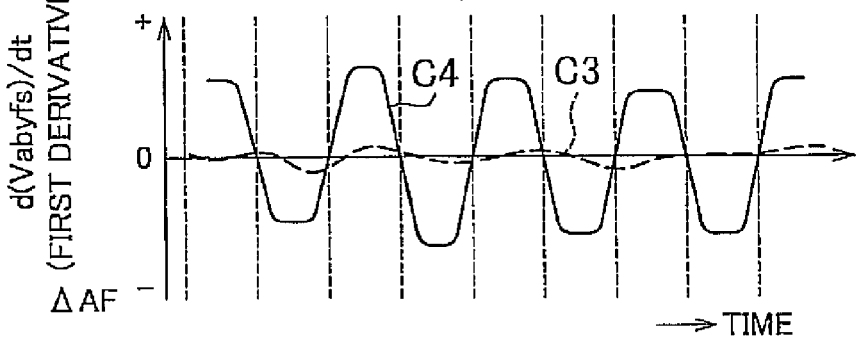

The reason why "the absolute value of the current derivative |ΔAFon(n)|" is added to the integral value SAFDon is because the derivative ΔAFon(n) can become either positive or negative as can be seen from FIGS. 16B and 16C. Note that the integral value SAFDon is also set to "0" in the above described initial routine.

(C) Update of Counter Cnon Indicating Number of Times Absolute Value of Derivative ΔAFon is Added to Integral Value SAFDon The CPU increases the value of the counter Cnon by "1" according to the following equation (27). In the equation (27), Cnon(n) is the counter Cnon after update and Cnon(n−1) is the counter Cnon before update. The value of the counter Cnon is set to "0" in the above-described initial routine and is set to "0" also in step 1855 to be described below. Thus, the value of the counter Cnon indicates the number of data of the absolute values |ΔAFon| of the derivatives ΔAFon that have been added to the integral value SAFDon.

$$Cnon(n)=Cnon(n-1)+1 \tag{27}$$

Next, the CPU proceeds to step 1830 and determines whether the crank angle CA (absolute crank angle CA) relative to the compression top dead center of the first cylinder has reached the 720-degree crank angle. In this step, when the absolute crank angle CA is less than the 720-degree crank angle, the CPU makes the negative determination, "No", in step 1830, directly proceeds to step 1895, and exits this routine.

The step 1830 is a step of determining the unit time period (unit combustion cycle) for calculating the average value of the absolute value |ΔAFon| of the derivative ΔAFon and in this embodiment, the 720-degree crank angle corresponds to the unit time period. The crank angle determining the unit time period may be less than 720-degree crank angle. The unit time period, however, is preferably equal to or longer than a period obtained by multiplying the sampling time is by two or a greater integer.

On the other hand, if the absolute crank angle CA has reached the 720-degree crank angle when the CPU performs the process of step 1830, the CPU makes the affirmative determination, "Yes", in step 1830 and proceeds to step 1835. In step 1835, the CPU performs: (D) calculation of the average value AveΔAFon of the absolute value |ΔAFon| of the derivative ΔAFon; (E) calculation of the integral value Saveon of the average value AveΔAFon; and (F) increment of the integration number counter Cson. A method of update these values will be specifically described below.

(D) Calculation of Average Value AveΔAFon of Absolute Value |ΔAFon| of Derivative ΔAFon The CPU calculates the average value AveΔAFon (=SAFDon/Cnon) of the absolute value |ΔAFon| over the preceding unit combustion cycle period by dividing the integral value SAFDon by the value of the counter Cnon. The CPU then sets the values of the integral value SAFDon and the counter Cnon to "0".

(E) Calculation of Integral Value Saveon of Average Value AveΔAFon

The CPU calculates the current integral value Saveon(n) using the following equation (28). Specifically, the CPU updates the integral value Saveon by adding the current average value AveΔAFon calculated as described above to the preceding integral value Saveon(n−1) at the time of proceeding to step 1835. The value of the integral value Saveon is set to "0" in the above-described initial routine.

$$Saveon(n)=Saveon(n-1)+Ave\Delta AFon \quad (28)$$

(F) Increment of Integration Number Counter Cson

The CPU increments the value of the counter Cson by "1" according to the following equation (29). In the equation (29), Cson(n) is the counter Cson after update and Cson(n−1) is the counter Cson before update. The value of the counter Cson is set to "0" in the above-described initial routine. Thus, the value of the counter Cson indicates the number of data of the average values AveΔAFon that have been added to the integral value Saveon.

$$Cson(n)=Cson(n-1)+1 \quad (29)$$

The CPU then proceeds to step 1840 and determines whether the value of the counter Cson is equal to or greater than the threshold value Csonth. In this step, when the value of the counter Cson is less than the threshold value Csonth, the CPU makes the negative determination, "No", in step 1840, directly proceeds to step 1895, and exits this routine. Note that the threshold value Csonth is a natural number and is preferably equal to or greater than two.

On the other hand, if the value of the counter Cson is equal to or greater than Csonth when the CPU performs the process of step 1840, the CPU makes the affirmative determination, "Yes", in step 1840, proceeds to step 1845, and calculates the large purge amount case parameter Pon.

More specifically, the CPU calculates the large purge amount case parameter Pon by dividing the integral value Saveon by the value of the counter Cson (=Csonth) according to the following equation (30). The large purge amount case parameter Pon is a value obtained by averaging the absolute value |ΔAFon| of the derivative ΔAFon over a unit combustion cycle and averaging the obtained average of the absolute value |ΔAFon| over a plurality of unit combustion cycles (Csonth cycles) while the vaporized fuel ratio is equal to or higher than the first predetermined value. Thus, the large purge amount case parameter Pon is an imbalance determination parameter that is used to determine the occurrence of an imbalance and that increases as the degree of imbalance in cylinder-specific air-fuel ratio increases.

$$Pon=Saveon/Csonth \quad (30)$$

Next, the CPU proceeds to step 1850 and sets the value of the large purge amount case parameter calculation completion flag XPon to "1". The CPU then proceeds to step 1895 and exits this routine. Note that the value of the large purge amount case parameter calculation completion flag XPon is set to "0" in the above-described initial routine. Thus, the large purge amount case parameter calculation completion flag XPon, whose value is "1", indicates that "the large purge amount case parameter Pon is acquired after the current operation of the engine 10 was started", and the large purge amount case parameter calculation completion flag XPon, whose value is "0", indicates that "the large purge amount case parameter Pon has not been acquired yet after the current operation of the engine 10 was started".

On the other hand, in the case where the value of the parameter acquisition allowance flag Xkyoka is not "1" when the CPU proceeds to step 1805 or in the case where the value of (1−FPG) is not equal to or greater than the threshold value Pth when the CPU proceeds to step 1810, the CPU proceeds to step 1855. The CPU sets, or clears, the values (ΔAFon, SAFDon, Cnon, etc.) to "0" in step 1855, directly proceeds to step 1895, and exits this routine. In this way, the large purge amount case parameter Pon is acquired.

(Acquisition of Small Purge Amount Case Parameter Poff)

Figure 19:
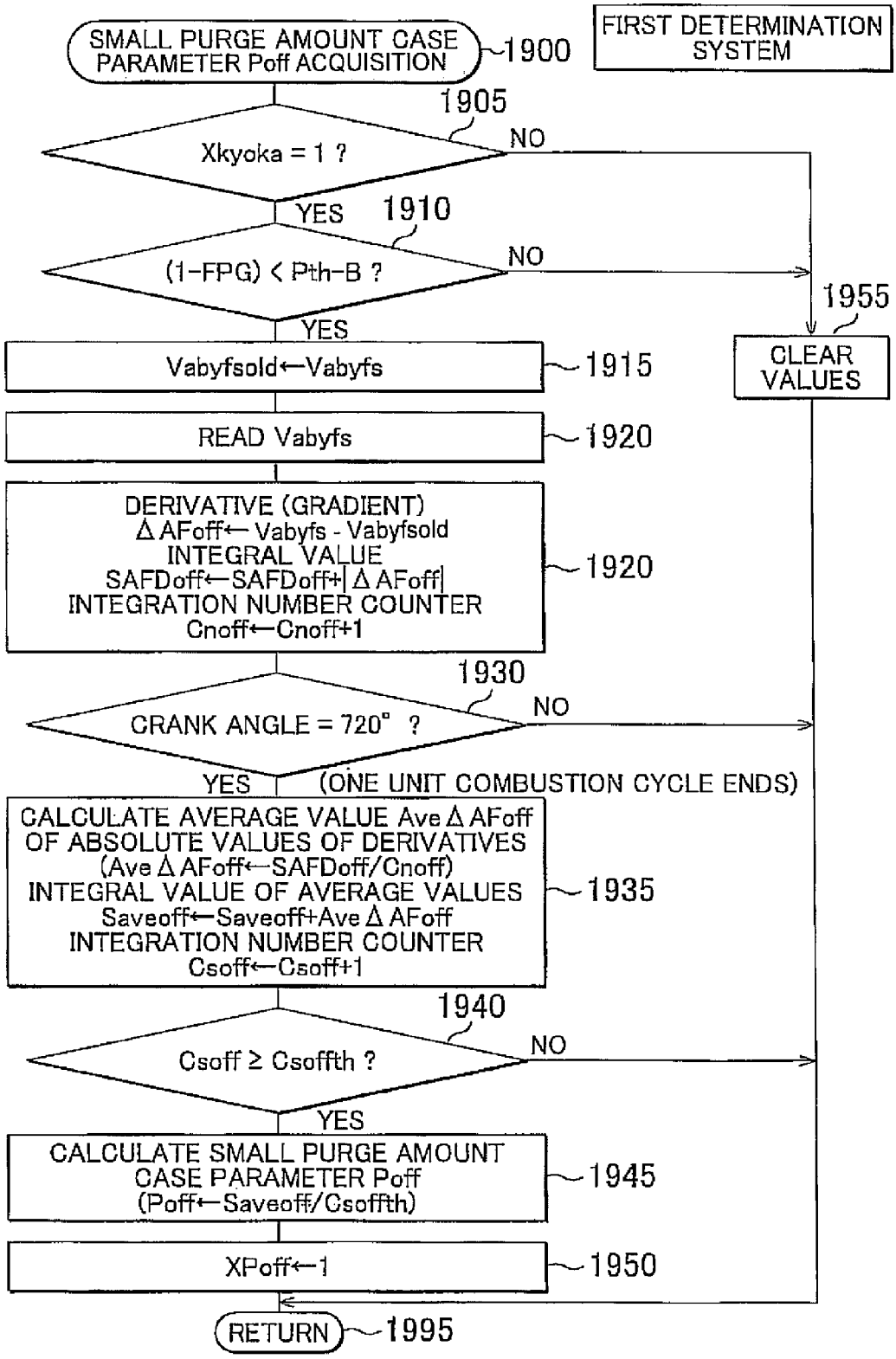
FIG. 19 is a flow chart showing a routine to be executed by the CPU of the first determination system.

The CPU is configured to execute the routine shown by the flow chart in FIG. 19 every 4 ms. The CPU calculates the small purge amount case parameter Poff in this routine by the method similar to that used to calculate the large purge amount case parameter Pon.

Thus, the CPU starts the process from step 1900 at a predetermined timing, proceeds to step 1905, and determines whether the value of the parameter acquisition allowance flag Xkyoka is "1".

Assume that the value of the parameter acquisition allowance flag Xkyoka is "1". In this case, the CPU makes the affirmative determination, "Yes", in step 1905, proceeds to step 1910, and determines whether the value of (1−FPG) is less than the threshold value (Pth-B). The value B is positive. The threshold value (Pth-B) is referred to also as the second predetermined value, which is smaller than the first predetermined value (Pth). The threshold value (Pth-B) is set to a value (0%, for example) that means that it can be considered that substantially no vaporized fuel is supplied to the engine 10.

Assume that the value of (1−FPG) is less than the threshold value (Pth-B). In this case, the CPU makes the affirmative determination, "Yes", in step 1910, sequentially performs the processes of steps 1915 to 1925 to be described below, and proceeds to step 1930.

Step 1915: The CPU stores, as the preceding output value Vabyfs, the output value Vabyfs that was read in during the preceding execution of this routine.

Step 1920: The CPU reads the present output value Vabyfs of the upstream-side air-fuel ratio sensor 66.

Step 1925: The CPU updates the value of the ΔAFoff that is the derivative d(abyfs)/dt when the vaporized fuel ratio is lower than the second predetermined value (vaporized fuel ratio=0% in this embodiment), the integral value SAFDoff that is the integral of the absolute value of the derivative ΔAFoff, and the value of the integration number counter Cnoff. The methods of such updates are similar to those in the process of step 1825. These processes will be briefly described below.

(G) Update of Derivative ΔAFoff The CPU calculates the current derivative ΔAFoff(n) using the following equation (31).

$$\Delta AFoff(n)=Vabyfs(n)-Vabyfs(n-1) \quad (31)$$

(H) Update of Integral Value SAFDoff of Absolute Value |ΔAFoff| of Derivative ΔAFoff The CPU calculates the current integral value SAFDoff(n) using the following equation (32). The integral value SAFDoff(n−1) is the preceding integral value SAFDoff at the time of proceeding to step 1925.

$$SAFDoff(n)=SAFDoff(n-1)+|\Delta AFoff(n)| \quad (32)$$

(I) Update of Integration Number Counter Cnoff indicating Number of Times Absolute Value of Derivative ΔAFoff is Added to Integral Value SAFDoff The CPU increments the value of the counter Cnoff by "1" according to the following equation (33). In the equation (33), Cnoff(n) is the counter Cnoff after update and Cnoff(n−1) is the counter Cnoff before update. The value of the counter Cnoff is set to "0" in the above-described initial routine and is set to "0" also in step 1955 to be described below. The value of the counter Cnoff indicates the number of data of the absolute values |ΔAFoff| of the derivatives ΔAFoff that have been added to the integral value SAFDoff.

$$Cnoff(n)=Cnoff(n-1)+1 \quad (33)$$

Next, the CPU proceeds to step 1930 and determines whether the crank angle CA (absolute crank angle CA) relative to the compression top dead center of the first cylinder has reached the 720-degree crank angle. In this step, when the absolute crank angle CA is less than the 720-degree crank angle, the CPU makes the negative determination, "No", in step 1930, directly proceeds to step 1995, and exits this routine. The meaning of this step is the same as that of step 1830.

On the other hand, if the absolute crank angle CA has reached the 720-degree crank angle when the CPU performs the process of step 1930, the CPU makes the affirmative determination, "Yes", in step 1930 and proceeds to step 1935. In step 1935, the CPU performs: (J) calculation of the average value AveΔAFoff of the absolute value |ΔAFoff| of the derivative ΔAFoff; (K) calculation of the integral value Saveoff of the average value AveΔAFoff; and (L) increment of the integration number counter Csoff. The methods of such updates are similar to those in the process of step 1845. These processes will be briefly described below.

(J) Calculation of Average Value AveΔAFoff of Absolute Value |ΔAFoff| of Derivative ΔAFoff The CPU calculates the average value AveΔAFoff (=SAFDoff/Cnoff) of the absolute value |ΔAFoff| over the preceding unit combustion cycle period by dividing the integral value SAFDoff by the value of the counter Cnoff. The CPU then sets the values of the integral value SAFDoff and the counter Cnoff to "0".

(K) Calculation of Integral Value Saveoff of Average Value AveΔAFoff

The CPU calculates the current integral value Saveoff(n) using the following equation (34). The integral value Saveoff (n−1) is the preceding integral value Saveoff at the time of proceeding to step 1935. The value of the integral value SAFDoff is set to "0" in the above-described initial routine.

$$Saveoff(n)=Saveoff(n-1)+Ave\Delta AFoff \quad (34)$$

(L) Increment of Integration Number Counter Csoff

The CPU increments the value of the counter Csoff by "1" according to the following equation (35). In the equation (35), Csoff(n) is the counter Csoff after update and Csoff(n−1) is the counter Csoff before update. The value of the counter Csoff is set to "0" in the above-described initial routine. Thus, the value of the counter Csoff indicates the number of data of the average values AveΔAFoff that have been added to the integral value Saveoff.

$$Csoff(n)=Csoff(n-1)+1 \quad (35)$$

The CPU then proceeds to step 1940 and determines whether the value of the counter Csoff is equal to or greater than the threshold value Csoffth. In this step, when the value of the counter Csoff is less than the threshold value Csoffth, the CPU makes the negative determination, "No", in step 1940, directly proceeds to step 1995, and exits this routine. The threshold value Csoffth is a natural number and is preferably the same as the threshold value Csonth.

On the other hand, if the value of the counter Csoff is equal to or greater than Csoffth when the CPU performs the process of step 1940, the CPU makes the affirmative determination, "Yes", in step 1940, proceeds to step 1945, and calculates the small purge amount case parameter Poff.

More specifically, the CPU calculates the small purge amount case parameter Poff by dividing the integral value Saveoff by the value of the counter Csoff (=Csoffth) according to the following equation (36). The small purge amount case parameter Poff is a value obtained by averaging the absolute value |ΔAFoff| of the derivative ΔAFoff over a unit combustion cycle and averaging the obtained average of the absolute value |ΔAFoff| over a plurality of unit combustion cycles (Csoffth cycles) while the vaporized fuel ratio is less than "the second predetermined value that is equal to or less than the first predetermined value". Thus, the small purge amount case parameter Poff is an imbalance determination parameter that is used to determine the occurrence of an imbalance and that increases as the degree of imbalance in cylinder-specific air-fuel ratio increases.

$$Poff=Saveoff/Csoffth \quad (36)$$

Next, the CPU proceeds to step 1950 and sets the value of the small purge amount case parameter calculation completion flag XPoff to "1". The CPU then proceeds to step 1995 and exits this routine. Note that the value of the small purge amount case parameter calculation completion flag XPoff is set to "0" in the above-described initial routine. Thus, the small purge amount case parameter calculation completion flag XPoff, whose value is "1", indicates that "the small purge amount case parameter Poff is acquired after the current operation of the engine 10 was started", and the small purge amount case parameter calculation completion flag XPoff, whose value is "0", indicates that "the small purge amount case parameter Poff has not been acquired yet after the current operation of the engine 10 was started".

On the other hand, in the case where the value of the parameter acquisition allowance flag Xkyoka is not "1" when the CPU proceeds to step 1905 or in the case where "the value of (1−FPG) is not less than the threshold value Pth-B" when the CPU proceeds to step 1910, the CPU proceeds to step 1955. The CPU sets, or clears, the values (ΔAFoff, SAFDoff, Cnoff, etc.) to "0" in step 1955, directly proceeds to step 1995, and exits this routine. In this way, the small purge amount case parameter Poff is acquired.

(Abnormality Determination)

Next, the process of performing the "abnormality determination" will be described. The CPU executes the routine shown by a flow chart in FIG. 20 every time a predetermined period of time has elapsed.

Figure 20:
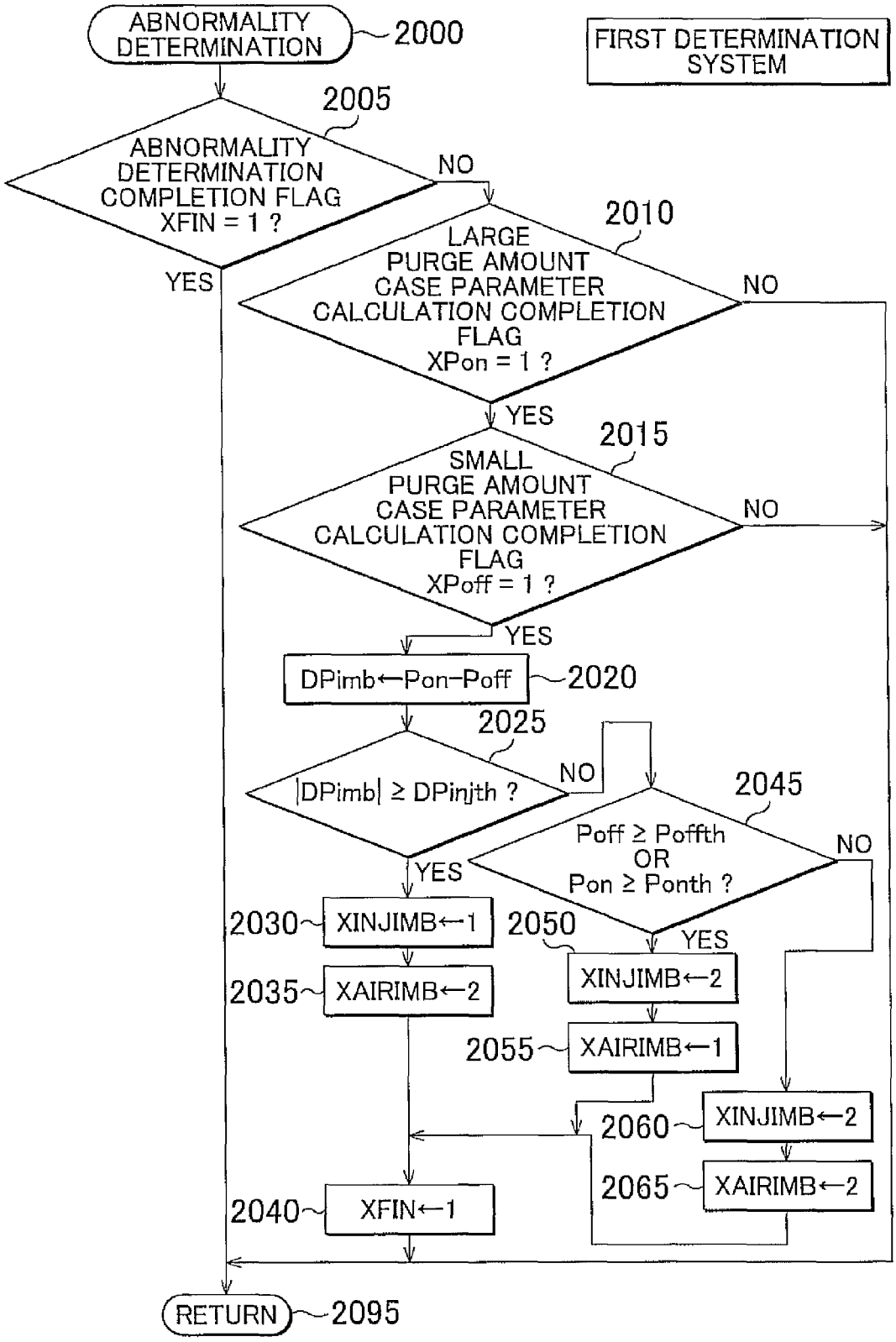
FIG. 20 is a flow chart showing a routine to be executed by the CPU of the first determination system.

Thus, the CPU starts the process from step 2000 in FIG. 20 at a predetermined timing, proceeds to step 2005, and determines whether the value of the abnormality determination completion flag XFIN is "1". The abnormality determination completion flag XFIN is set to "0" in the above-described initial routine and is set to "1" in step 2040 to be described later when the abnormality determination is completed.

Assume that the value of the abnormality determination completion flag XFIN is "0". In this case, the CPU makes the negative determination, "No", in step 2005, proceeds to step 2010, and determines whether the value of the large purge amount case parameter calculation completion flag XPon is "1". In this step, when the value of the flag XPon is not "1" (that is, the large purge amount case parameter Pon has not been acquired yet), the CPU makes the negative determination, "No", in step 2010, directly proceeds to step 2095, and exits this routine.

On the other hand, when the value of the large purge amount case parameter calculation completion flag XPon is "1", the CPU makes the affirmative determination, "Yes", in step 2010, proceeds to step 2015, and determines whether the small purge amount case parameter calculation completion flag XPoff is "1". In this step, when the value of the flag XPoff is not "1" (that is, the small purge amount case parameter Poff has not been acquired yet), the CPU makes the negative determination, "No", in step 2015, directly proceeds to step 2095, and exits this routine.

On the other hand, when the value of the small purge amount case parameter calculation completion flag XPoff is "1", the CPU makes the affirmative determination, "Yes", in step 2015, and proceeds to step 2020. Specifically, when both of the large purge amount case parameter Pon and the small purge amount case parameter Poff are acquired after the current operation of the engine 10 is started, the CPU proceeds to step 2020.

When the CPU proceeds to step 2020, the CPU calculates a parameter difference correlation value DPimb by subtracting the small purge amount case parameter Poff from the large purge amount case parameter Pon according to the following equation (37).

$$DPimb = Pon - Poff \tag{37}$$

Next, the CPU proceeds to step 2025 and determines whether the absolute value of the parameter difference correlation value DPimb (|DPimb|) is equal to or greater than a first abnormality determination threshold value Dpinjth. When the absolute value of the parameter difference correlation value DPimb (|DPimb|) is equal to or greater than the first abnormality determination threshold value Dpinjth, the CPU determines that "an inter-cylinder fuel injection amount variation abnormality is occurring", proceeds to step 2030, and sets the value of a fuel injection amount variation abnormality occurrence flag XINJIMB to "1". Specifically, the CPU records the fact that an inter-cylinder fuel injection amount variation abnormality has occurred. Note that the value of the fuel injection amount variation abnormality occurrence flag XINJIMB is stored in the backup RAM. The value of the fuel injection amount variation abnormality occurrence flag XINJIMB is set to "0" in the above-described initial routine.

Next, the CPU proceeds to step 2035 and sets the value of the intake air amount variation abnormality occurrence flag XAIRIMB to "2". Specifically, the CPU records the fact that no inter-cylinder air intake amount variation abnormality has occurred. Note that the value of the intake air amount variation abnormality occurrence flag XAIRIMB is stored in the backup RAM. The value of the intake air amount variation abnormality occurrence flag XAIRIMB is also set to "0" in the above-described initial routine.

The CPU then proceeds to step 2040 to set the value of the determination completion flag XFIN to "1", proceeds to step 2095, and exits this routine. Thus, when the CPU restarts this routine after the predetermined period of time, the CPU makes the affirmative determination, "Yes", in step 2005, directly proceeds to step 2095, and exits this routine.

On the other hand, if the value of the parameter difference correlation value DPimb is less than the first abnormality determination threshold value Dpinjth when the CPU performs the process of step 2025, the CPU determines that no inter-cylinder fuel injection amount variation abnormality has occurred, and proceeds to step 2045.

In step 2045, the CPU determines whether one of the following conditions is satisfied: the small purge amount case parameter Poff is equal to or greater than a second abnormality determination threshold value Poffth; and the large purge amount case parameter Pon is equal to or greater than a third abnormality determination threshold value Ponth.

When one of these conditions: the small purge amount case parameter Poff is equal to or greater than the second abnormality determination threshold value Poffth; and the large purge amount case parameter Pon is equal to or greater than the third abnormality determination threshold value Ponth, is satisfied, the CPU determines that "an inter-cylinder air intake amount variation abnormality is occurring", sequentially performs the processes of steps 2050 and 2055 to be described below, and proceeds to step 2040.

Step 2050: The CPU sets the value of the fuel injection amount variation abnormality occurrence flag XINJIMB to "2". Specifically, the CPU records the fact that no inter-cylinder fuel injection amount variation abnormality has occurred. Step 2055: The CPU sets the intake air amount variation abnormality occurrence flag XAIRIMB to "1". Specifically, the CPU records the fact that an inter-cylinder air intake amount variation abnormality has occurred.

On the other hand, if the value of the small purge amount case parameter Poff is less than the second abnormality determination threshold value Poffth and the value of the large purge amount case parameter Pon is less than the third abnormality determination threshold value Ponth when the CPU performs the process of step 2045, the CPU determines that neither the inter-cylinder fuel injection amount variation abnormality nor the inter-cylinder air intake amount variation abnormality has occurred. Specifically, in this case, the CPU makes the negative determination, "No", in step 2045, sequentially performs the processes of steps 2060 and 2065 to be described below, and proceeds to step 2040.

Step 2060: The CPU sets the value of the fuel injection amount variation abnormality occurrence flag XINJIMB to "2". Specifically, the CPU records the fact that no inter-cylinder fuel injection amount variation abnormality has occurred. Step 2065: The CPU sets the value of the intake air amount variation abnormality occurrence flag XAIRIMB to "2". Specifically, the CPU records the fact that no inter-cylinder air intake amount variation abnormality has occurred.

As described above, the first determination system includes: a vaporized fuel purge device (purge control valve 55, etc.) that introduces the vaporized fuel that has occurred in the fuel tank 51 into the intake passage of the engine 10; a vaporized fuel purge amount control section (routine shown in FIG. 13) that controls the purge amount that is the amount of vaporized fuel to be introduced into the intake passage according to the operating conditions of the engine 10; an instructed fuel injection amount determination section (routines shown in FIGS. 10 to 12, and routines shown in FIGS. 14 and 15) that determines the instructed fuel injection amount Fi by feedback correcting the amount of fuel injected through the fuel injection valves 33 so that the air-fuel ratio indicated by the output value Vabyfs of the air-fuel ratio sensor (upstream-side air-fuel ratio sensor 66) (or the output value Vabyfs itself) is brought to a predetermined target air-fuel ratio abyfr (value corresponding to the target air-fuel ratio abyfr); and an injection command signal sending section (step 1060 in FIG. 10) that sends injection command signals to the plurality of fuel injection valves 33 so that fuel, whose amount corresponds to the instructed fuel injection amount Fi, is injected through each of the plurality of fuel injection valves 33.

In addition, the first determination system includes an index value acquisition section (routines shown in FIGS. 18 and 19) that, based on the output value Vabyfs of the upstream-side air-fuel ratio sensor 66, acquires the air-fuel ratio imbalance index value (large purge amount case parameter Pon and small purge amount case parameter Poff) that increases as the degree of imbalance in air-fuel ratio of the mixture to be supplied to each of the plurality of cylinders (cylinder-specific air-fuel ratio) between the plurality of cylinders increases.

The index value acquisition section acquires, as the large purge amount case parameter Pon, the air-fuel ratio imbalance index value that is acquired while the ratio of "the amount of vaporized fuel to be supplied to the engine 10" to "the total amount of fuel to be supplied to the engine 10" (vaporized fuel ratio) is equal to or higher than the first predetermined value (routine shown in FIG. 18), and acquires, as the small purge amount case parameter Poff, the air-fuel ratio imbalance index value that is acquired while the vaporized fuel ratio is "lower than the second predetermined value that is equal to or less than the first predetermined value (routine shown in FIG. 19).

In addition, the first determination system includes an abnormality determination section (step 2055 in FIG. 20) that, when the absolute value of the difference between the large purge amount case parameter Pon and the small purge amount case parameter Poff (|parameter difference correlation value DPimb|) is less than the first abnormality determination threshold value (fuel injection valve abnormality determination value Dpinjth) (steps 2020 and 2025 in FIG. 20) and one of the following conditions is satisfied: the small purge amount case parameter Poff is equal to or greater than the second abnormality determination threshold value (Poffth); and the large purge amount case parameter Pon is equal to or greater than the third abnormality determination threshold value (Ponth) (step 2045 in FIG. 20), determines that an intake air amount abnormality that the degree of imbalance in the amount of intake air to be supplied to each of the plurality of cylinders between the plurality of cylinders is equal to or greater than an allowable value is occurring.

In addition, the abnormality determination section is configured to determine that there is an abnormality in the fuel injection valves 33 (an inter-cylinder fuel injection amount variation abnormality is occurring) when the absolute value of the difference (|parameter difference correlation value DPimb|) is equal to or greater than the first abnormality determination threshold value (Dpinjth) (step 2025 and step 2030 in FIG. 20).

Thus, with the first determination system, it is possible to ensure that the occurrence of an inter-cylinder air intake amount variation abnormality is detected while it is distinguished from the occurrence of an inter-cylinder fuel injection amount variation abnormality.

( Second Embodiment)

Next, the determination system according to a second embodiment of the invention (hereinafter referred to merely as the "second determination system") will be described. The second determination system differs from the first determination system only in that when one of the large purge amount case parameter Pon and the small purge amount case parameter Poff is acquired first, the amount of purge of the vaporized fuel is changed (vaporized fuel purge control is changed) so that the parameter that has not been acquired yet is quickly acquired. Thus, this difference will be mainly described below.

The CPU of the second determination system changes the vaporized fuel purge control as follows. (Case 1) The CPU inhibits the vaporized fuel purge (or restricts the amount of purge of vaporized fuel (the amount of vaporized fuel to be introduced into the intake passage) to a small value) when the large purge amount case parameter Pon has already been acquired and the small purge amount case parameter Poff has not been acquired yet. (Case 2) Even when there is "a request to inhibit the vaporized fuel purge" from another control process, the CPU ignores the request (or sets the amount of purge of the vaporized fuel (the amount of vaporized fuel to be introduced into the intake passage) to a large value) when the small purge amount case parameter Poff has already been acquired and the large purge amount case parameter Pon has not been acquired yet.

The CPU of the second determination system executes the routines shown in FIGS. 10 to 12, 14, 15, and 18 to 20 as in the case of the first determination system. In addition, the CPU of the second determination system executes the routines shown by the flow charts in FIGS. 21 to 23. An operation of the second determination system will be described below with reference to the routines shown in FIGS. 21 to 23.

Figure 21:
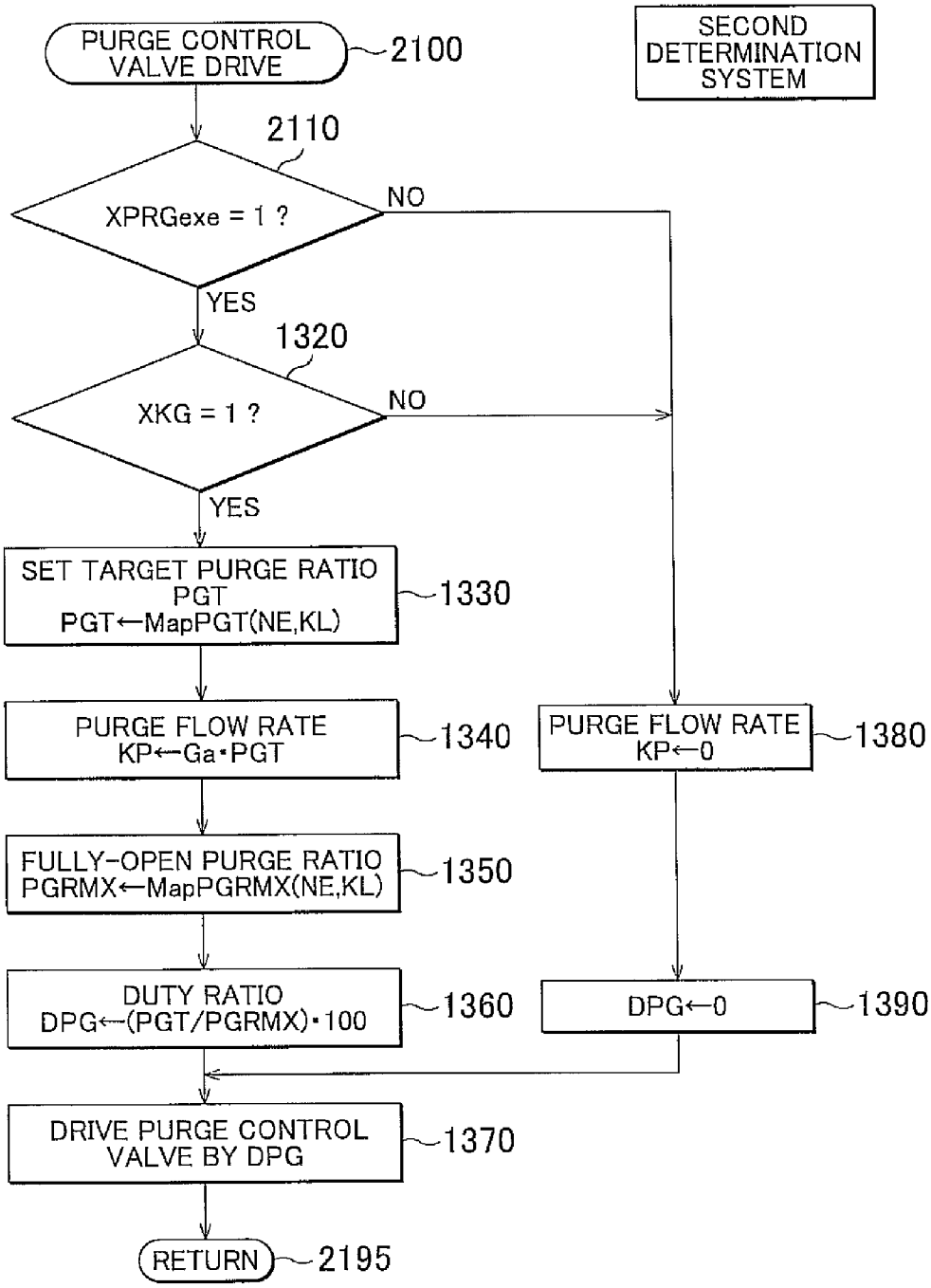
FIG. 21 is a flow chart showing a routine to be executed by a CPU of an abnormality determination system (second determination system) according to a second embodiment of the invention.

The routine shown in FIG. 21 differs from the routine shown in FIG. 13 in that step 1310 of the routine shown in FIG. 13 is replaced by step 2110. Specifically, when the CPU proceeds to step 2110, the CPU determines whether the value of the purge execution allowance flag XPRGexe is "1".

The value of the purge execution allowance flag XPRGexe is set to "0" in step 2330 of the routine shown in FIG. 23 to be described later and is set to "1" in step 2360. The CPU makes the affirmative determination, "Yes", in step 2110 and proceeds to step 1320 when the value of the purge execution allowance flag XPRGexe is "1". On the other hand, when the value of the purge execution allowance flag XPRGexe is "0", the CPU makes the negative determination, "No", in step 2110 and proceeds to step 1380. Thus, in this case, no vaporized fuel purge is executed.

The CPU is configured to execute the "flag operation routine" shown in FIG. 22 every time a predetermined period of time has elapsed and execute the "purge execution allowance flag setting routine" shown in FIG. 23 subsequently to the flag operation routine. Note that the CPU is configured to set the values of the "purge inhibition request flag XPinh and invalidation flag XPTinhclr for invalidating the purge inhibition request from another control process" that are used in these routines, to "0" in the above-described initial routine. Note that the purge inhibition request from another control process is issued when, for example, a request to set the target air-fuel ratio abyfr richer or leaner than the stoichiometric air-fuel ratio is issued.

(Assumption 1) Assume that none of the large purge amount case parameter Pon and the small purge amount case parameter Poff has been acquired yet after the current operation of the engine 10 was started. In this case, both the value of the large purge amount case parameter calculation completion flag XPon and the value of the small purge amount case parameter calculation completion flag XPoff are "0". In addition, the value of the abnormality determination completion flag XFIN is "0".

Figure 22:
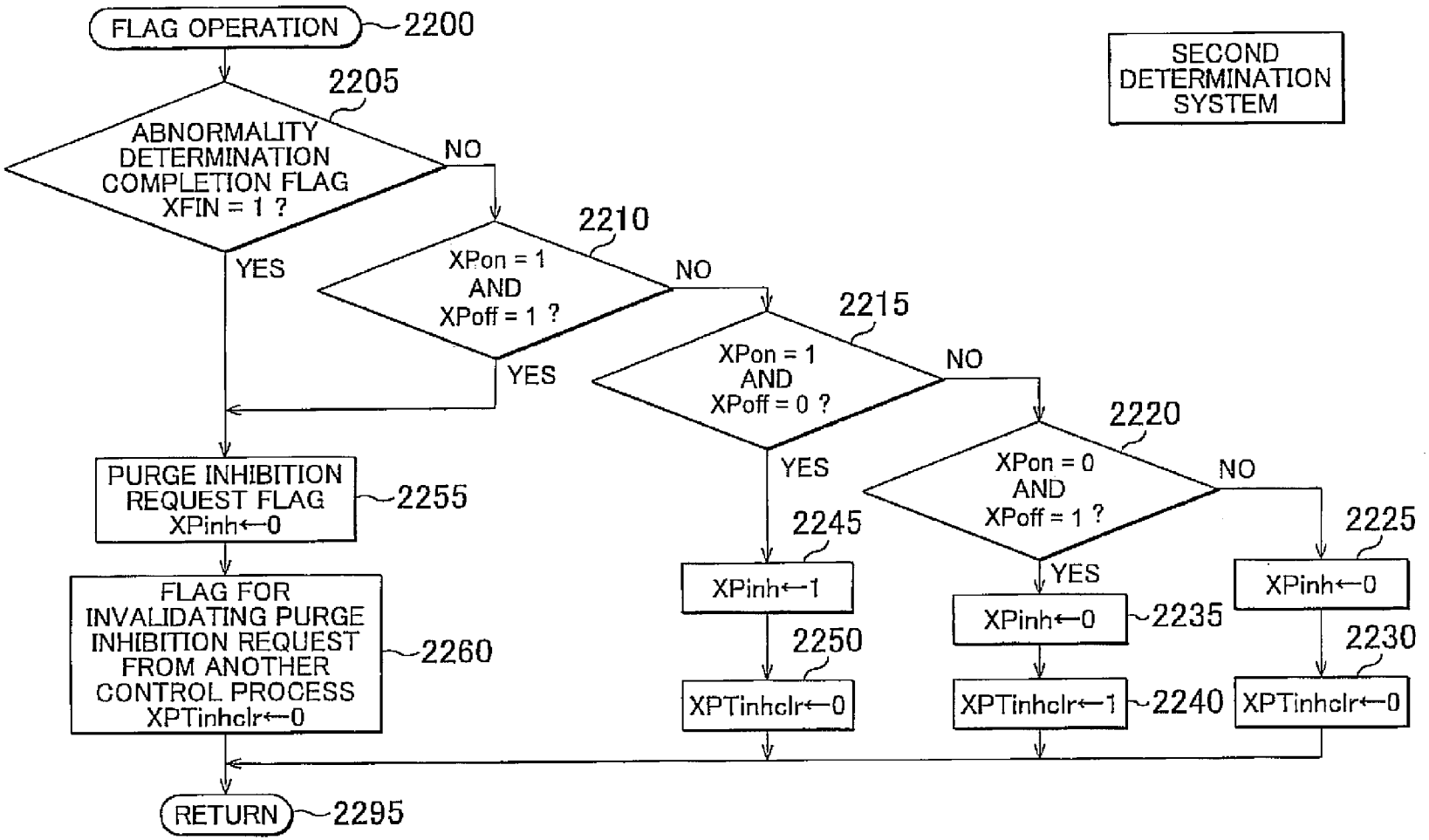
FIG. 22 is a flow chart showing a routine to be executed by the CPU of the second determination system.

The CPU starts the process from step 2200 in FIG. 22 at a predetermined timing, proceeds to step 2205, and determines whether the value of the abnormality determination completion flag XFIN is "1". According to the above Assumption 1, the value of the abnormality determination completion flag XFIN is "0". Thus, the CPU makes the negative determination, "No", in step 2205, proceeds to step 2210, and determines whether both the following conditions are satisfied: the value of the flag XPon is "1"; and the value of the flag XPoff is "1".

According to the above Assumption 1, both the value of the flag XPon and the value of the flag XPoff are "0". Thus, the CPU makes the negative determination, "No", in step 2210, proceeds to step 2215, and determines whether both the following conditions are satisfied: the value of the flag XPon is "1"; and the value of the flag XPoff is "0".

According to the above Assumption 1, both the value of the flag XPon and the value of the flag XPoff are "0". Thus, the CPU makes the negative determination, "No", in step 2215, proceeds to step 2220, and determines whether both the following conditions are satisfied: the value of the flag XPon is "0"; and the value of the flag XPoff is "1".

According to the above Assumption 1, both the value of the flag XPon and the value of the flag XPoff are "0". Thus, the CPU makes the negative determination, "No", in step 2220, proceeds to step 2225, and sets the value of the purge inhibition request flag XPinh to "0". Next, the CPU proceeds to step 2230 and sets the value of the invalidation flag XPTinhclr for invalidating the purge inhibition request from another control process to "0". The CPU then proceeds to step 2295 and exits this routine.

Figure 23:
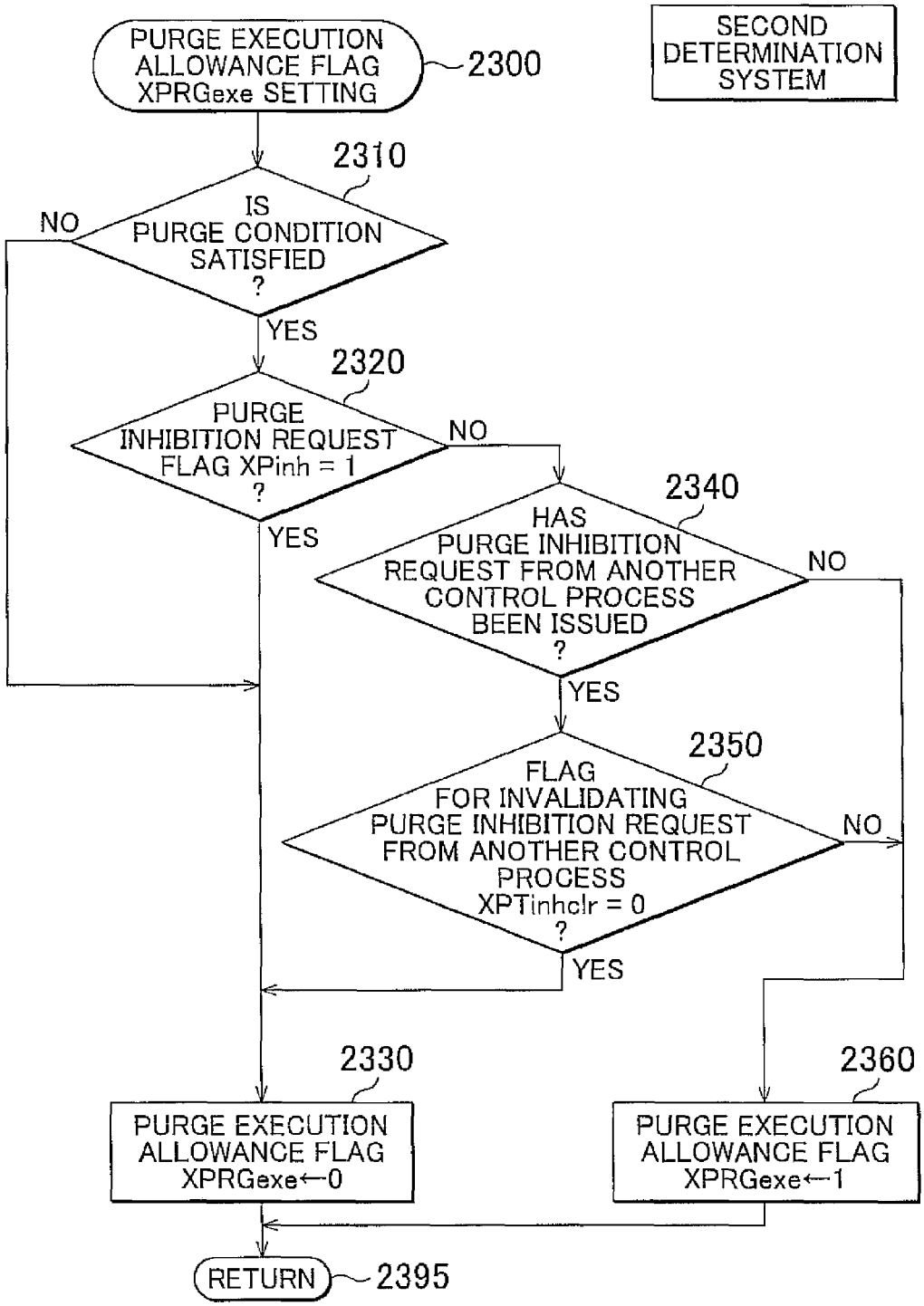
FIG. 23 is a flow chart showing a routine to be executed by the CPU of the second determination system.

Next, the CPU starts the process from step 2300 in FIG. 23, proceeds to step 2310, and determines whether the above-described purge condition is satisfied. In this step, when the purge condition is not satisfied, the CPU directly proceeds to step 2330 and sets the value of the purge execution allowance flag XPRGexe to "0". As a result, a negative determination, "No", is made in step 2110 in FIG. 21, so that the vaporized fuel purge is not executed (the vaporized fuel purge is inhibited).

On the other hand, when the purge condition is satisfied, the CPU makes the affirmative determination, "Yes", in step 2310, proceeds to step 2320, and determines whether the value of the purge inhibition request flag XPinh is "1". As described above, the present value of the purge inhibition request flag XPinh is "0". Thus, the CPU makes the negative determination, "No", in step 2320, proceeds to step 2340, and determines whether a purge inhibition request from another control process has been issued.

When no purge inhibition request from another control process has been issued, the CPU makes the negative determination, "No", in step 2340, proceeds to step 2360, and sets the value of the purge execution allowance flag XPRGexe to "1". As a result, an affirmative determination, "Yes", is made in step 2110 in FIG. 21, so that it is enabled to execute the vaporized fuel purge.

In addition, if a purge inhibition request from another control process has been issued when the CPU performs the process of step 2340, the CPU makes the affirmative determination, "Yes", in step 2340, proceeds to step 2350, and determines whether the value of the flag XPTinhclr for invalidating the purge inhibition request from another control process is "0". As described above, the present value of the flag XPTinhclr is "0". Thus, the CPU makes the affirmative determination, "Yes", in step 2350, proceeds to step 2330, and sets the value of the purge execution allowance flag XPRGexe to "0". As a result, a negative determination, "No", is made in step 2110 in FIG. 21, so that no vaporized fuel purge is executed (vaporized fuel purge is inhibited).

Specifically, when both the values of the flag XPoff and the flag XPon are "0", the values of the purge inhibition request flag XPinh and the invalidation flag XPTinhclr for invalidating the purge inhibition request from another control process are both set to "0" and as a result, the value of the purge execution allowance flag XPRGexe is set to "1" when the purge condition is satisfied and no purge inhibition request from another control process has been issued, and the value of the purge execution allowance flag is set to "0" when the purge condition is satisfied and a purge inhibition request from another control process has been issued or when the purge condition is not satisfied.

(Assumption 2) Next, assume that the large purge amount case parameter Pon has not been acquired and the small purge amount case parameter Poff has been acquired. In this case, the value of the large purge amount case parameter calculation completion flag XPon is set to "0", and the value of the small purge amount case parameter calculation completion flag XPoff is set to "1". The value of the abnormality determination completion flag XFIN is "0".

According to the above Assumption 2, the CPU makes the negative determination, "No", in steps 2205, 2210, and 2215 in FIG. 22 and makes the affirmative determination, "Yes", in step 2220. The CPU then sequentially performs the processes of steps 2235 and 2240 to be described below and proceeds to step 2295.

Step 2235: The CPU sets the value of the purge inhibition request flag XPinh to "0". Step 2240: The CPU sets the value of the invalidation flag XPTinhclr for invalidating the purge inhibition request from another control process to "1".

Next, the CPU starts the process from step 2300 in FIG. 23, proceeds to step 2310, and determines whether the purge condition is satisfied. In this step, when the purge condition is not satisfied, the CPU directly proceeds to step 2330 and sets the value of the purge execution allowance flag XPRGexe to "0". As a result, a negative determination, "No", is made in step 2110 in FIG. 21, so that no vaporized fuel purge is executed (the vaporized fuel purge is inhibited).

On the other hand, when the purge condition is satisfied, the CPU makes the affirmative determination, "Yes", in step 2310 and proceeds to step 2320. As described above, the present value of the purge inhibition request flag XPinh is "0". Thus, the CPU makes the negative determination, "No", in step 2320 and proceeds to step 2340.

When no purge inhibition request from another control process has been issued, the CPU makes the negative determination, "No", in step 2340, proceeds to step 2360, and sets the value of the purge execution allowance flag XPRGexe to "1". As a result, an affirmative determination, "Yes", is made in step 2110 in FIG. 21, so that it is enabled to execute the vaporized fuel purge.

In addition, if a purge inhibition request from another control process has been issued when the CPU performs the process of step 2340, the CPU makes the affirmative determination, "Yes", in step 2340 and proceeds to step 2350. As described above, the present value of the "invalidation flag XPTinhclr for invalidating the purge inhibition request from another control process" is "1". Thus, the CPU makes the negative determination, "No", in step 2350, proceeds to step 2360, and sets the value of the purge execution allowance flag XPRGexe to "1". As a result, the affirmative determination, "Yes", is made in step 2110 in FIG. 21, so that it is enabled to execute the vaporized fuel purge.

Specifically, when the value of the flag XPoff is "1" and the value of the flag XPon is "0", the value of the purge inhibition request flag XPinh is set to "0" and the value of the invalidation flag XPTinhclr for invalidating the purge inhibition request from another control process is set to "1". As a result, when the purge condition is not satisfied, the value of the purge execution allowance flag XPRGexe is set to "0", and when the purge condition is satisfied, the value of the purge execution allowance flag XPRGexe is set to "1" regardless of whether the purge inhibition request from another control process has been issued (that is, even when the purge inhibition request from another control process has been issued).

(Assumption 3) Next, assume that the large purge amount case parameter Pon has been acquired but the small purge amount case parameter Poff has not been acquired. In this case, the value of the large purge amount case parameter calculation completion flag XPon is set to "1" and the value of the small purge amount case parameter calculation completion flag XPoff is set to "0". The value of the abnormality determination completion flag XFIN is "0".

According to the above Assumption 3, the CPU makes the negative determination, "No", in steps 2205 and 2210 in FIG. 22 and makes the affirmative determination, "Yes", in step 2215. The CPU then sequentially performs the processes of steps 2245 and 2250 to be described below and proceeds to step 2295.

Step 2245: The CPU sets the value of the purge inhibition request flag XPinh to "1". Step 2250: The CPU sets the value of the invalidation flag XPTinhclr for invalidating the purge inhibition request from another control process to "0".

Next, the CPU starts the process from step 2300 in FIG. 23, proceeds to step 2310, and determines whether the purge condition is satisfied. In this step, when the purge condition is not satisfied, the CPU directly proceeds to step 2330 and sets the value of the purge execution allowance flag XPRGexe to "0". As a result, the negative determination, "No", is made in step 2110 in FIG. 21, so that no vaporized fuel purge is executed (the vaporized fuel purge is inhibited).

On the other hand, when the purge condition is satisfied, the CPU makes the affirmative determination, "Yes", in step 2310 and proceeds to step 2320. As described above, the present value of the purge inhibition request flag XPinh is "1". Thus, the CPU makes the affirmative determination, "Yes", in step 2320 and proceeds to step 2330. As a result, the value of the purge execution allowance flag XPRGexe is set to "0", so that no vaporized fuel purge is executed even when the purge condition is satisfied.

As described above, when the large purge amount case parameter Pon has been acquired but the small purge amount case parameter Poff has not been acquired, the vaporized fuel purge is inhibited.

(Assumption 4) Next, assume that both the large purge amount case parameter Pon and the small purge amount case parameter Poff have been acquired but the abnormality determination has not been performed. In this case, the value of the large purge amount case parameter calculation completion flag XPon is set to "1" and the value of the small purge amount case parameter calculation completion flag XPoff is set to "1". The value of the abnormality determination completion flag XFIN is "0".

According to the above Assumption 4, the CPU makes the negative determination, "No", in step 2205 in FIG. 22, makes the affirmative determination, "Yes", in step 2210, sequentially performs the processes of steps 2255 and 2260 to be described below, and then proceeds to step 2295.

Step 2255: The CPU sets the value of the purge inhibition request flag XPinh to "0". Step 2260: The CPU sets the value of the invalidation flag XPTinhclr for invalidating the purge inhibition request from another control process to "0".

Next, the CPU starts the process from step 2300 in FIG. 23, proceeds to step 2310, and determines whether the purge condition is satisfied. In this step, when the purge condition is not satisfied, the CPU directly proceeds to step 2330 and sets the value of the purge execution allowance flag XPRGexe to "0". As a result, a negative determination, "No", is made in step 2110 in FIG. 21, so that the vaporized fuel purge is not executed (the vaporized fuel purge is inhibited).

On the other hand, when the purge condition is satisfied, the CPU makes the affirmative determination, "Yes", in step 2310 and proceeds to step 2320. As described above, the present value of the purge inhibition request flag XPinh is "0". Thus, the CPU makes the negative determination, "No", in step 2320 and proceeds to step 2340.

When no purge inhibition request from another control process has been issued, the CPU makes the negative determination, "No", in step 2340, proceeds to step 2360, and sets the value of the purge execution allowance flag XPRGexe to "1". As a result, an affirmative determination, "Yes", is made in step 2110 in FIG. 21, so that it is enabled to execute the vaporized fuel purge.

In addition, if a purge inhibition request from another control process has been issued when the CPU performs the process of step 2340, the CPU makes the affirmative determination, "Yes", in step 2340 and proceeds to step 2350. As described above, the present value of the "invalidation flag XPTinhclr for invalidating the purge inhibition request from another control process" is "0". Thus, the CPU makes the affirmative determination, "Yes", in step 2350, proceeds to step 2330, and sets the value of the purge execution allowance flag XPRGexe to "0". As a result, a negative determination, "No", is made in step 2110 in FIG. 21, so that the vaporized fuel purge is not executed (the vaporized fuel purge is inhibited).

(Assumption 5) Next, assume that both the large purge amount case parameter Pon and the small purge amount case parameter Poff have been acquired and the abnormality determination has been performed. In this case, the value of the abnormality determination completion flag XFIN is set to "1".

In this case, the CPU makes the affirmative determination, "Yes", in step 2205 in FIG. 22 and performs the processes of steps 2255 and 2260. Thus, the CPU performs operations the same as those performed when both the large purge amount case parameter Pon and the small purge amount case parameter Poff have been acquired.

Specifically, when both the large purge amount case parameter Pon and the small purge amount case parameter Poff have been acquired and when the abnormality determination has been performed, the purge control is performed as in the case where neither the large purge amount case parameter Pon nor the small purge amount case parameter Poff has been acquired.

As described above, the second determination system includes the vaporized fuel purge amount control section (refer to steps 2215, 2245, and 2250 in FIG. 22, steps 2320 and 2330 in FIG. 23, and step 2110 in FIG. 21) that controls the purge amount so that the chance that the vaporized fuel ratio becomes less than the second predetermined value (Pth-B) increases as compared to the case where neither the large purge amount case parameter Pon nor the small purge amount case parameter Poff has been acquired yet (refer to the Assumption 1), by inhibiting the vaporized fuel purge when the large purge amount case parameter Pon has already been acquired but the small purge amount case parameter Poff has not been acquired yet (refer to the Assumption 3).

Thus, it is possible to increase the chance to calculate the small purge amount case parameter Poff. As a result, it is possible to acquire both the large purge amount case parameter Pon and the small purge amount case parameter Poff early, so that it is made possible to perform the abnormality determination early.

In addition, the vaporized fuel purge amount control section of the second determination system controls the purge amount (steps 2220, 2235, and 2240 in FIG. 22, steps 2320, 2340, 2350, and 2360 in FIG. 23, and step 2110 in FIG. 21) so that the chance that the vaporized fuel ratio becomes equal to or higher than the first predetermined value (Pth) increases as compared to the case where neither the large purge amount case parameter Pon nor the small purge amount case parameter Poff has been acquired yet (refer to the Assumption 1), by invalidating (ignoring) the purge inhibition request when the small purge amount case parameter Poff has already been acquired but the large purge amount case parameter Pon has not been acquired yet (refer to the Assumption 2) even when the purge inhibition request from another control process has been issued.

Thus, it is possible to increase the chance to calculate the large purge amount case parameter Pon. As a result, it is possible to acquire both the large purge amount case parameter Pon and the small purge amount case parameter Poff early, so that it is made possible to perform the abnormality determination early.

The second determination system may be configured in the form of a following modification, for example. Specifically, when neither the large purge amount case parameter Pon nor the small purge amount case parameter Poff has been acquired, the modification of the second determination system controls the purge amount so that the vaporized fuel ratio becomes equal to or higher than the first predetermined value (Pth) (for example, the modification sets the target purge ratio PGT to a very large first predetermined value) when the load KL and the engine speed NE are within a "predetermined region (first region)", and controls the purge amount so that the vaporized fuel ratio becomes less than the second predetermined value (Pth-B) (for example, the modification sets the target purge ratio PGT to a second predetermined value ("0", for example) smaller than the first predetermined value) when the load KL and the engine speed NE are not within the "predetermined region (first region)".

When the large purge amount case parameter Pon has already been acquired but the small purge amount case parameter Poff has not been acquired yet, the modification of the second determination system controls the purge amount so that the vaporized fuel ratio becomes equal to or higher than the first predetermined value (Pth) when the load KL and the engine speed NE are within a "region (second region) smaller than the first region", and controls the purge amount so that the vaporized fuel ratio becomes less than the second predetermined value (Pth-B) when the load KL and the engine speed NE are not within the "second region".

In addition, when the small purge amount case parameter Poff has already been acquired but the large purge amount case parameter Pon has not been acquired yet, the modification of the second determination system controls the purge amount so that the vaporized fuel ratio becomes equal to or higher than the first predetermined value (Pth) when the load KL and the engine speed NE are within a "region (third region) larger than the first region", and controls the purge amount so that the vaporized fuel ratio becomes less than the second predetermined value (Pth-B) when the load KL and the engine speed NE are not within the "third region".

Thus, this modification also makes it possible to increase the chance to acquire one of the parameters that has not been acquired yet.

(Third Embodiment)

Next, the determination system according to a third embodiment of the invention (hereinafter referred to merely as the "third determination system") will be described.

Figure 1A:
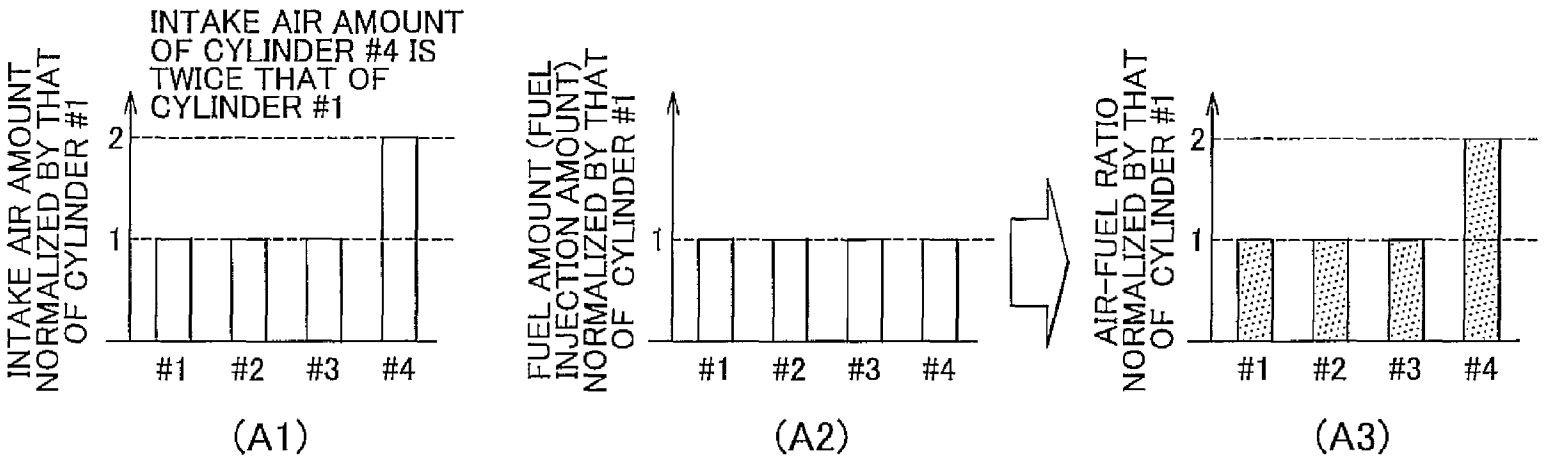
FIG. 1A shows graphs of intake air amount, fuel injection amount, and air-fuel ratio when an inter-cylinder air intake amount variation abnormality occurs.
Figure 1B:
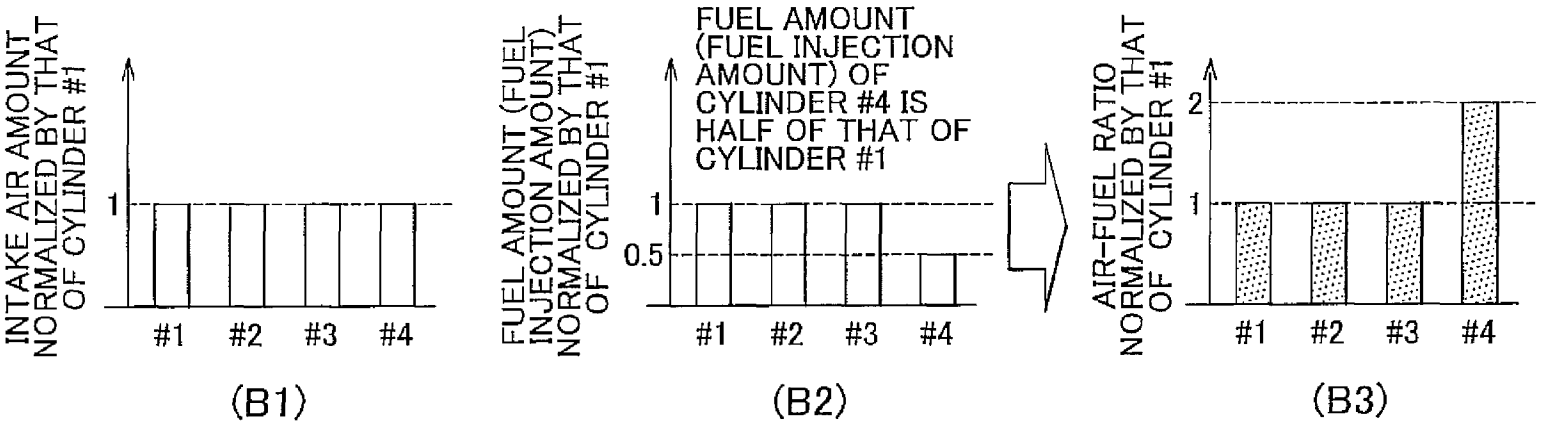
FIG. 1B shows graphs of intake air amount, fuel injection amount, and air-fuel ratio when an inter-cylinder fuel injection amount variation abnormality occurs.
Figure 2A:
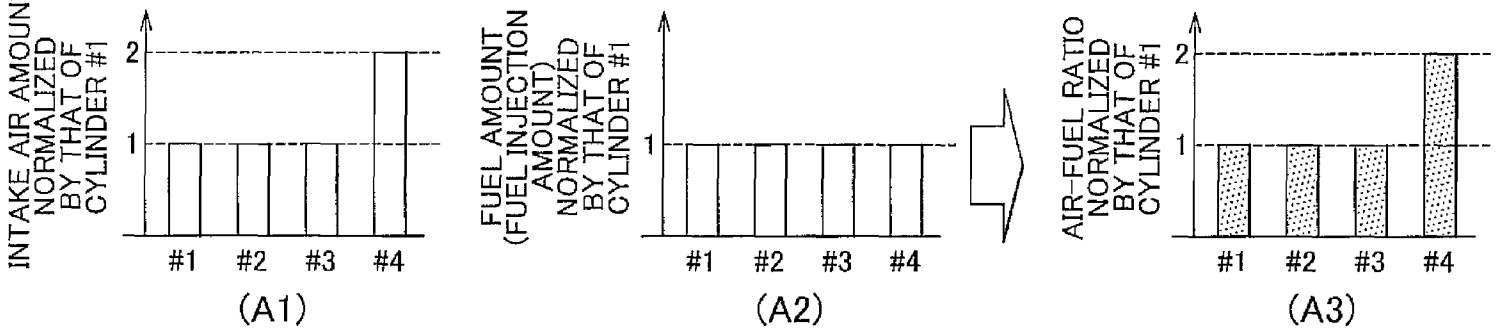
FIG. 2A shows graphs of intake air amount, fuel injection amount, and air-fuel ratio when an inter-cylinder intake air amount variation abnormality occurs and a vaporized fuel ratio is small.
Figure 2B:
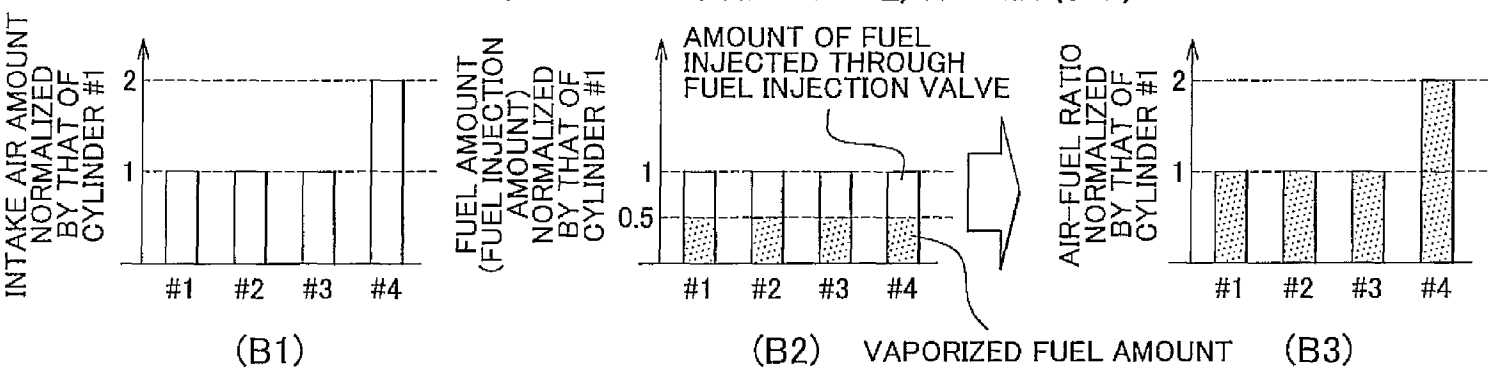
FIG. 2B shows graphs of intake air amount, fuel injection amount, and air-fuel ratio when an inter-cylinder intake air amount variation abnormality occurs and the vaporized fuel ratio is large.
Figure 3A:
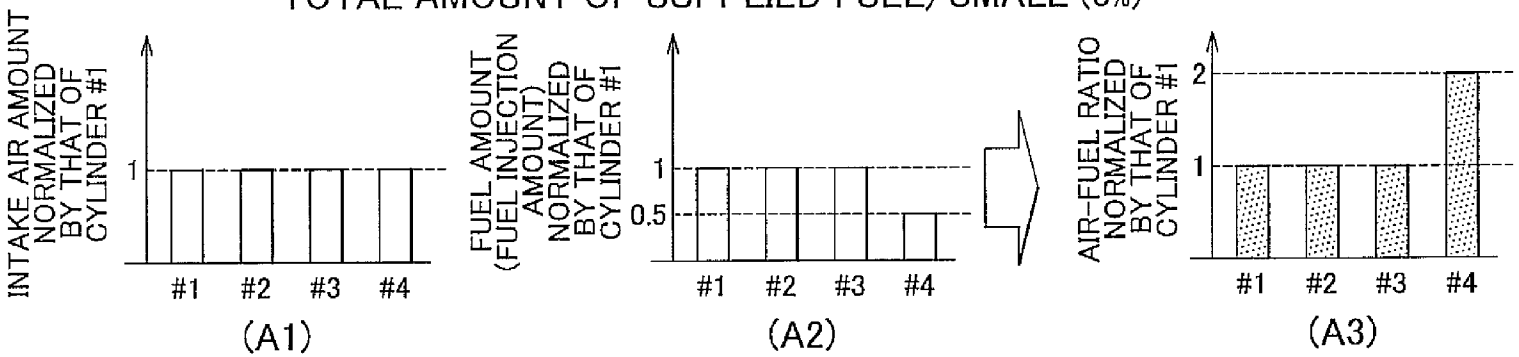
FIG. 3A shows graphs of intake air amount, fuel injection amount, and air-fuel ratio when an inter-cylinder fuel injection amount variation abnormality occurs and the vaporized fuel ratio is small.
Figure 3B:
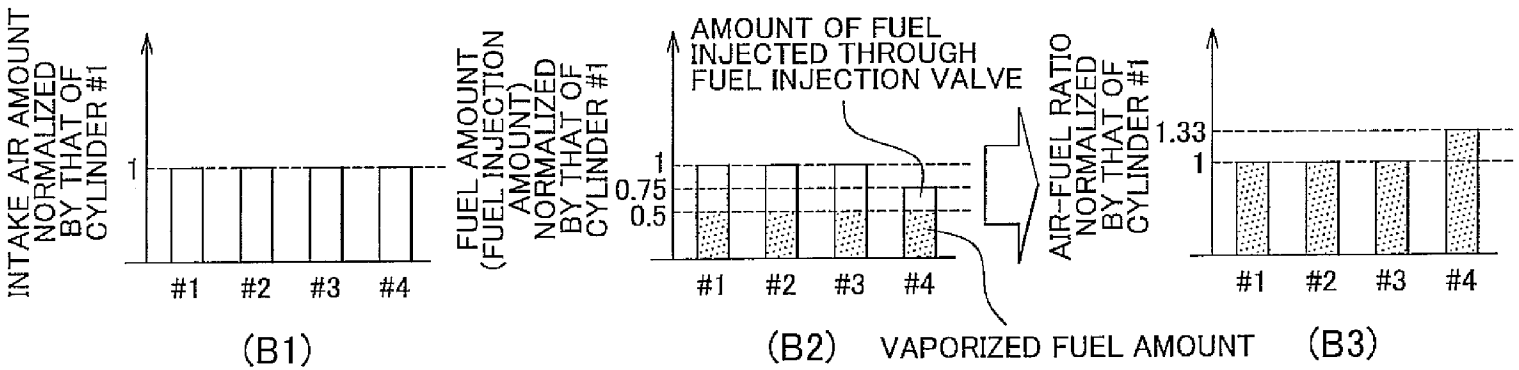
FIG. 3B shows graphs of intake air amount, fuel injection amount, and air-fuel ratio when an inter-cylinder fuel injection amount variation abnormality occurs and the vaporized fuel ratio is large.
Figure 24:
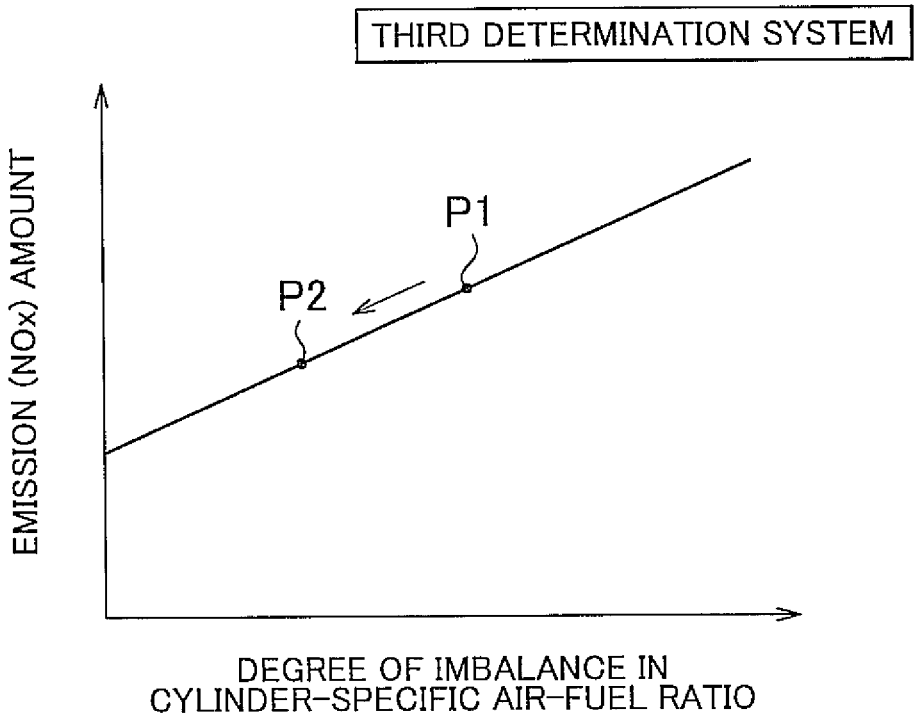
FIG. 24 is a diagram for explaining an effect of an abnormality determination system (third determination system) according to a third embodiment of the invention.

As can be seen from the comparison between (B1), (B2), and (B3) of FIG. 3B and (A1), (A2), and (A3) of FIG. 3A, when the inter-cylinder fuel injection amount variation abnormality is occurring, execution of the vaporized fuel purge reduces the degree of imbalance in cylinder-specific air-fuel ratio. Thus, when it is determined that the inter-cylinder fuel injection amount variation abnormality is occurring, it is possible to reduce the amount of emission (especially the amount of discharge of NOx when the characteristics of the fuel injection valves of the imbalance cylinders become such that the fuel injection valves inject fuel less than the instructed fuel injection amount Fi) from the discharge amount indicated by the point P1 to the discharge amount indicated by the point P2 in FIG. 24, by executing the vaporized fuel purge.

Thus, when, as a result of performing the abnormality determination, it is determined that the inter-cylinder fuel injection amount variation abnormality is occurring (flag XINJIMB=1), the third determination system ignores the purge inhibition request and executes the vaporized fuel purge as long as the purge condition is satisfied even when the purge inhibition request from another control process has been issued. The third determination system is the same as the first determination system on the other points.

(Actual Operation)

Figure 25:
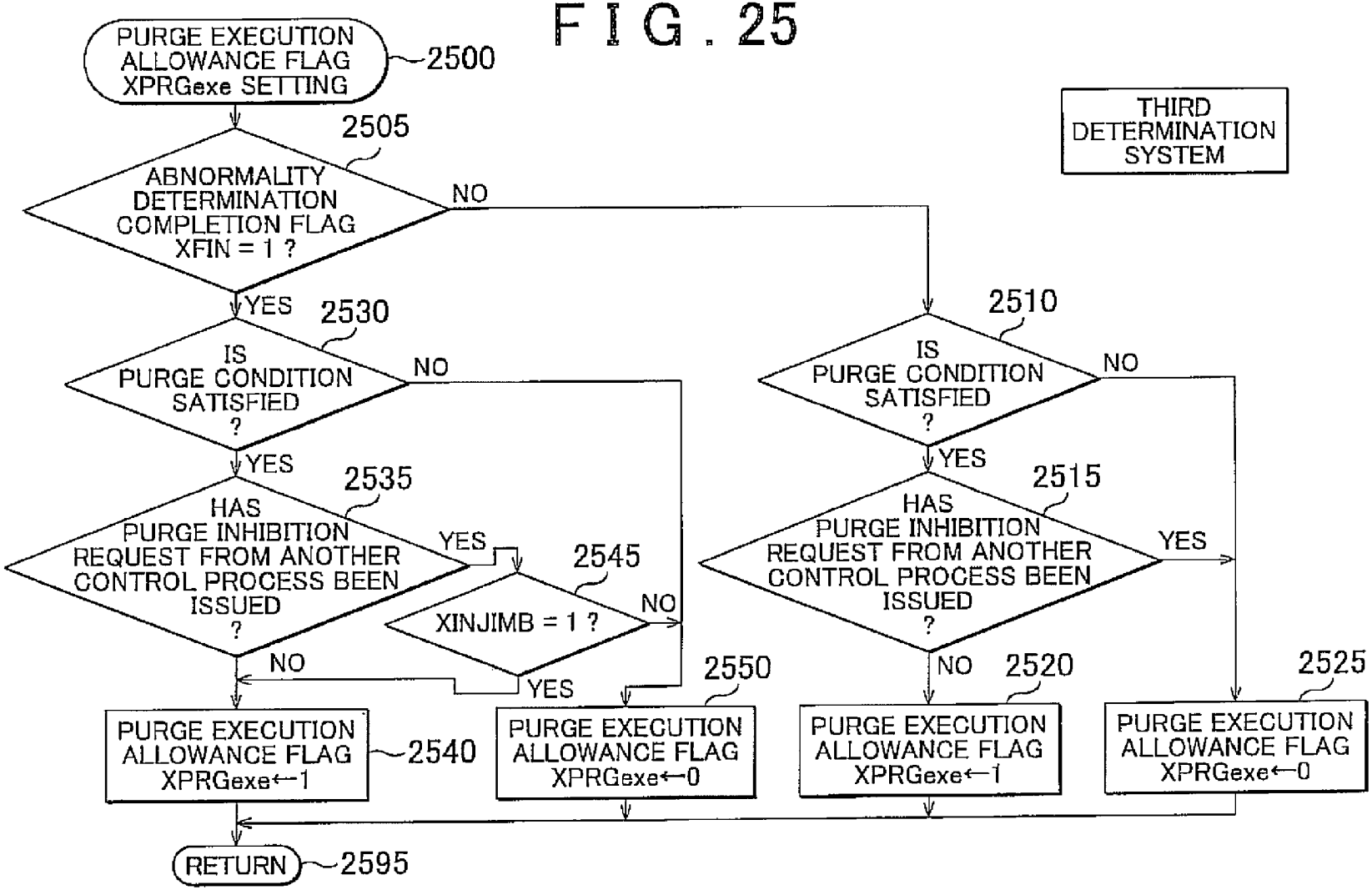
FIG. 25 is a flow chart showing a routine to be executed by the CPU of the third determination system.

The CPU of the third determination system executes a "purge execution allowance flag setting routine" shown in FIG. 25 every time a predetermined period of time has elapsed, in addition to the routines to be executed by the CPU of the first determination system. In addition, the CPU of the third determination system executes the routine shown in FIG. 21 instead of that in FIG. 13. Thus, the CPU starts the process from step 2500 in FIG. 25 at a predetermined timing, proceeds to step 2505, and determines whether the value of the abnormality determination completion flag XFIN is Assume that no abnormality determination has been performed after the current operation of the engine 10 was started. In this case, the value of the abnormality determination completion flag XFIN is set to "0". Thus, the CPU makes the negative determination, "No", in step 2505, proceeds to step 2510, and determines whether the purge condition is satisfied.

In this step, when the purge condition is satisfied, the CPU makes the affirmative determination, "Yes", in step 2510, proceeds to step 2515, and determines whether the purge inhibition request from another control process has been issued. When no purge inhibition request from another control process has been issued, the CPU makes the negative determination, "No", in step 2515, proceeds to step 2520, and sets the value of the purge execution allowance flag XPRGexe to "1". As a result, execution of the vaporized fuel purge is allowed.

On the other hand, if a purge inhibition request from another control process has been issued when the CPU performs the process of step 2515, the CPU makes the affirmative determination, "Yes", in step 2515, proceeds to step 2525, and sets the value of the purge execution allowance flag XPRGexe to "0". As a result, the execution of the vaporized fuel purge is inhibited.

In addition, if the purge condition is not satisfied when the CPU performs the process of step 2510, the CPU proceeds to step 2525 and sets the value of the purge execution allowance flag XPRGexe to "0". As a result, the execution of the vaporized fuel purge is inhibited.

Next, assume that the abnormality determination has been performed. In this case, the value of the abnormality determination completion flag XFIN is set to "1". Thus, when the CPU proceeds to step 2505, the CPU makes the affirmative determination, "Yes", in step 2505, proceeds to step 2530, and determines whether the purge condition is satisfied.

In this step, when the purge condition is satisfied, the CPU makes the affirmative determination, "Yes", in step 2530, proceeds to step 2535, and determines whether the purge inhibition request from another control process has been issued. When no purge inhibition request from another control process has been issued, the CPU proceeds to step 2540 and sets the value of the purge execution allowance flag XPRGexe to "1". As a result, execution of the vaporized fuel purge is allowed.

On the other hand, if a purge inhibition request from another control process has been issued when the CPU performs the process of step 2535, the CPU makes the affirmative determination, "Yes", in step 2535, proceeds to step 2545, and determines whether the value of the fuel injection amount variation abnormality occurrence flag XINJIMB is "1".

In this step, when the value of the fuel injection amount variation abnormality occurrence flag XINJIMB is "1", the CPU makes the affirmative determination, "Yes", in step 2545, proceeds to step 2540, and sets the value of the purge execution allowance flag XPRGexe to "1". Specifically, provided that it has been determined that the inter-cylinder fuel injection amount variation abnormality is occurring, if the purge condition is satisfied, execution of the vaporized fuel purge is allowed even when the purge inhibition request from another control process has been issued. As a result, the emission is improved.

On the other hand, if the value of the fuel injection amount variation abnormality occurrence flag XINJIMB is not "1" when the CPU performs the process of step 2545, the CPU makes the negative determination, "No", in step 2545, proceeds to step 2550, and sets the value of the purge execution allowance flag XPRGexe to "0". As a result, execution of the vaporized fuel purge is inhibited.

In addition, if the purge condition is not satisfied when the CPU performs the process of step 2530, the CPU makes the negative determination, "No", in step 2530, proceeds to step 2550, and sets the value of the purge execution allowance flag XPRGexe to "0". As a result, execution of the vaporized fuel purge is inhibited.

As described above, the third determination system includes the vaporized fuel purge amount control section (steps 2535, 2545, and 2540 in FIG. 25) that is configured to control the purge amount to zero when the purge inhibition request (purge inhibition request from another control process) has been issued based on the operating conditions of the engine 10 (steps 2515 and 2525 in FIG. 25) and allow the control to set the purge amount to a set value that is not zero (that is, to set the value of the purge execution allowance flag XPRGexe to "1") even when a purge inhibition request has been issued, provided that the abnormality determination section determines that "there is an abnormality in the fuel injection valves 33 (flag XINJIMB=1)".

The fuel injection valve 33 injects fuel, whose amount is a certain percentage (X, for example) of the instructed fuel injection amount Fi when the fuel injection valve 33 malfunctions. Thus, the fuel injection valve 33 of the imbalance cylinder injects fuel, whose amount is X·Fi, and the fuel injection valve 33 of the non-imbalance cylinder injects fuel, whose amount is Fi. Thus, the difference in the amount of fuel injection is (1−X)·Fi. Thus, by reducing the instructed fuel injection amount Fi, it is possible to reduce the influence of the imbalance in fuel injection amount between cylinders on the air-fuel ratio. The instructed fuel injection amount Fi is corrected by the purge amount and therefore, in order to reduce the instructed fuel injection amount Fi, it suffices to increase the purge amount.

Thus, the third determination system can reduce the degree of imbalance in cylinder-specific air-fuel ratio when the inter-cylinder fuel injection amount variation abnormality is occurring, so that it is possible to suppress the degradation of emission.

As described above, the determination system according to this embodiment can accurately determine whether the inter-cylinder air intake amount variation abnormality is occurring. Note that the invention is not limited to the above embodiments and various modifications may be adopted within the scope of the invention. For example, the large purge amount case parameter Pon and the small purge amount case parameter Poff (air-fuel ratio imbalance index value) may be acquired by various methods as described below.

(A-1)

The determination system may be configured to acquire the derivative d(abyfs)/dt that is the time derivative of the detected air-fuel ratio abyfs (air-fuel ratio that is obtained by applying the output value Vabyfs to the table Mapabyfs shown in FIG. 7) indicated by the output value Vabyfs of the upstream-side air-fuel ratio sensor 66, and to acquire, as the air-fuel ratio imbalance index value, the value correlating to the acquired derivative d(abyfs)/dt.

An example of the value correlating to the acquired derivative d(abyfs)/dt is the average value of the absolute values of the derivatives d(abyfs)/dt that are acquired during a unit combustion cycle or a natural number multiple of the unit combustion cycle. Another example of the value correlating to the acquired derivative d(abyfs)/dt is the average value, over a plurality of unit combustion cycles, of the maximum value of the absolute values of the derivatives d(abyfs)/dt that are acquired during a unit combustion cycle.

(A-2)

Figure 16D:
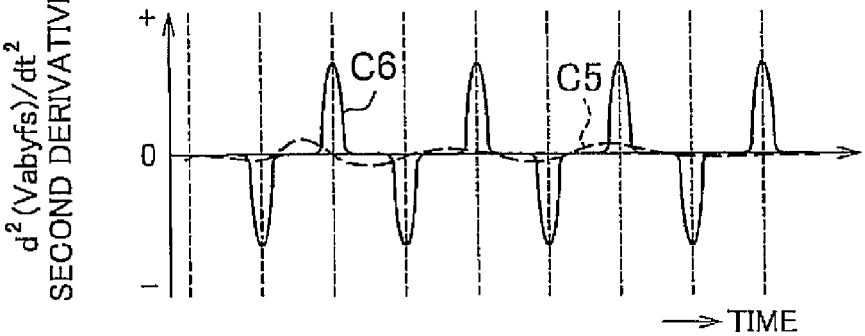

The determination system may be configured to acquire the second time derivative $d^2(Vabyfs)/dt^2$ of the output value Vabyfs of the upstream-side air-fuel ratio sensor 66 and acquire, as the air-fuel ratio imbalance index value, the value correlating to the acquired second time derivative $d^2(Vabyfs)/dt^2$. The second derivative $d^2(Vabyfs)/dt^2$ is relatively small as shown by the broken line C5 in FIG. 16D when the difference in cylinder-specific air-fuel ratio is small and the second derivative $d^2(Vabyfs)/dt^2$ is relatively large as shown by the solid line C6 in FIG. 16D when the difference in cylinder-specific air-fuel ratio is large.

Note that the second derivative $d^2(Vabyfs)/dt^2$ can be obtained by subtracting the output value Vabyfs acquired the fixed sampling time before the present from the current output value Vabyfs to calculate the derivative d(Vabyfs)/dt at every fixed sampling time, and subtracting the derivative d(Vabyfs)/ dt acquired the fixed sampling time before the present from the newly obtained derivative d(Vabyfs)/dt.

An example of the value correlating to the acquired second derivative $d^2(Vabyfs)/dt^2$ is the average value of the absolute values of the second derivative $d^2(Vabyfs)/dt^2$ that are acquired during a unit combustion cycle or a natural number multiple of the unit combustion cycle. Another example of the value correlating to the acquired second derivative $d^2(Vabyfs)/dt^2$ is the average value, over a plurality of unit combustion cycles, of the maximum value of the absolute values of the second derivatives $d^2(Vabyfs)/dt^2$ that are acquired during a unit combustion cycle.

(A-3)

The determination system may be configured to acquire the second time derivative $d^2(abyfs)/dt^2$ of the detected air-fuel ratio abyfs and acquire, as the air-fuel ratio imbalance index value, the value correlating to the acquired second derivative $d^2(byfs)/dt^2$. Because the output value Vabyfs and the detected air-fuel ratio abyfs are substantially in a proportional relation (see FIG. 7), the second derivative $d^2(byfs)/dt^2$ shows a trend similar to that of the second derivative $d^2(Vabyfs)/dt^2$.

An example of the value correlating to the acquired second derivative $d^2(byfs)/dt^2$ is the average value of the absolute values of the second derivatives $d^2(byfs)/dt^2$ that are acquired during a unit combustion cycle or a natural number multiple of the unit combustion cycle. Another example of the value correlating to the acquired second derivative $d^2(byfs)/dt^2$ is the average value, over a plurality of unit combustion cycles, of the maximum value of the absolute values of the second derivatives $d^2(byfs)/dt^2$ that are acquired during a unit combustion cycle.

The values correlating to "the derivative d(Vabyfs)/dt, the derivative d(abyfs)/dt, the second derivative $d^2(Vabyfs)/dt^2$, and the second derivative $d^2(byfs)/dt^2$" are influenced by the intake air amount Ga but are less susceptible to the influence of the engine speed NE. This is because the flow speed of the exhaust gas in the protection cover of the upstream-side air-fuel ratio sensor 66 varies according to the flow speed of the exhaust gas EX that flows near the discharge holes in the protection cover (that is, according to the intake air amount Ga, which is the amount of intake air that is taken in per unit time). Thus, the air-fuel ratio imbalance index value acquired based on these values is not influenced by the engine speed NE and accurately indicates the difference in cylinder-specific air-fuel ratio.

(A-4)

The determination system may be configured to acquire, as the air-fuel ratio imbalance index value, the value correlating to the difference ΔX between the maximum value and the minimum value of the output value Vabyfs of the upstream-side air-fuel ratio sensor 66 within a predetermined period of time (a natural number multiple of the unit combustion cycle, for example) or the value correlating to the difference ΔY between the maximum value and the minimum value of the detected air-fuel ratio abyfs indicated by the output value Vabyfs of the upstream-side air-fuel ratio sensor 66 within the predetermined period of time.

As is clear from the solid line C2 and the broken line C1 shown in FIG. 16B, the difference ΔY (absolute value of ΔY) increases as the difference in cylinder-specific air-fuel ratio increases. Thus, the difference ΔX (absolute value of ΔX) increases as the difference in cylinder-specific air-fuel ratio increases. An example of the value correlating to the difference ΔX (or difference ΔY) is the average value of the absolute values of the differences ΔX (or ΔY) that are acquired during a unit combustion cycle or a natural number multiple of the unit combustion cycle.

(A-5)

The determination system may be configured to acquire, as the air-fuel ratio imbalance index value, the value correlating to the trace length of the output value Vabyfs of the upstream-side air-fuel ratio sensor 66 within a predetermined period of time or the value correlating to the trace length of the detected air-fuel ratio abyfs indicated by the output value Vabyfs of the upstream-side air-fuel ratio sensor 66 within the predetermined period of time. These trace lengths increase as the difference in cylinder-specific air-fuel ratio increases as is clear from FIG. 16B. The value correlating to the trace length is, for example, the average value of the absolute values of the trace lengths that are acquired during a unit combustion cycle or a natural number multiple of the unit combustion cycle.

Note that, for example, the trace length of the detected air-fuel ratio abyfs can be calculated by acquiring the output value Vabyfs every time the fixed sampling time ts has elapsed, converting the output value Vabyfs to a detected air-fuel ratio abyfs, and accumulating the absolute value of the difference between the detected air-fuel ratio abyfs and the detected air-fuel ratio abyfs acquired the fixed sampling time ts before the present.

Note that the determination system may acquire, as the air-fuel ratio imbalance index value, the value that increases as the sub FB learned value KSFBg increases.

In addition, the determination systems described above can be used in V-type engines. In this case, the V-type engine includes a right-bank upstream-side catalyst downstream of the exhaust gas joining portion for two or more cylinders of the right bank. In addition, this V-type engine also includes a left-bank upstream-side catalyst downstream of the exhaust gas joining portion for two or more cylinders of the left bank.

Moreover, the V-type engine includes a right-bank upstream-side air-fuel ratio sensor upstream of the right-bank upstream-side catalyst and a right-bank downstream-side air-fuel ratio sensor downstream of the right-bank upstream-side catalyst, and also includes a left-bank upstream-side air-fuel ratio sensor upstream of the left-bank upstream-side catalyst and a left-bank downstream-side air-fuel ratio sensor downstream of the left-bank upstream-side catalyst. The upstream-side air-fuel ratio sensors are disposed between the exhaust gas joining portion of each bank and the upstream-side catalyst of the corresponding bank as in the case of the upstream-side air-fuel ratio sensor 66. In this case, main feedback control and sub-feedback control for the right bank are performed and independently of such control for the right bank, main feedback control and sub-feedback control for the left bank are performed.

In this case, the determination system may calculate "the air-fuel ratio imbalance index value (large purge amount case parameter Pon and the small purge amount case parameter Poff) of the right bank" based on the output value of the right-bank upstream-side air-fuel ratio sensor, and perform the abnormality determination with respect to the cylinders of the right bank based on these parameters. Similarly, the determination system may calculate "the air-fuel ratio imbalance index value (large purge amount case parameter Pon and the small purge amount case parameter Poff) of the left bank" based on the output value of the left-bank upstream-side air-fuel ratio sensor, and perform the abnormality determination with respect to the cylinders of the left bank based on these parameters.

In addition, the upstream-side air-fuel ratio 66 may be a concentration cell-type (electromotive force) oxygen concentration sensor as in the case of the downstream-side air-fuel ratio sensor 67. Moreover, the determination system may be configured to determine whether the difference between the large purge amount case parameter Pon and the small purge amount case parameter Poff is equal to or greater than the first abnormality determination threshold value Dpinjth, based on "the ratio of the large purge amount case parameter Pon to the small purge amount case parameter Poff or the reciprocal of this ratio" in step 2025 in FIG. 20.

What is claimed is:

1. An abnormality determination system for a multi-cylinder internal combustion engine, comprising:

a plurality of fuel injection valves configured to inject fuel that is a component of a mixture to be supplied to combustion chambers of a plurality of cylinders of the engine;

a vaporized fuel purge device that introduces, into an intake passage of the engine, vaporized fuel that has occurred in a fuel tank for storing the fuel to be supplied to the fuel injection valves;

a vaporized fuel purge amount control section that controls a purge amount that is an amount of vaporized fuel that is introduced into the intake passage according to an operating condition of the engine;

an air-fuel ratio sensor that is disposed at a position downstream of an exhaust gas joining portion of an exhaust passage of the engine, at which exhaust gases of the plurality of cylinders join, and that generates an output value corresponding to an air-fuel ratio of an exhaust gas that passes through the position;

an instructed fuel injection amount determination section that determines an instructed fuel injection amount that is a command value of an amount of fuel to be injected through each of the plurality of fuel injection valves by feedback correcting the amount of fuel that is injected through each of the fuel injection valves so that the air-fuel ratio indicated by the output value of the air-fuel ratio sensor is brought to a predetermined target air-fuel ratio;

an injection command signal sending section that sends an injection command signal to the plurality of fuel injection valves so that the fuel, whose amount corresponds to the instructed fuel injection amount, is injected through each of the plurality of fuel injection valves;

an index value acquisition section that, based on the output value of the air-fuel ratio sensor, acquires an air-fuel ratio imbalance index value that increases as a degree of imbalance, between the plurality of cylinders, in cylinder-specific air-fuel ratio that is an air-fuel ratio of the mixture to be supplied to each of the plurality of cylinders increases; and an abnormality determination section that determines whether an abnormality is occurring based on the air-fuel ratio imbalance index value, wherein the index value acquisition section acquires, as a large purge amount case parameter, the air-fuel ratio imbalance index value that is acquired while a vaporized fuel ratio that is a ratio of the amount of vaporized fuel to be supplied to the engine to a total amount of fuel to be supplied to the engine is equal to or higher than a first predetermined value, and acquires, as a small purge amount case parameter, the air-fuel ratio imbalance index value that is acquired while the vaporized fuel ratio is lower than a second predetermined value that is equal to or less than the first predetermined value, and, when an absolute value of a difference between the small purge amount case parameter and the large purge amount case parameter is less than a first abnormality determination threshold value and one of following conditions is satisfied: the small purge amount case parameter is equal to or greater than a second abnormality determination threshold value; and the large purge amount case parameter is equal to or greater than a third abnormality determination threshold value, the abnormality determination section determines that an intake air amount abnormality that a degree of imbalance, between the plurality of cylinders, in an amount of intake air to be supplied to each of the plurality of cylinders is equal to or greater than an allowable value is occurring.

2. The abnormality determination system according to claim 1, wherein the abnormality determination section is configured to determine that an abnormality is occurring in the fuel injection valves when the absolute value of the difference between the small purge amount case parameter and the large purge amount case parameter is equal to or greater than the first abnormality determination threshold value.

3. The abnormality determination system according to claim 2, wherein the vaporized fuel purge amount control section is configured to control the purge amount to zero when a purge inhibition request has been issued based on the operating condition of the engine and allow control to set the purge amount to a set value that is not zero even when the purge inhibition request has been issued, provided that the abnormality determination section determines that there is an abnormality in the fuel injection valves.

4. The abnormality determination system according to claim 1, wherein, when the large purge amount case parameter has already been acquired but the small purge amount case parameter has not been acquired yet, the vaporized fuel purge amount control section controls the purge amount so that a chance that the vaporized fuel ratio becomes less than the second predetermined value increases as compared to a case where neither the large purge amount case parameter nor the small purge amount case parameter has been acquired yet.

5. The abnormality determination system according to claim 1, wherein, when the small purge amount case parameter has already been acquired but the large purge amount case parameter has not been acquired yet, the vaporized fuel purge amount control section controls the purge amount so that a chance that the vaporized fuel ratio becomes equal to or higher than the first predetermined value increases as compared to a case where neither the large purge amount case parameter nor the small purge amount case parameter has been acquired yet.

* * * * *